US010070766B2

(12) United States Patent
Patterson et al.

(10) Patent No.: US 10,070,766 B2
(45) Date of Patent: Sep. 11, 2018

(54) HARD SURFACE CLEANING DEVICES

(71) Applicant: Unger Marketing International, LLC, Bridgeport, CT (US)

(72) Inventors: Joseph K. Patterson, Monroe, CT (US); James M. Buckley, New Hartford, CT (US); John Lombardo, Ridgefield, CT (US); Stephen Huda, Shelton, CT (US); Paul H. Adams, Monroe, CT (US); Bryan Lee Roberts, Jr., Dormagen (DE); Frank Wilde, Essen (DE)

(73) Assignee: Unger Marketing International, LLC, Bridgeport, CT (US)

( * ) Notice: Subject to any disclaimer, the term of this patent is extended or adjusted under 35 U.S.C. 154(b) by 0 days.

(21) Appl. No.: 15/704,993

(22) Filed: Sep. 14, 2017

(65) Prior Publication Data

US 2018/0070791 A1 Mar. 15, 2018

Related U.S. Application Data

(60) Provisional application No. 62/394,643, filed on Sep. 14, 2016, provisional application No. 62/452,891, filed on Jan. 31, 2017.

(51) Int. Cl.
*B08B 3/00* (2006.01)
*A47L 13/22* (2006.01)
(Continued)

(52) U.S. Cl.
CPC ..... *A47L 13/22* (2013.01); *A47L 13/26* (2013.01); *B05B 9/08* (2013.01); *B05B 12/002* (2013.01);
(Continued)

(58) Field of Classification Search
None
See application file for complete search history.

(56) References Cited

U.S. PATENT DOCUMENTS 2,104,161 A 12/1934 Koukal
4,776,716 A 10/1988 Huang
(Continued)

FOREIGN PATENT DOCUMENTS

CA 2730814 8/2011
CA 2893297 6/2014

OTHER PUBLICATIONS

HooverTwinTank_2011_Manual, 13 pages.
(Continued)

*Primary Examiner* — Eric Wayne Golightly
(74) *Attorney, Agent, or Firm* — Ohlandt, Greeley, Ruggiero, and Perle, LLP

(57) ABSTRACT

A cleaning device is provided that includes a cleaning element, a cleaning head, a housing, an electric pump, a battery, a container of cleaning fluid, an activation button, and a spray nozzle. The cleaning element and the cleaning head have spray openings that are in registration with one another. The container forms a fluid and air tight connection with the pump. The activation button places the pump and the battery in electrical communication. The spray nozzle forms a fluid tight and air tight connection with the pump so that the pump is configured to spray fluid from the container through the first and second spray openings onto a surface to be cleaned. The cleaning head, the cleaning element, and the spray nozzle define a cavity that traps spray from the spray nozzle between the cleaning device and the surface to be cleaned.

24 Claims, 48 Drawing Sheets

(51) Int. Cl.

| | |
|---|---|
| ***B25G 1/04*** | (2006.01) |
| ***B05B 12/00*** | (2018.01) |
| ***A47L 13/26*** | (2006.01) |
| ***B05B 9/08*** | (2006.01) |
| *B65D 47/20* | (2006.01) |
| *B25G 1/10* | (2006.01) |

(52) U.S. Cl.
CPC ..... *B25G 1/04* (2013.01); *B25G 1/102* (2013.01); *B65D 47/20* (2013.01)

(56) References Cited

U.S. PATENT DOCUMENTS

| | | | |
|---|---|---|---|
| 4,863,299 | A | 9/1989 | Osberghaus et al. |
| 5,271,682 | A | 12/1993 | Realdon |
| 5,726,388 | A | 3/1998 | Ferland |
| 5,735,620 | A | 4/1998 | Ford |
| 5,888,006 | A | 3/1999 | Ping et al. |
| 6,142,750 | A | 11/2000 | Benecke |
| 6,497,525 | B1 | 12/2002 | Huang |
| 6,540,424 | B1 | 4/2003 | Hall et al. |
| 6,551,001 | B2 | 4/2003 | Aberegg et al. |
| 6,579,023 | B2 | 6/2003 | Kunkler et al. |
| 6,612,768 | B2 | 9/2003 | Zorzo |
| 6,655,866 | B1 | 12/2003 | Morad et al. |
| 6,659,670 | B1 | 12/2003 | Blouse |
| 6,663,306 | B2 | 12/2003 | Policicchio et al. |
| 6,669,391 | B2 | 12/2003 | Policicchio et al. |
| 6,722,806 | B2 | 4/2004 | Kunkler et al. |
| 6,726,388 | B1 | 4/2004 | Monahan |
| 6,854,911 | B2 | 2/2005 | Policicchio et al. |
| 6,854,912 | B2 | 2/2005 | Dyer et al. |
| 6,893,180 | B2 | 5/2005 | Hall et al. |
| 6,899,485 | B2 | 5/2005 | Hall et al. |
| 6,953,299 | B2 | 10/2005 | Wang et al. |
| 6,960,042 | B1 | 11/2005 | Hsiao |
| 6,964,535 | B2 | 11/2005 | Bell et al. |
| 6,981,533 | B2 | 1/2006 | Zorzo |
| 6,986,618 | B2 | 1/2006 | Hall et al. |
| 6,986,619 | B2 | 1/2006 | Hall et al. |
| 7,004,658 | B2 | 2/2006 | Hall et al. |
| 7,048,458 | B2 | 5/2006 | Hall et al. |
| 7,048,804 | B2 | 5/2006 | Kisela et al. |
| 7,056,050 | B2 | 6/2006 | Sacks |
| 7,159,275 | B2 | 1/2007 | Chang |
| 7,160,044 | B2 | 1/2007 | Dyer et al. |
| 7,163,349 | B2 | 1/2007 | Policicchio et al. |
| 7,172,099 | B2 | 2/2007 | Hofte et al. |
| 7,191,486 | B1 | 3/2007 | Michelson et al. |
| 7,431,524 | B2 | 10/2008 | Sacks |
| 7,530,136 | B1 | 5/2009 | Ball |
| 7,618,206 | B2 | 11/2009 | Sacks |
| 7,699,551 | B2 | 4/2010 | Suda et al. |
| 7,708,485 | B2 | 5/2010 | Tanaka et al. |
| 7,722,273 | B2 | 5/2010 | Tanaka et al. |
| 7,850,384 | B2 | 12/2010 | Sacks |
| 8,069,520 | B2 | 12/2011 | Mattucci et al. |
| 8,079,770 | B2 | 12/2011 | Widmer et al. |
| 8,096,723 | B2 | 1/2012 | Bae |
| 8,109,685 | B1 | 2/2012 | Vito |
| 8,186,898 | B2 | 5/2012 | Bradbury et al. |
| 8,205,293 | B2 | 6/2012 | Rosenzweig et al. |
| 8,241,427 | B1 | 8/2012 | Crawford et al. |
| 8,267,607 | B2 | 9/2012 | Harris |
| 8,425,137 | B1 | 4/2013 | Sampaio |
| 8,449,212 | B2 | 5/2013 | Crawford et al. |
| 8,596,896 | B2 | 12/2013 | Kimura |
| 8,641,309 | B2 | 2/2014 | Perry et al. |
| 8,662,778 | B2 | 3/2014 | Crawford et al. |
| 8,667,637 | B2 | 3/2014 | Vrdoljak et al. |
| 8,807,858 | B2 | 8/2014 | Fitzpatrick et al. |
| 8,834,053 | B2 | 9/2014 | Van Landingham, Jr. et al. |
| 8,844,088 | B2 | 9/2014 | Garcia Castillo |
| 8,894,315 | B2 | 11/2014 | Dingert et al. |
| 8,926,210 | B2 | 1/2015 | Orubor |
| 8,927,480 | B2 | 1/2015 | Williams et al. |
| 9,044,132 | B2 | 6/2015 | Kaminer et al. |
| 2002/0166573 | A1 | 11/2002 | Policicchio |
| 2003/0103795 | A1 | 6/2003 | Hollars et al. |
| 2003/0126710 | A1 | 7/2003 | Policicchio et al. |
| 2004/0146333 | A1 | 7/2004 | Fu |
| 2004/0223803 | A1 | 11/2004 | Fahy et al. |
| 2005/0031404 | A1 | 2/2005 | Tsai et al. |
| 2005/0089360 | A1 | 4/2005 | Garabedian, Jr. et al. |
| 2005/0191116 | A1 | 9/2005 | Flanery et al. |
| 2005/0254882 | A1 | 11/2005 | Hofte |
| 2006/0039743 | A1 | 2/2006 | Mensink et al. |
| 2006/0110207 | A1 | 5/2006 | Augustinus Hofte et al. |
| 2006/0213017 | A1 | 9/2006 | Bele et al. |
| 2006/0222441 | A1 | 10/2006 | Tanaka |
| 2007/0140774 | A1 | 6/2007 | Dyer et al. |
| 2007/0231046 | A1 | 10/2007 | Whiffen et al. |
| 2008/0038045 | A1 | 2/2008 | Hofte et al. |
| 2008/0066242 | A1 | 3/2008 | Aiyar |
| 2008/0205972 | A1 | 8/2008 | LaFlamme et al. |
| 2010/0043167 | A1 | 2/2010 | Bradbury |
| 2011/0158740 | A1 | 6/2011 | Kandasamy et al. |
| 2012/0227763 | A1 | 9/2012 | Hayes |
| 2013/0263396 | A1 | 10/2013 | Crawford et al. |
| 2013/0263398 | A1 | 10/2013 | Irwin et al. |
| 2014/0259510 | A1 | 9/2014 | Conrad |
| 2014/0317868 | A1 | 10/2014 | Fitzpatrick et al. |
| 2015/0082570 | A1 | 3/2015 | Davidshofer et al. |
| 2015/0089757 | A1 | 4/2015 | Davidshofer et al. |
| 2015/0101140 | A1 | 4/2015 | Pierce |
| 2015/0201820 | A1 | 7/2015 | Escobar |
| 2015/0297054 | A1 | 10/2015 | Weeks |
| 2015/0305588 | A1 | 10/2015 | Dingert |
| 2016/0374532 | A1 | 12/2016 | Patterson |

OTHER PUBLICATIONS

International Search Report (ISR) of the International Search Authority in corresponding International Application No. PCT/US2017/051621 dated Dec. 11, 2017.

Written Opinion of the International Search Authority in corresponding International Application No. PCT/US2017/051621 dated Dec. 11, 2017.

HARD SURFACE CLEANING DEVICES

CROSS REFERENCE TO RELATED APPLICATIONS

This application claims the benefit of U.S. Provisional Application No. 62/394,643 filed on Sep. 14, 2016 and claims the benefit of U.S. Provisional Application No. 62/452,891 filed on Jan. 31, 2017, the entire contents of both of which are incorporated by reference herein. Additionally, this application incorporates by reference the entire contents of U.S. Provisional Application Ser. No. 62/185,382 filed Jun. 26, 2015 and U.S. application Ser. No. 14/983,883 filed Dec. 30, 2015.

BACKGROUND

1. Field of the Disclosure

The present disclosure is related to cleaning devices. More particularly, the present disclosure is related to cleaning devices that spray cleaning fluids to assist the cleaning of hard surfaces.

2. Description of Related Art

Cleaning devices that allow for the cleaning of hard surfaces such as, but not limited to, window, walls, counters, floors, mirrors, tiles, tables, and others are known. Some prior art cleaning devices are also known to include cleaning fluid spraying systems—that allow the user to spray cleaning fluid onto the surface to be cleaned.

However, it has been determined by the present disclosure that such prior art cleaning devices are less than optimal.

Accordingly, there is a need for improved hard surface cleaning devices that improve upon, overcome, alleviate, and/or mitigate the deleterious effects and inefficiencies of prior art devices.

SUMMARY

A cleaning device is provided that includes a housing, a cleaning head, a container, a cleaning element, and a spray nozzle. The housing defines an internal cavity having a power source in selective electrical communication with a pump. The container can be removably stored or fixed in the housing and includes a cleaning fluid therein. The container contains a fluid and has an air tight connection with an inlet of the pump. The cleaning element is connected to the cleaning head and has a second spray opening in registration with the first spray opening. The spray nozzle is in fluid communication with an outlet of the pump. The spray nozzle is positioned on the cleaning head so as to spray the cleaning fluid from the container through the first spray opening onto a surface being cleaned.

A cleaning device is provided that includes a cleaning element, a cleaning head, a housing, an electric pump, a battery, a container of cleaning fluid, an activation button, and a spray nozzle. The cleaning element has a first spray opening and the cleaning head has a second spray opening. The cleaning element and cleaning head are connected so that the first and second spray openings are in registration with one another. The housing is connected to the cleaning head and the electric pump and battery are in the housing. The container forms a fluid and air tight connection with the pump. The activation button places the pump and the battery in electrical communication. The spray nozzle forms a fluid tight and air tight connection with the pump so that the pump is configured to spray fluid from the container through the first and second spray openings onto a surface to be cleaned. The cleaning head, the cleaning element, and the spray nozzle define a cavity that traps spray from the spray nozzle between the cleaning device and the surface to be cleaned.

In some embodiments alone or in combination with one or more of the aft mentioned embodiments, the spray nozzle is positioned on the cleaning head in a position selected from the group consisting of recessed with respect to a bottom of the cleaning head, flush with the bottom of the cleaning head, and extending from the bottom of the cleaning head a distance less than a thickness of the cleaning element.

In some embodiments alone or in combination with one or more of the afore and/or aft mentioned embodiments, the cleaning element is removably connected to the cleaning head.

In some embodiments alone or in combination with one or more of the afore and/or aft mentioned embodiments, the cleaning element is a microfiber cleaning cloth.

In some embodiments alone or in combination with one or more of the afore and/or aft mentioned embodiments, the cleaning element is selected from the group consisting a washable fabric, a disposable fabric, a woven fabric, a non-woven fabric, a microfiber fabric, a fabric made of natural material, a fabric made of synthetic material, a brush, a melamine foam, and any combinations thereof.

In some embodiments alone or in combination with one or more of the afore and/or aft mentioned embodiments, the cleaning head is removably connected to the housing.

In some embodiments alone or in combination with one or more of the afore and/or aft mentioned embodiments, the cleaning head is pivotally connected to the housing.

In some embodiments alone or in combination with one or more of the afore and/or aft mentioned embodiments, the container is a refillable rigid container having a vent.

In some embodiments alone or in combination with one or more of the afore and/or aft mentioned embodiments, the rigid container has a removable cap.

In some embodiments alone or in combination with one or more of the afore and/or aft mentioned embodiments, the housing further has a cover that hingeably covers the cap.

In some embodiments alone or in combination with one or more of the afore and/or aft mentioned embodiments, the rigid container has at least one transparent region that can be viewed from outside of the housing.

In some embodiments alone or in combination with one or more of the afore and/or aft mentioned embodiments, the rigid container has a vent that is normally closed when the pump and the battery are not in electrical communication and is opened by a negative pressure applied on the container when the pump and the battery are in electrical communication.

In some embodiments alone or in combination with one or more of the afore and/or aft mentioned embodiments, the vent is the only valve in a fluid path from the container through the spray nozzle.

In some embodiments alone or in combination with one or more of the afore and/or aft mentioned embodiments, the refillable rigid container has a flexible tube that places the cleaning fluid in communication with the pump.

In some embodiments alone or in combination with one or more of the afore and/or aft mentioned embodiments, the cleaning device includes a weighted port on the flexible tubing in the container.

In some embodiments alone or in combination with one or more of the afore and/or aft mentioned embodiments, the weighted port further has a filter.

In some embodiments alone or in combination with one or more of the afore and/or aft mentioned embodiments, the cleaning device includes a grommet forming a fluid tight seal between the container and the flexible tube to allow the tube to pass through the container.

In some embodiments alone or in combination with one or more of the afore and/or aft mentioned embodiments, the battery is a rechargeable battery.

In some embodiments alone or in combination with one or more of the afore and/or aft mentioned embodiments, the battery is removably received in the housing.

In some embodiments alone or in combination with one or more of the afore and/or aft mentioned embodiments, the housing includes a handle. The handle os positioned on the housing to allow use in cleaning surfaces selected from the group consisting of horizontal surfaces, vertical surfaces, and surfaces having any desired angle therebetween.

A cleaning kit is also provided. The kit includes a cleaning device and a station having one or more of a battery holding area, a pole holding area, a cleaning element holding area, a cleaning fluid holding area, and a device holding area.

In some embodiments alone or in combination with one or more of the afore and/or aft mentioned embodiments, the station includes a battery holding area configured to hold more than one battery.

In some embodiments alone or in combination with one or more of the afore and/or aft mentioned embodiments, the station includes a battery recharging area configured to charge the battery.

In some embodiments alone or in combination with one or more of the afore and/or aft mentioned embodiments, the station includes a device holding area configured to hold the cleaning device so that contacts on the battery mate with corresponding contacts in the device holding area.

The above-described and other features and advantages of the present disclosure will be appreciated and understood by those skilled in the art from the following detailed description, drawings, and appended claims.

DETAILED DESCRIPTION

Figure 1:
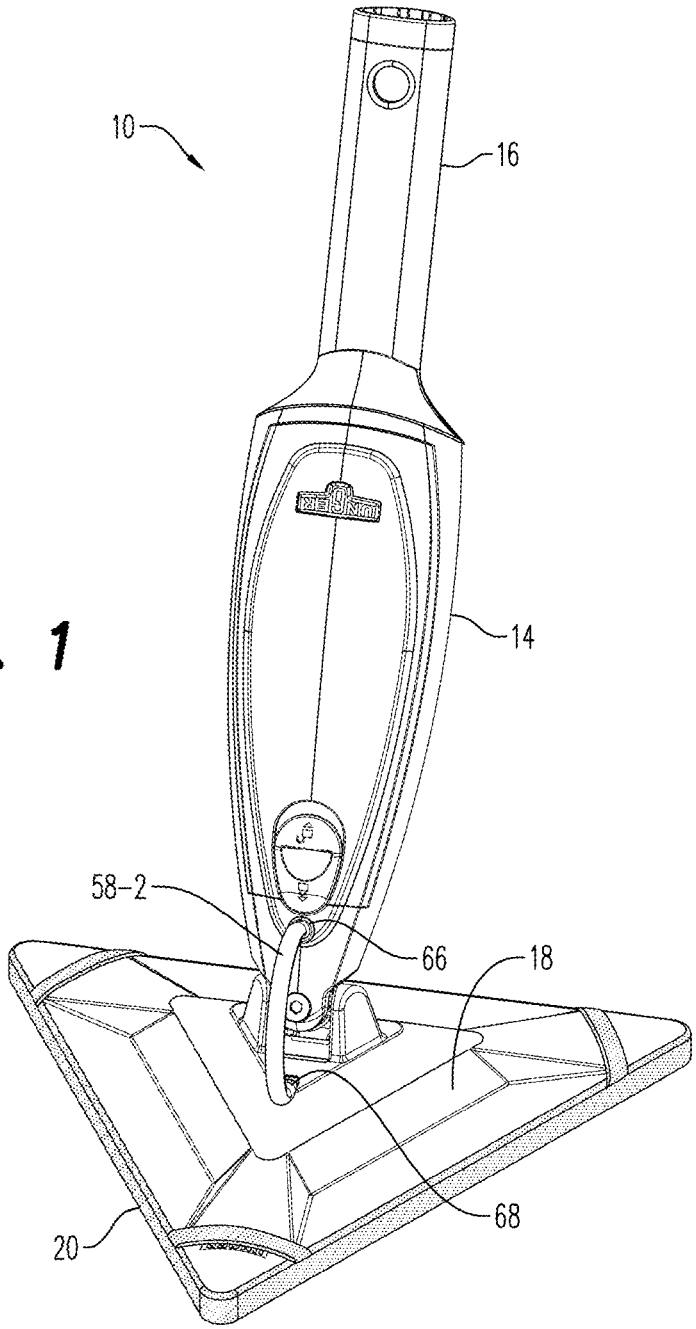
FIG. 1 is a front perspective view of an exemplary embodiment of a cleaning device according to the present disclosure.
Figure 2:
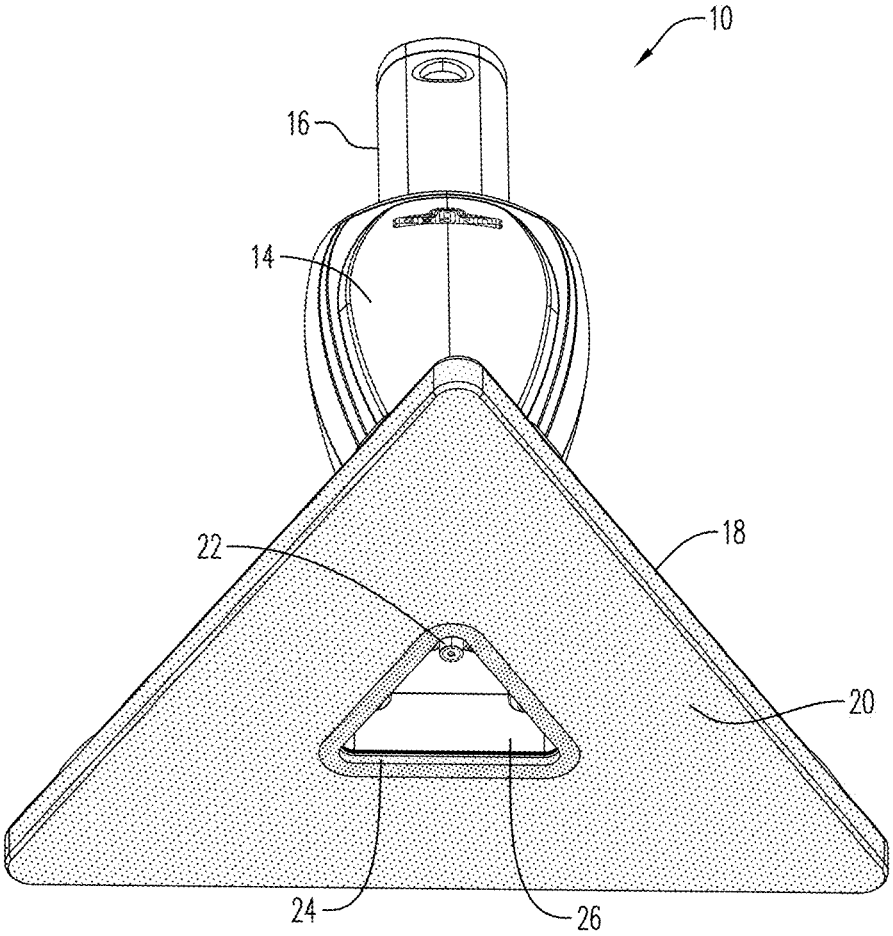
FIG. 2 is a rear perspective view of the cleaning device of FIG. 1.
Figure 3:
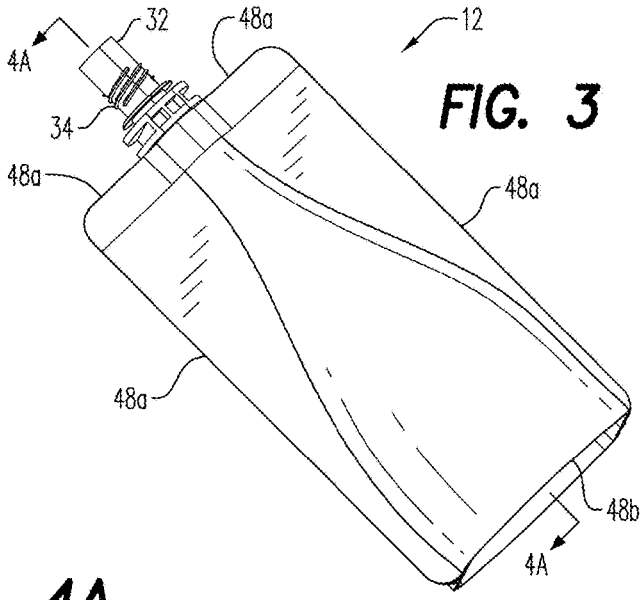
FIG. 3 is a side view of an exemplary embodiment of a cleaning fluid pouch for use with the device of FIG. 1.
Figure 4A:
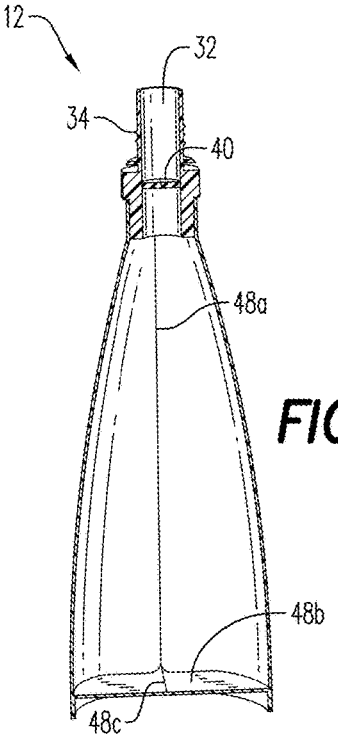
FIG. 4*a* is a section view of the cleaning fluid pouch of FIG. 3 taken along line 4*a*-4*a;*
Figure 4B:
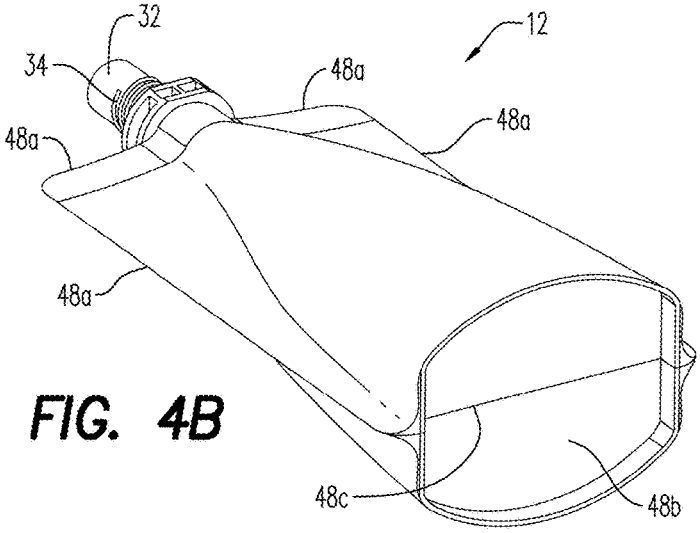
FIG. 4*b* is a bottom view of the cleaning fluid pouch of FIG. 3.
Figure 5:
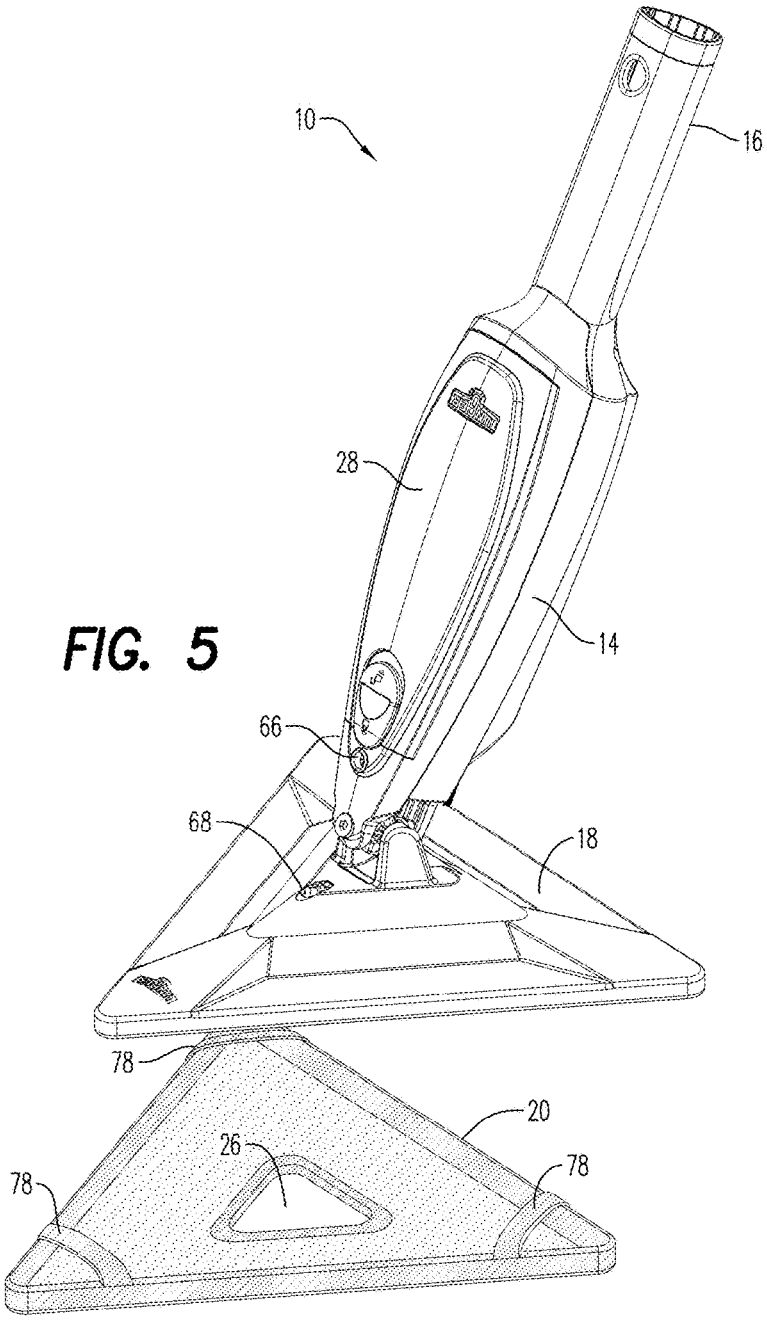
FIG. 5 is another front rear perspective view of the cleaning device of FIG. 1 illustrating the removability of the cleaning element.
Figure 6:
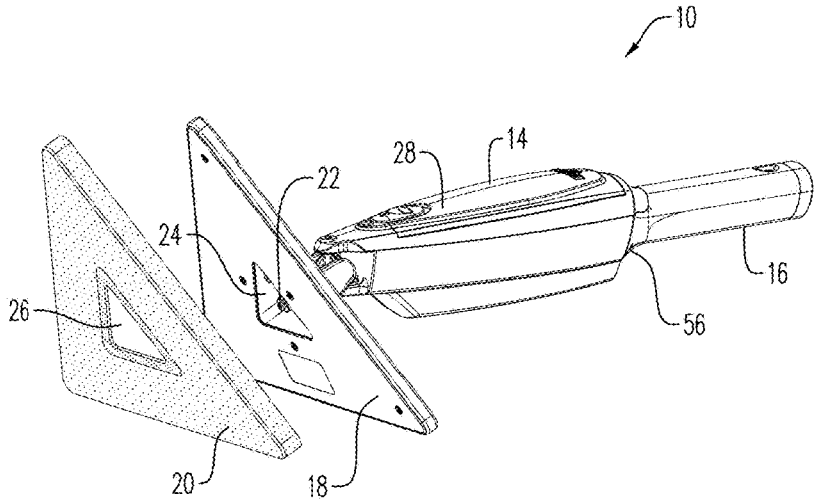
FIG. 6 is a bottom perspective view of the cleaning device of FIG. 1 illustrating the removability of the cleaning element.
Figure 7:
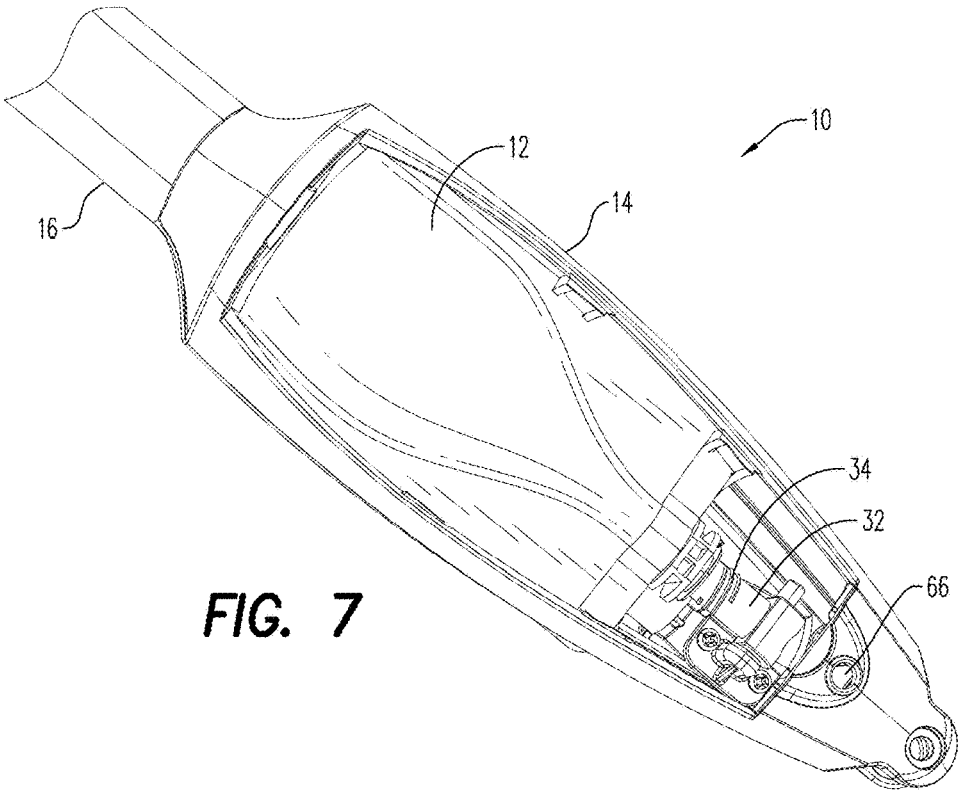
FIG. 7 is a top perspective view of the cleaning device of FIG. 1 having a housing cover removed to illustrate the cleaning pouch installed in an internal cavity.
Figure 8:
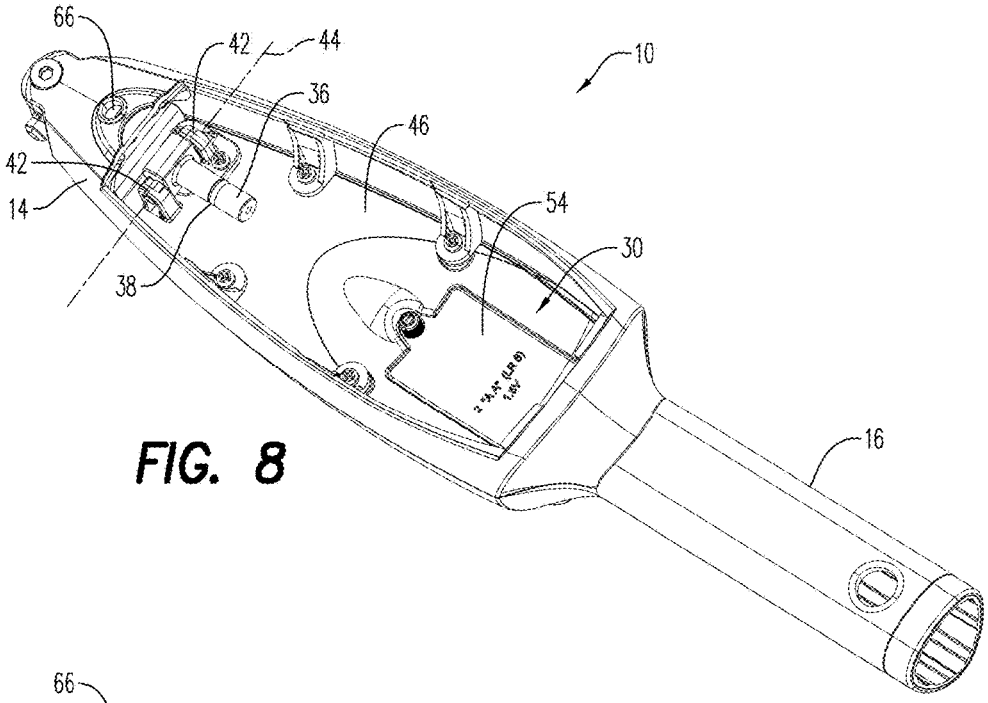
FIG. 8 is a top perspective view of the cleaning device of FIG. 1 having the housing cover and cleaning pouch removed.
Figure 9:
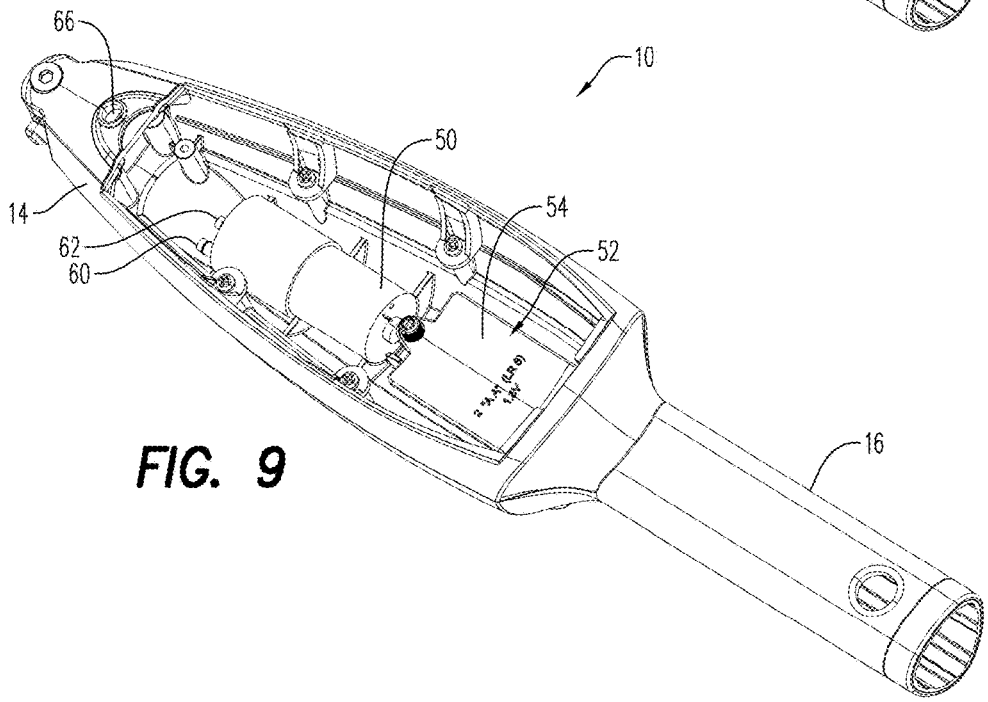
FIG. 9 is a top perspective view of the cleaning device of FIG. 1 illustrating the internal cavity.
Figure 10:
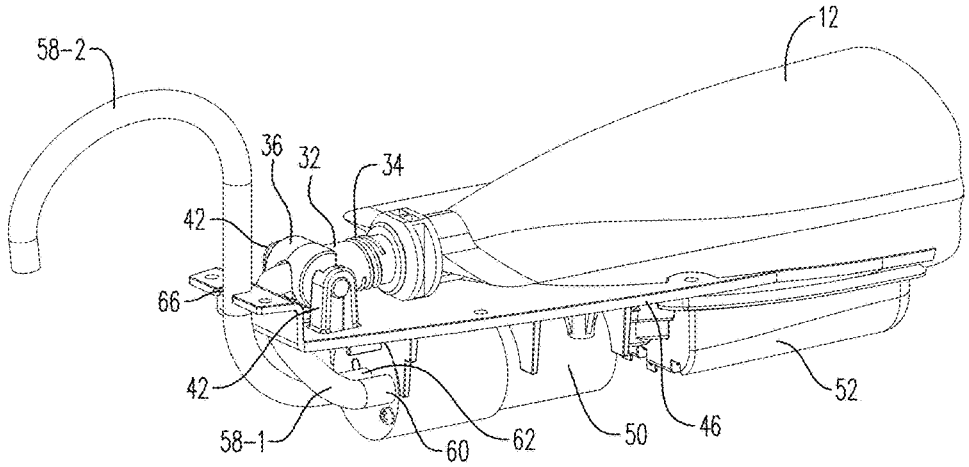
FIG. 10 is a top perspective view of the pump system of FIG. 9.
Figure 11:
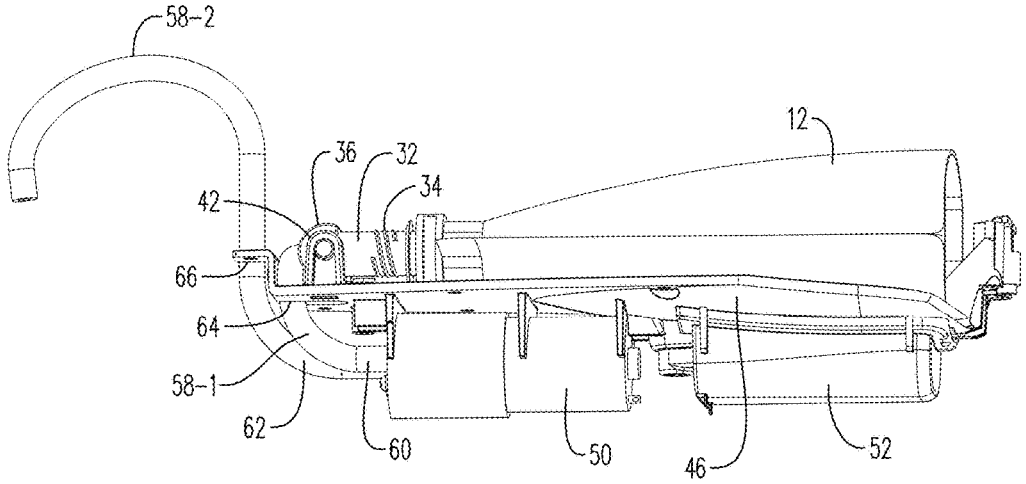
FIG. 11 is a side perspective view of the pump system of FIG. 9.
Figure 12:
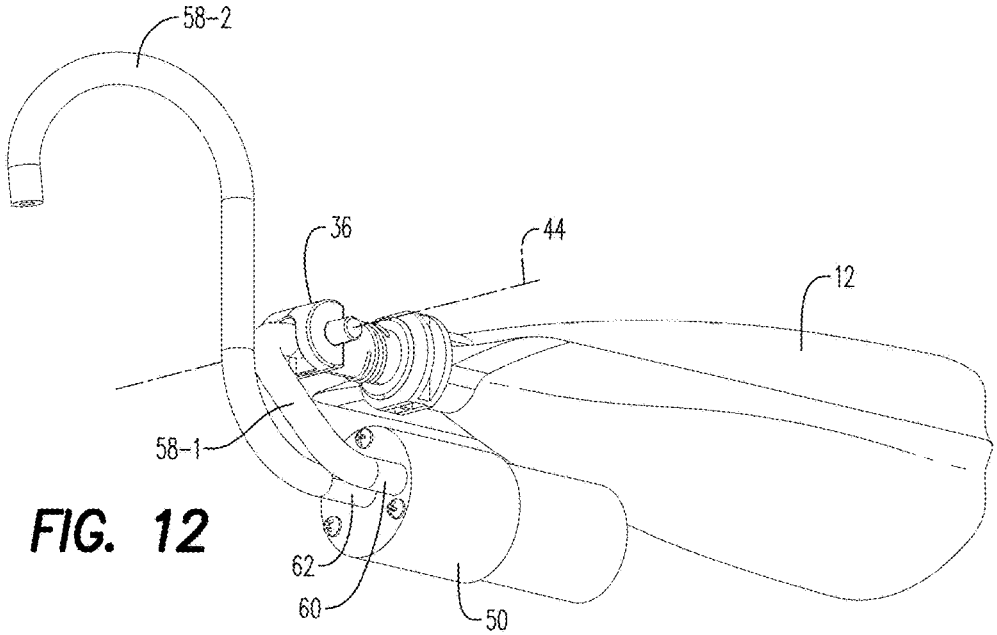
FIG. 12 is a front perspective view of portions of the pump system of FIG. 9.
Figure 13:
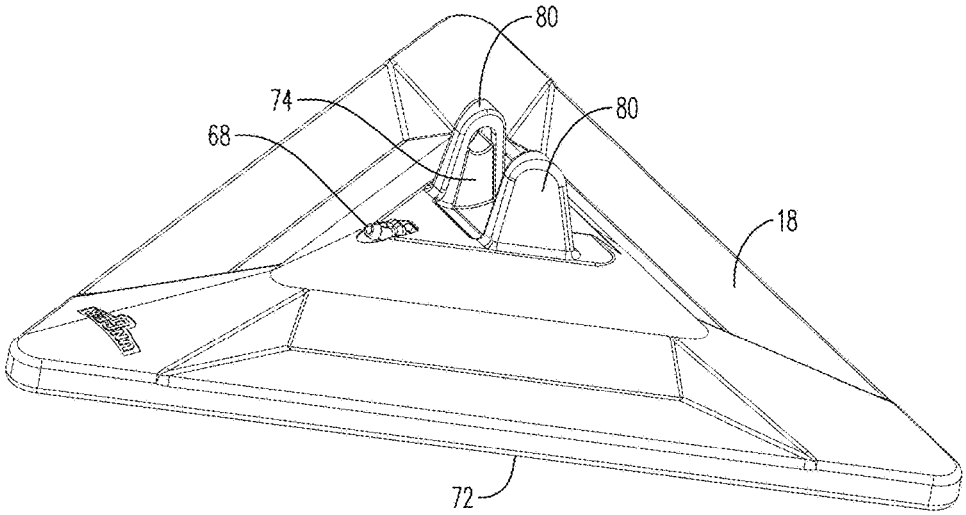
FIG. 13 is a top perspective view of an exemplary embodiment of a cleaning head according to the present disclosure.
Figure 14:
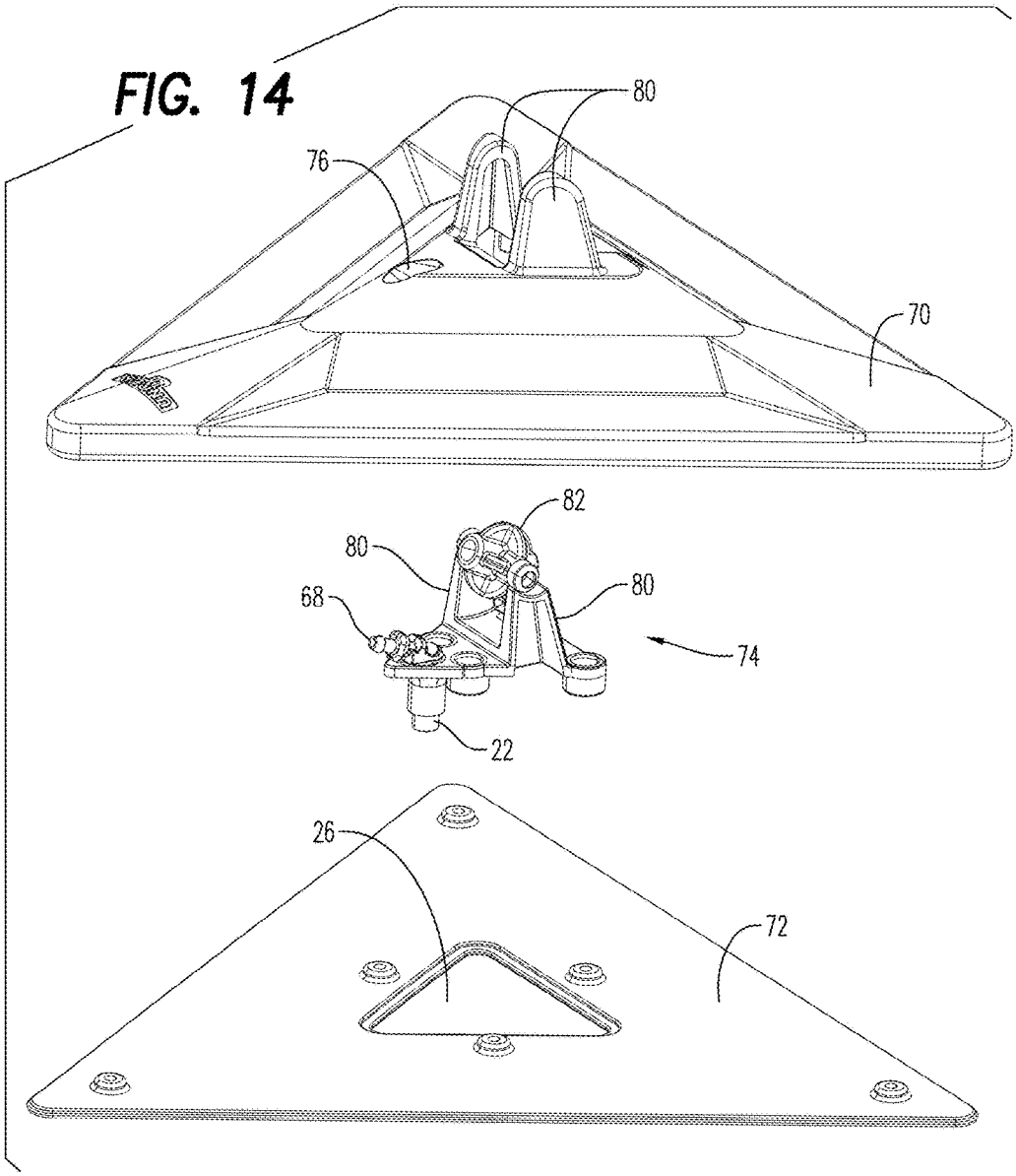
FIG. 14 is a top perspective, exploded view of the cleaning head of FIG. 13.

Referring to the drawings and in particular to FIGS. 1-3, an exemplary embodiment of a cleaning device according to the present disclosure is shown and is generally referred to by reference numeral 10 and an exemplary embodiment of a cleaning fluid pouch according to the present disclosure is shown and is generally referred to by reference numeral 12.

Device 10 includes a main housing 14 having a handle 16 depending therefrom. Device 10 also includes a cleaning head 18 having a cleaning element 20 disposed thereon. As will be described in more detail below, device 10 is configured to removably receive pouch 12 within housing 14.

Additionally, device 10 is configured to pump fluid from pouch 12 to one or more spray nozzles 22 (one shown) directly onto the surface being cleaned. Here, cleaning head 18 and cleaning element 20 each include central openings 24, 26, respectively that are in alignment or registration with one another so that spray nozzles 22 spray the cleaning fluid through the openings 24, 26 onto the surface being cleaned. Thus, nozzles 22 are protected from damage that may occur during use.

Moreover and when device 10 is placed with cleaning element 20 against the surface being cleaned, any spray of the cleaning fluid is captured or trapped within head 18 due to the position of nozzles 22. Without wishing to be bound by any particular theory, it is believed that device 10—by capturing the spray of the cleaning fluid between head 18 and the surface being cleaned—prevents airborne cleaning fluid from being present in the air near the user's mouth and nose, particularly as the device is held at or above head level while cleaning windows, mirrors, and the like. In the example where device 10 is used in window cleaning, the cleaning fluid often includes chemicals with a viscosity low enough to be formed into a mist—namely atomized or formed into an aerosol—by the spraying through nozzles 22. When prior art window cleaning devices are used to clean items at or above the user's mouth and nose, the atomized cleaning fluid can disadvantageously pass through the breathing space—an outcome that device 10 prevents by constraining the spray of the cleaning fluid between head 18 and the surface being cleaned.

Figure 15:
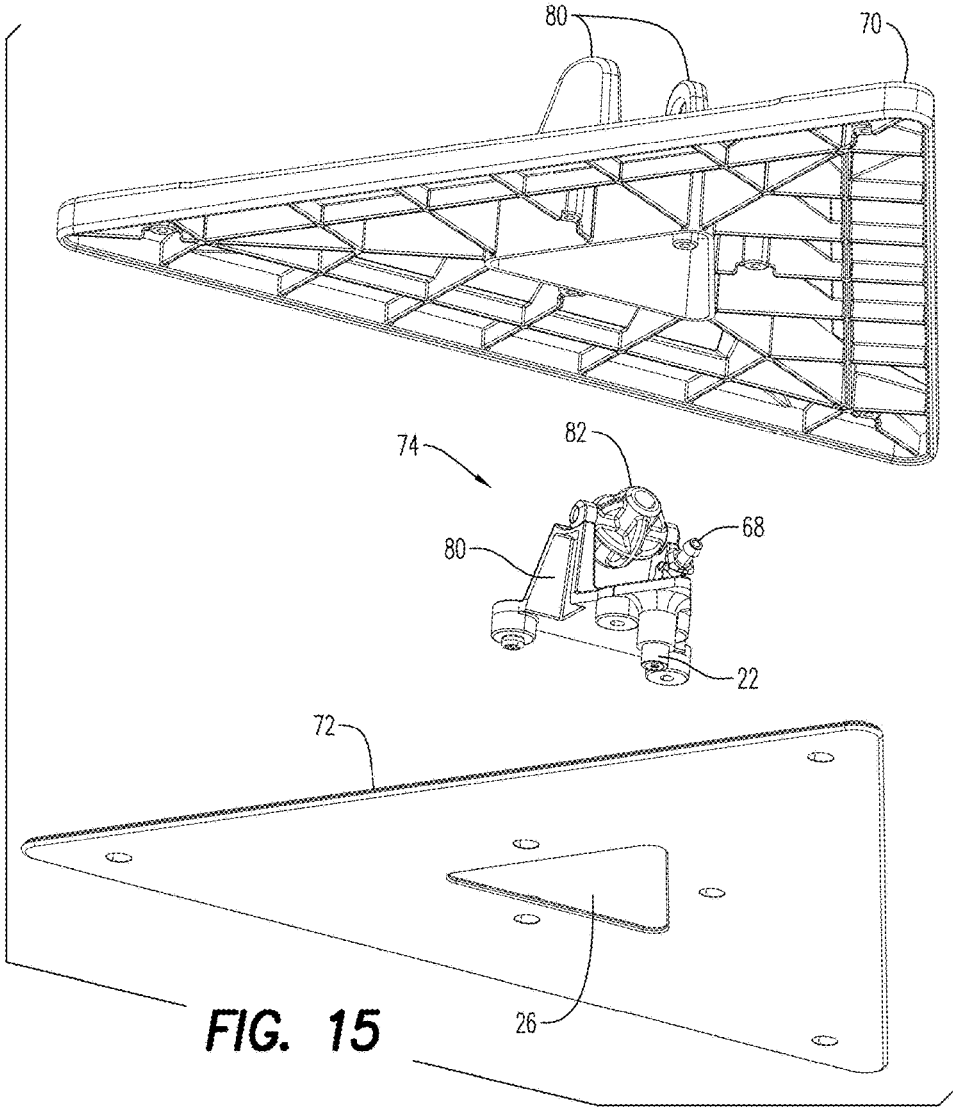
FIG. 15 is a bottom perspective, exploded view of the cleaning head of FIG. 13.
Figure 15A:
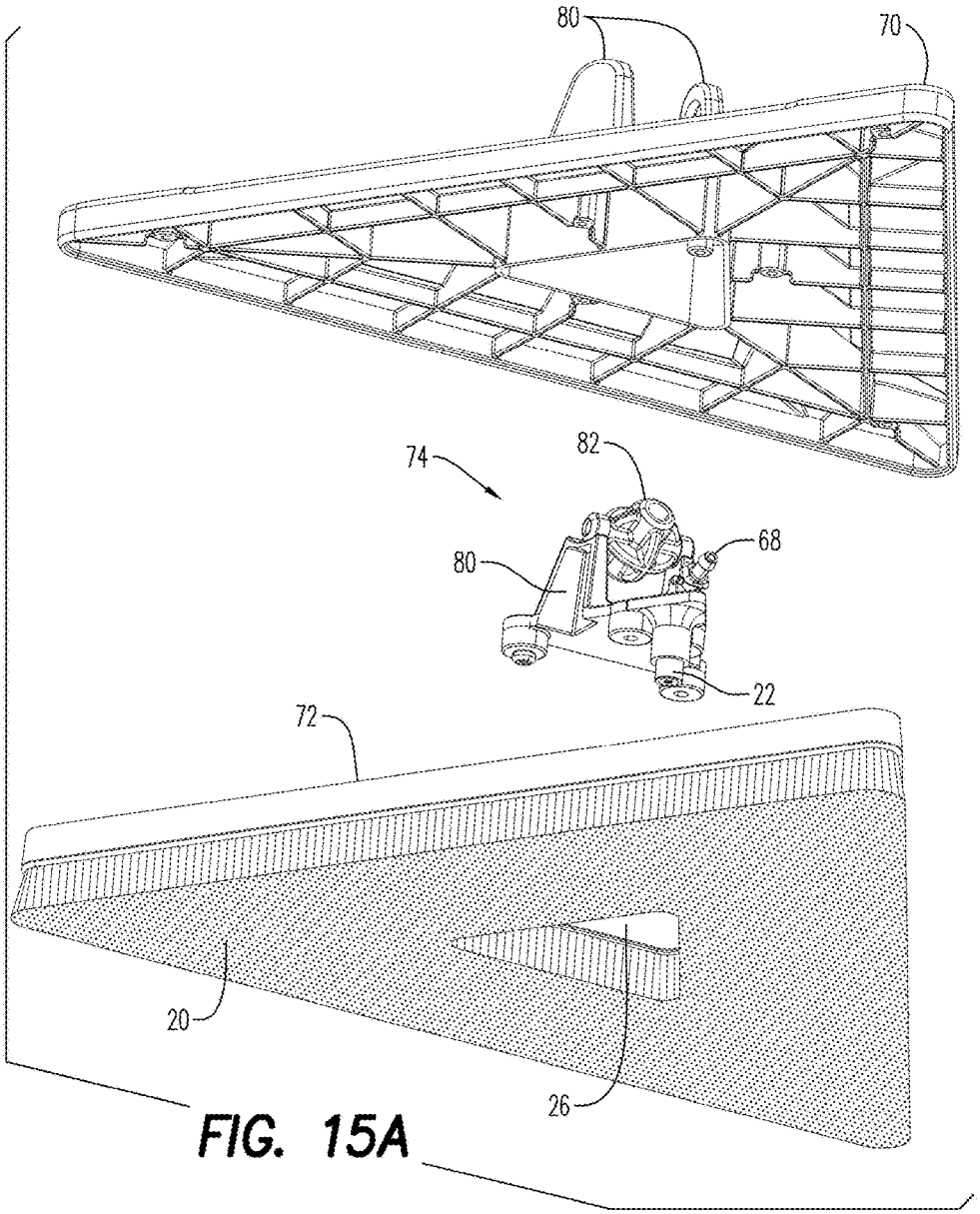
FIG. 15A is a bottom perspective, exploded view of an alternate embodiment of the cleaning head of FIG. 13.

In the embodiment illustrated, cleaning element 20 is illustrated as a cleaning pad made of, for example, microfiber, cotton, wool, non-woven, or any combinations thereof. Of course, it is contemplated by the present disclosure for cleaning element 20 to be any desired element such as, but not limited to, brush bristles as shown in FIG. 15A, squeegee, scraper, or any other cleaning element and combinations thereof.

In this manner, device 10 and pouch 12 increase the ease of use during the cleaning of various hard surfaces by, for example, providing improved ergonomics, location of switches, and/or maneuverability. In some embodiments, device 10 and pouch 12 advantageously provide sufficient weight at cleaning head 18 so as to assist the user in applying cleaning element 20 to the surface being cleaned, which assists the operator to clean the surface.

Device 10 and pouch 12 are described in more detail with simultaneous reference to FIGS. 1-12.

Housing 14 includes a removable cover 28 disposed over an internal cavity 30 so as to allow the user to selectively open and close the cavity. Cavity 30 is configured to removably receive pouch 12 therein. Pouch 12 is formed of a material having sufficient flexibility to conform to the space within cavity 30. For example, pouch 12 is preferably formed of a foil or polymer material.

It should be recognized that pouch 12 is described above by way of example only as a flexible pouch. Of course, it is contemplated by the present disclosure for pouch 12 to form a liner of a fluid container, where the liner collapses within the rigid container during use.

Pouch 12 includes a connection port 32 that allows the pouch to form a releasable fluid and air tight connection with device 10. Connection port 32 includes a closure member 34, illustrated as an external thread, which removably receives a cap or closure (not shown) to close the pouch before use and/or between uses. In this manner, pouch 12 is easily accessible and replaceable.

Device 10 includes a pouch port 36 that can be removably received in connection port 32 of pouch 12 to place the pouch in fluid communication with the inlet port. Thus, a user can remove the cap from closure member 34 of pouch 12 and insert pouch port 36 into connection port 32 to form a fluid and air tight connection. In some embodiments inlet port 36 can include an o-ring 38 or other seal member to improve or enhance the seal between pouch 12 and pouch port 36.

Preferably, pouch 12 can include a slit valve 40 that selectively opens upon application of a negative pressure on the pouch by the pump within device 10 and closes, under its own resilience after the pump is turned off. In this manner, device 10 with pouch 12 installed therein forms a fluid tight connection that prevents, or at least minimizes, leakage of cleaning fluid from pouch when the device is stored or not in use and/or when the pouch is removed from the device. Thus, pouch 12 and pouch port 36 are configured so that the pouch port, when inserted into the pouch, does not pass through valve 40.

In the illustrated embodiment, pouch port 36 is secured to housing 14 by one or more upstanding arms 42 so as to pivot about an axis 44. It has been found by the present disclosure that pivoting of pouch port 36 upward out of cavity 30 can assist the user to connect and disconnect pouch 12 to and from housing 14. Specifically, the user can pivot pouch port 36 to face out of cavity 30 during connection of pouch 12, then once connected, can pivot the pouch port back into the cavity to assist in storing the pouch in the cavity.

Pouch 12 can be held in position in cavity 30 by—for example—the friction between connection and pouch ports 32, 36. Of course, it is contemplated by the present disclosure for device 10 to secure pouch 12 in cavity 30 by any desired method.

Cavity 30 includes a plate 46 that separates pouch 12 from one or more electrical components—namely pump 50 and power source 52 such as a battery. In order to allow replacement of the power source 52, plate 46 can include a separate removable cover 54, which in some embodiments can be provided with a seal or o-ring (not shown) to eliminate or at least mitigate leakage of fluids into the power source.

Pump 50 and power source 52 are in selective electrical communication with one another by way of an activation button 56 defined on housing 14. In this manner, the user can—by depressing button 56—place pump 50 in electrical communication with power source 52 to selectively activate the pump.

In some embodiments, device 10 is configured in a manner that minimizes hydraulic resistance so that that size and weight of pump 50 and power source 52 can be minimized. The hydraulic resistance of device 10 can be minimized by, for example, allowing pouch 12 to collapse as pump 50 draws fluid from the pouch. Stated another way, the fluid and air tight connection between connection and pouch ports 32, 36 results in pouch 12 collapsing as fluid is withdrawn from the pouch.

It should be recognized that device 10 is described by way of example as including pump 50 described in combination with power source 52 as an electric pump. Of course, it is contemplated by the present disclosure for device 10 to find use with a manual pump—that allows the operator to actuate the manual pump via actuation button 56 in the form of a trigger or similar device.

Pouch 12 includes, in some embodiments, an elongated sealed edge 48*a* along the elongated sides and top and a flat bottom 48*b*. In this manner, pouch 12 returns to a substantially flat shape when collapsing as the fluid is withdrawn with flat bottom 48*b* being pulled into pouch 12 along one or more pleats or folds 48*c*. Without wishing to be bound by any particular theory, it is believed that the easy to collapse configuration of pouch 12 assists in providing the minimized hydraulic resistance of device 10.

Additionally, the hydraulic resistance of device 10 can also be minimized by, for example, reducing the number of valves in the fluid path—which is also made possible, at least in part, by the fluid and air tight connection between connection and pouch ports 32, 36. Thus, device 10 has only one valve, namely valve 40, in the fluid path yet still provides a system that eliminates, or at least minimizes, leakage of cleaning fluid from pouch 12 when the device is stored or not in use. Accordingly, device 10, in some embodiments, is configured so that pump 50 is a 3 volt pump and power source 52 is two standard AA batteries.

Pump 50 includes a pump inlet 60 and a pump outlet 62. Device 10 includes a conduit path 58-1 fluidly connecting pump inlet 60 to pouch port 36. Conduit 58-1 between pouch port 36 and pump inlet 60 passes through plate 46 at a first pathway 64.

Device 10 also includes conduit path 58-2 fluidly connecting pump outlet 62 to spray nozzles 22. Conduit path 58-2 between pump outlet 62 passes through plate 46 at a second pathway 66. Specifically, head 12 includes a head inlet 68 to which conduit path 58-2 from pump outlet 62 is fluidly connected.

Head 18 is described in more detail below with respect to FIGS. 13-16, which also provides more detail on the fluid connection between head inlet 68 and spray nozzles 22.

Head 18 includes an upper cover 70, a lower cover 72, and a support member 74 positioned between the covers. Support member 74 includes spray nozzles 22 and head inlet 68 fluidly communicating with one another. Upper cover 70 includes a port 76 through which head inlet 68 extends. Similarly, lower cover 72 includes central opening 26 through which spray nozzles 22 are directed. Preferably, support member 74 is configured so that nozzles 22 are recessed with respect to the bottom surface of head 18, which allows the head to prevent the nozzles from being damaged during use.

It should be recognized that device 10 is disclosed by way of example only having central opening 26 in lower cover 72 and having nozzles 22 recessed therein. Of course, it is contemplated by the present disclosure for lower cover 72 to have one or more openings 26 through which nozzles 22 are positioned in a manner to be substantial even or flush with the bottom surface of the lower cover. Moreover, it is contemplated by the present disclosure for lower cover 72 to have one or more openings 26 through which nozzles 22 are positioned to extend from the bottom surface of the lower cover less by a distance less than a thickness of the cleaning element 20. In these embodiments, the thickness of cleaning element 20 provides an offset between nozzles 22 and the surface being cleaned.

Support member 74 and upper cover 70 together form a pair of supports 80, which receive a pivot member 82 therebetween to allow head 18 to be secured to housing 14—and preferably removably secured to the housing. Pivot member 82 is secured between support member 74 and upper cover 70 so as to pivot or rotate about a first axis 84.

Cleaning element 20 can be removably secured to cleaning head 18 in any desired manner. In some embodiments, cleaning element 20 can include one or more connectors 78 for removably securing the cleaning element to head 18. For example, cleaning element 20 is illustrated having three connectors 78 one at each corner of the triangular shape of head 18. In some embodiments, one or more of connectors 78 can be elastic so as to allow cleaning element 20 to be secured to head 18. In other embodiments, one or more of connectors 78 can be hook-and-loop type fasteners so as to allow cleaning element 20 to be secured to head 18. Of course, it is contemplated by the present disclosure for connectors 78 to have any desired configuration sufficient to removably secure cleaning element 20 to cleaning head 18.

Figure 16:
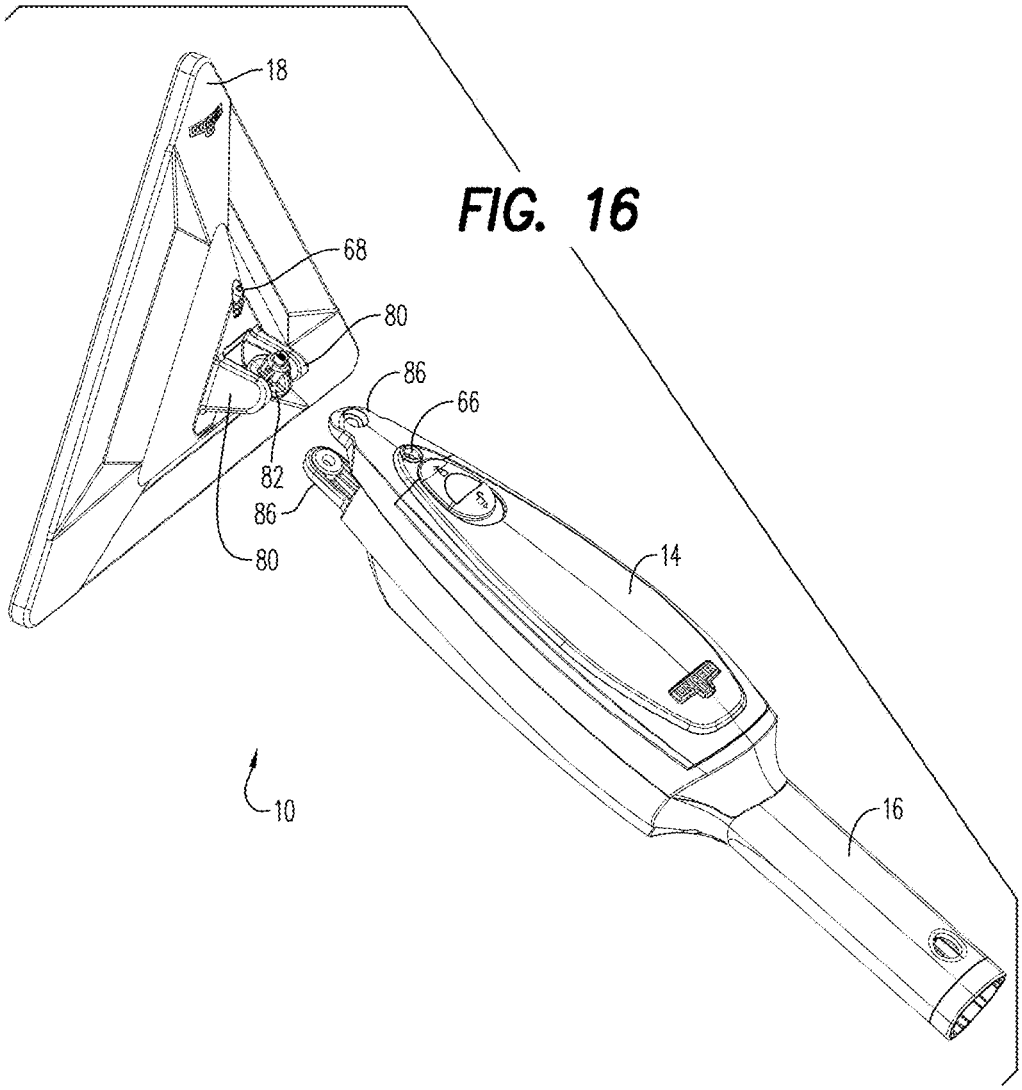
FIG. 16 is a top perspective view of the cleaning device of FIG. 1 having the cleaning head shown in a removed position.
Figure 17:
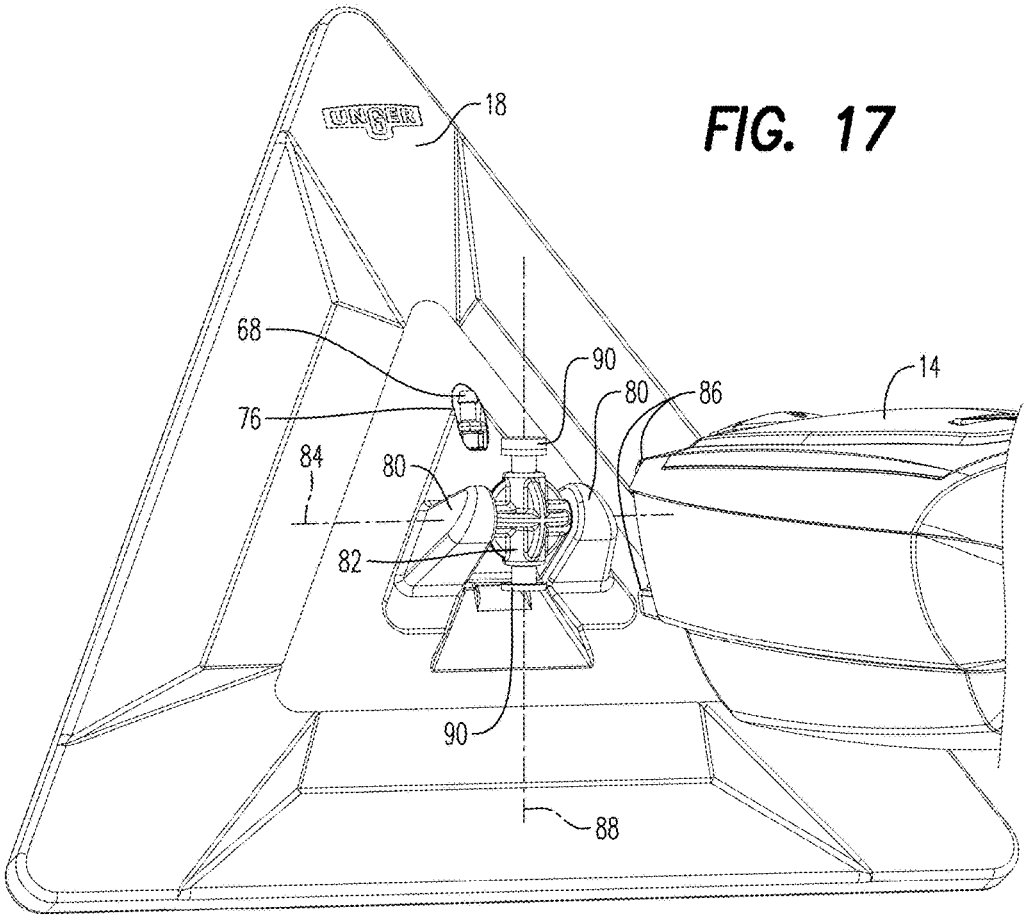
FIG. 17 is an enlarged view of the cleaning device of FIG. 16 having the cleaning head shown in the removed position.
Figure 18:
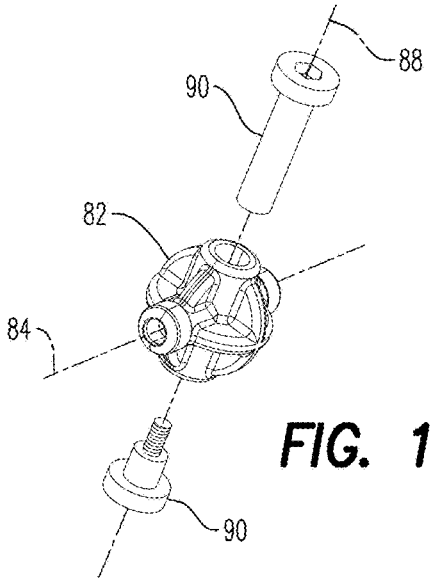
FIG. 18 is an enlarged, exploded view of a pivot member shown in FIG. 16.

The interconnection of housing 16 and head 18 are described in more detail with reference to FIGS. 16-18. Here, housing 16 includes a pair of arms 86 depending therefrom. Pivot member 82 is secured to arms 86 so as to pivot or rotate about a second axis 88 by a connector 90. In this manner, device 10 is configured for rotation about first axis 84 by 160 degrees and about second axis 86 by 180 degrees.

Head 18 can be removed from pivot member 82 and, thus from device 10, by removing connector 90 from the pivot member. In this manner, device 10 is configured to allow the user to replace head 18 or to use heads having different shapes, sizes, and/or configurations. In the illustrated embodiment, connector 90 is shown as a shoulder bolt, which is believed to provide increased structural rigidity to pivot member 82.

Of course, it is also contemplated by the present disclosure for head 18 itself to be configured to allow the user to replace portions of the head with portions having different configurations such as shown in FIG. 15A. Here, lower cover 72 is illustrated being removably received on upper cover 70. Thus in this embodiment, the user can replace one lower cover 72—such as that of FIG. 15 that receives a cleaning cloth as cleaning element 20—with a different lower cover 72—such as that of FIG. 15A that includes a different cleaning element 20, namely brush bristles.

Additionally, it is contemplated by the present disclosure for device 10 to include a scrubbing area such as that disclosed in Applicant's commonly owned U.S. Pat. No. 7,779,501 and/or to include feedback between the different cleaning states as disclosed in Applicant's commonly owned U.S. application Ser. No. 14/668,535, the entire contents of which are incorporated by reference herein.

Figure 19:
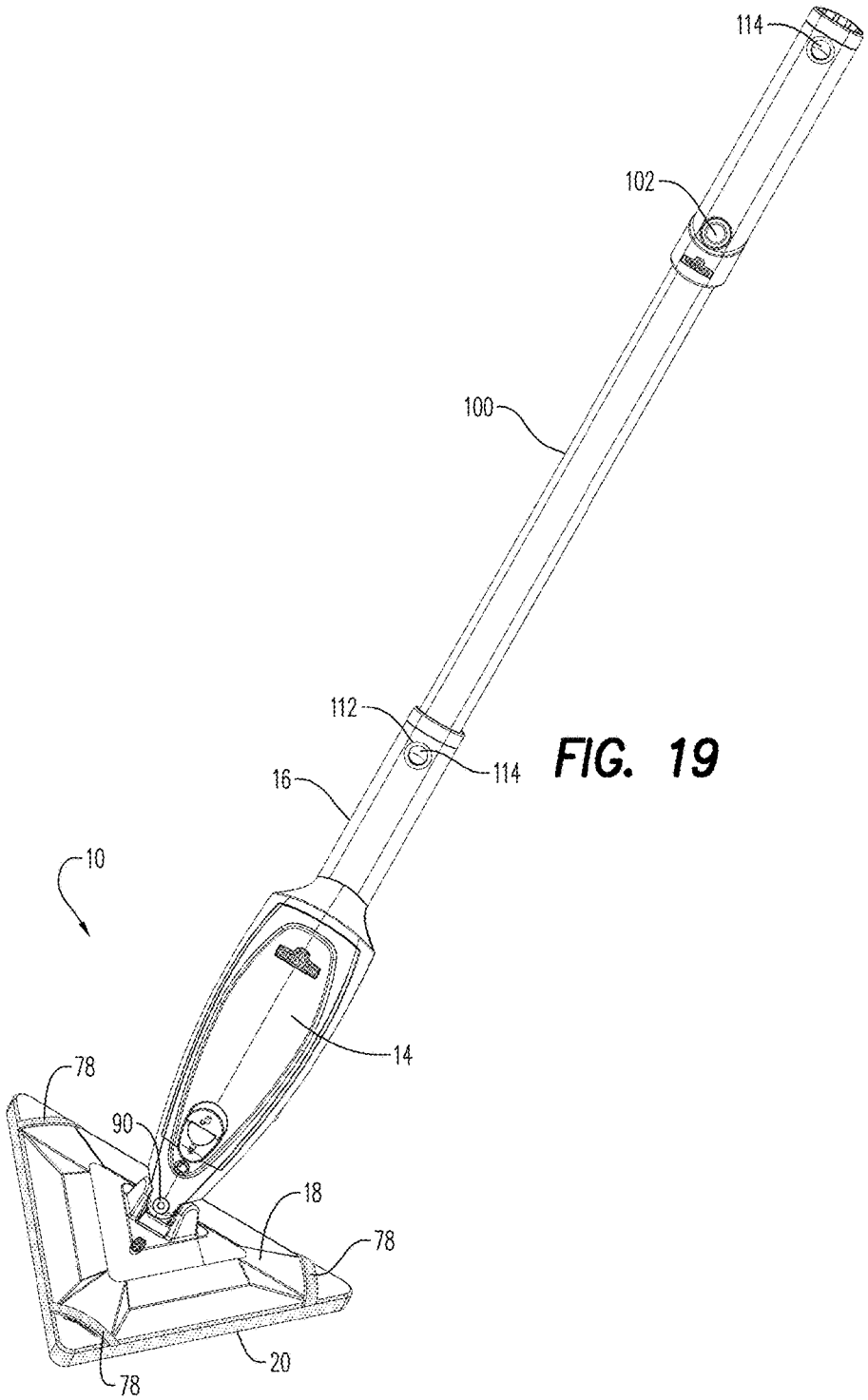
FIG. 19 is a top perspective view of the cleaning device of FIG. 1 having a first extension pole secured thereto.
Figure 20:
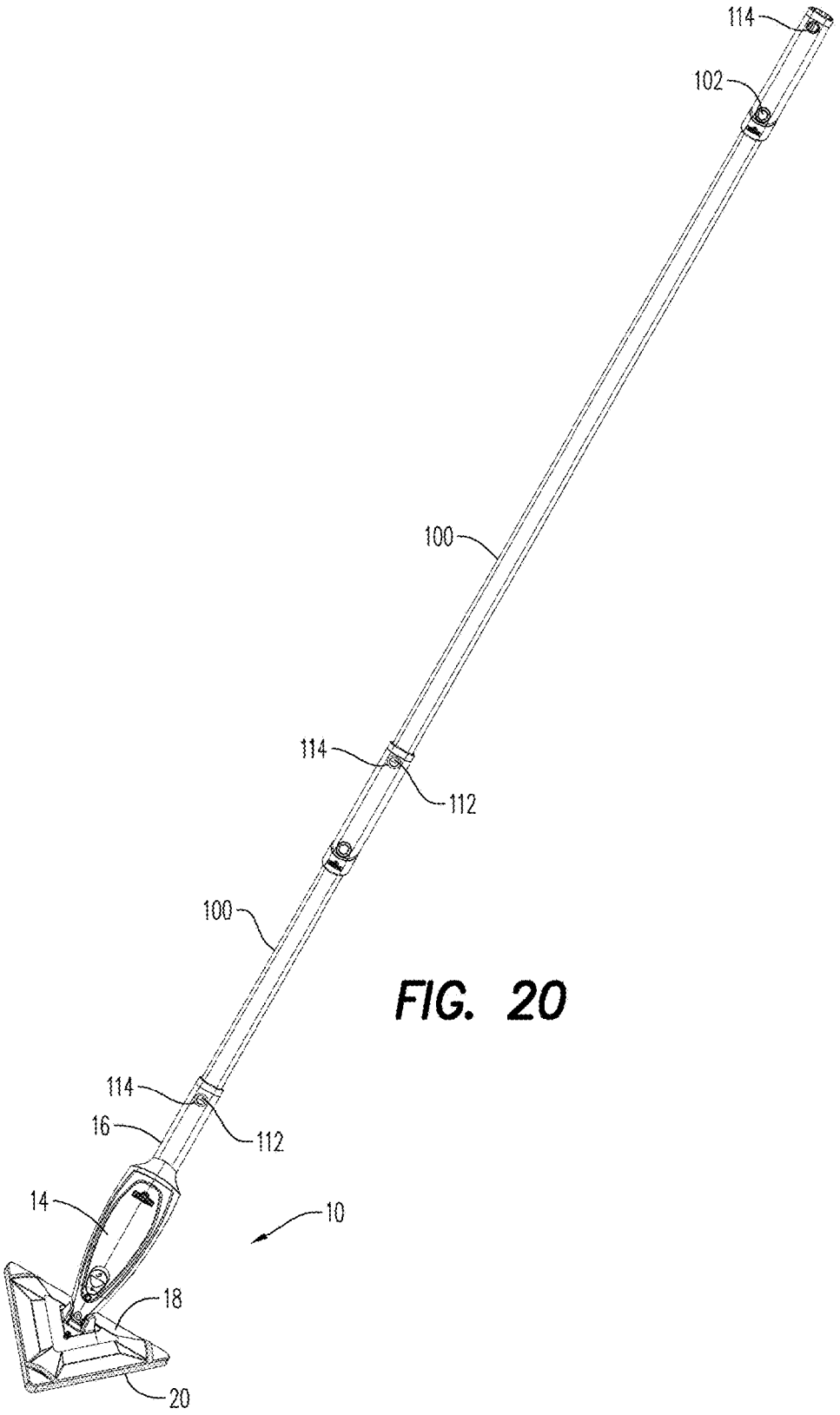
FIG. 20 is a top perspective view of the cleaning device of FIG. 1 having a first extension pole and a second extension pole secured thereto.
Figure 21:
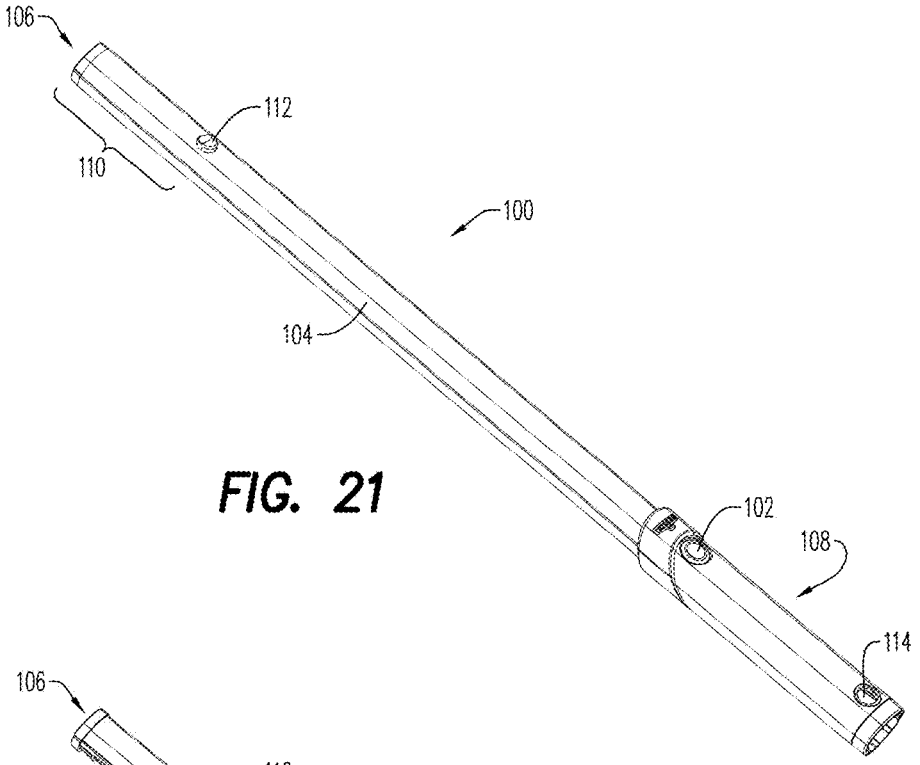
FIG. 21 is a top perspective view of an exemplary embodiment of an extension pole according to the present disclosure.
Figure 22:
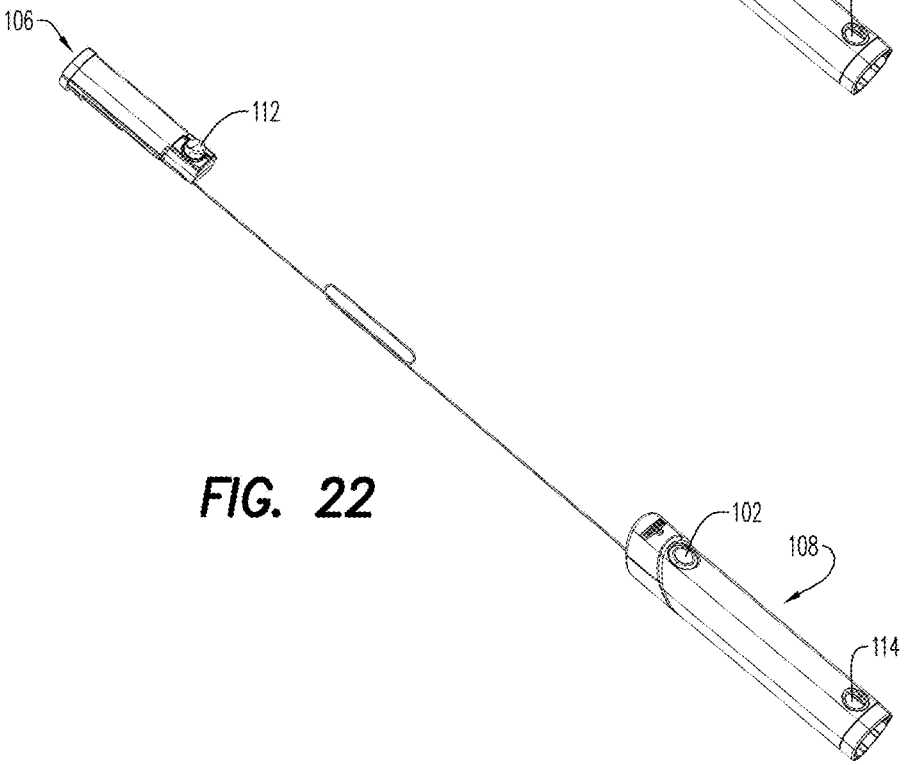
FIG. 22 is a top perspective view of the extension pole of FIG. 21 having various components omitted for clarity.
Figure 23:
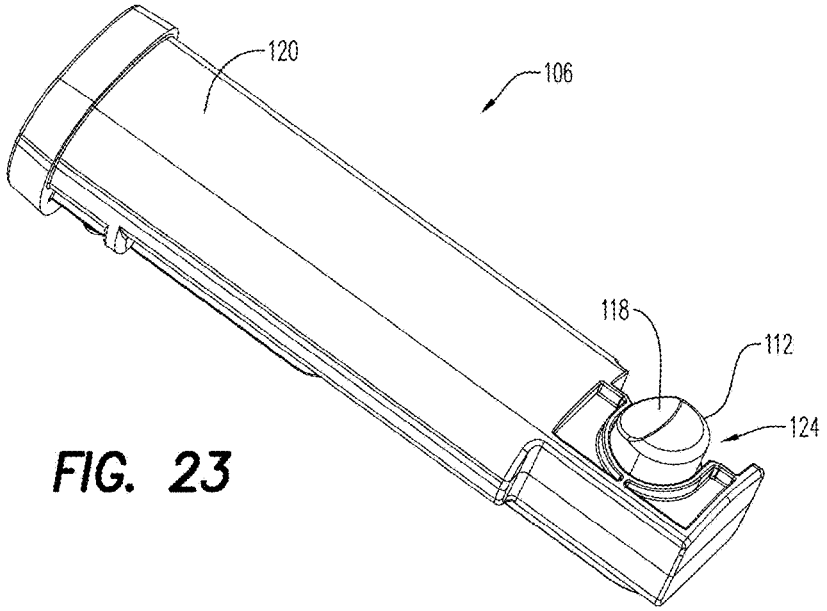
FIG. 23 is a top perspective view of an exemplary embodiment of a first pole connection assembly according to the present disclosure.
Figure 24:
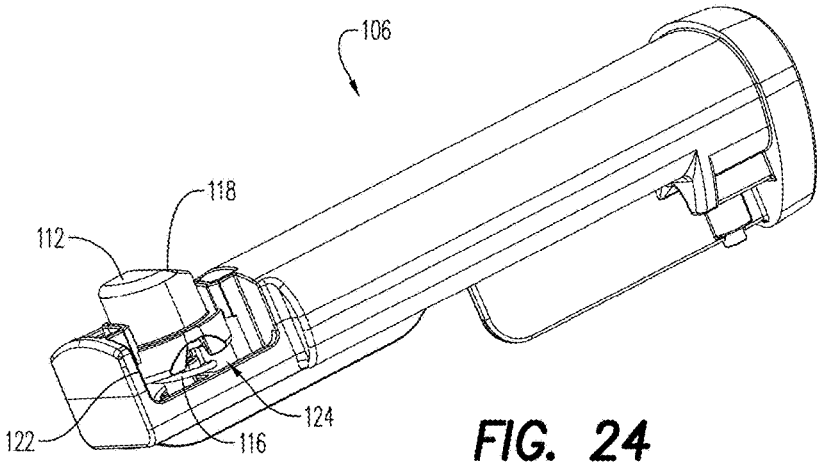
FIG. 24 is a side perspective view of the first pole connection assembly of FIG. 23.
Figure 25:
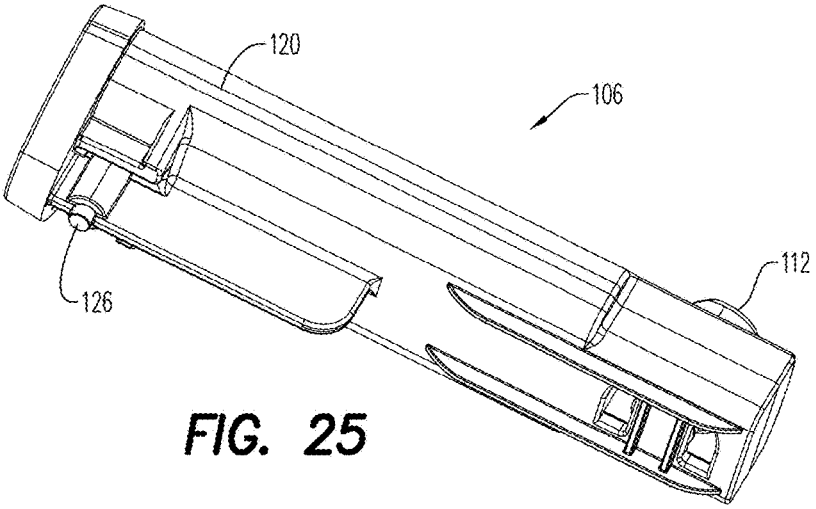
FIG. 25 is a bottom perspective view of the first pole connection assembly of FIG. 23.
Figure 26:
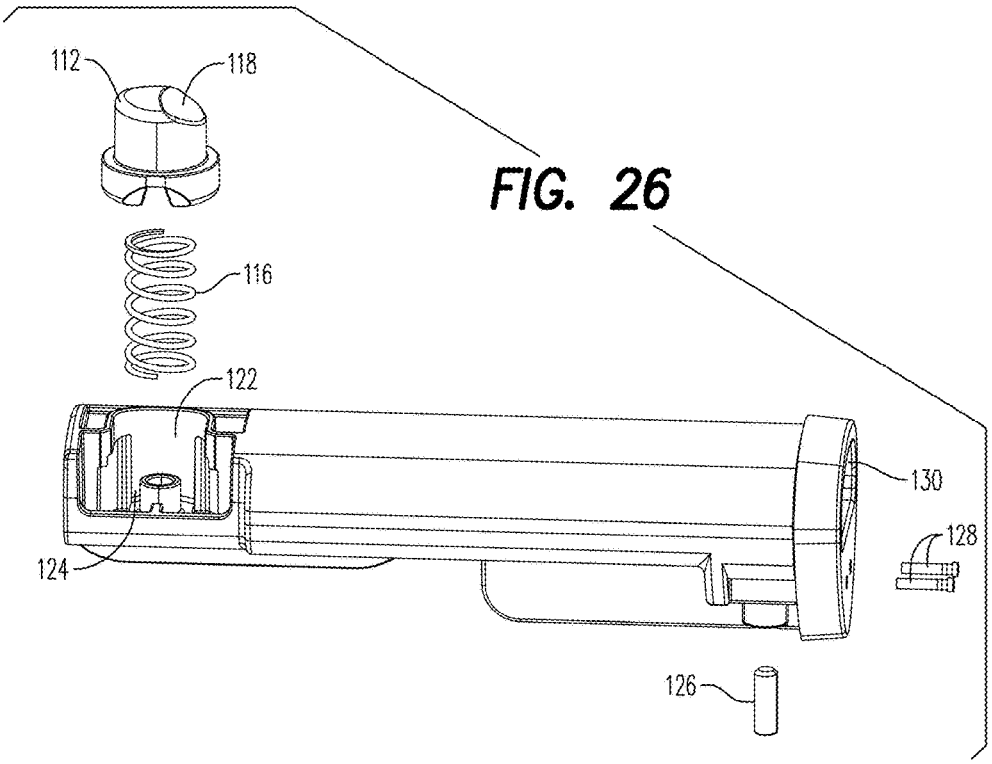
FIG. 26 is a side perspective, exploded view of the first pole connection assembly of FIG. 23.
Figure 27:
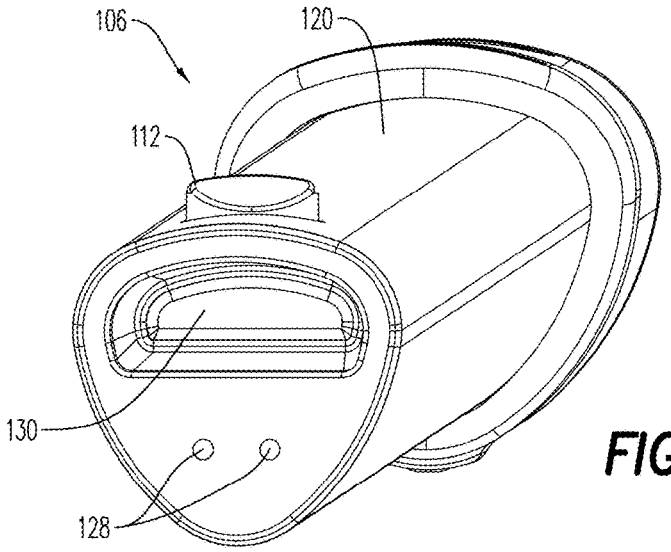
FIG. 27 is an end view of the first pole connection assembly of FIG. 23.
Figure 28:
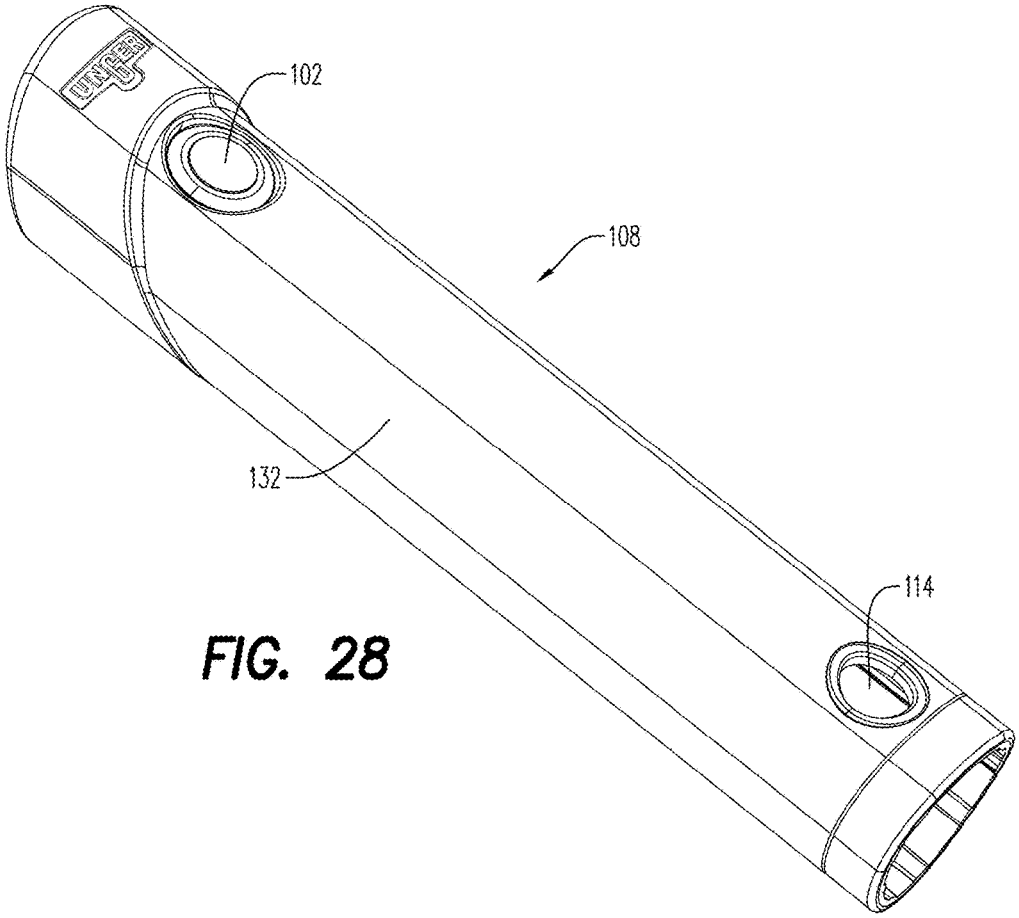
FIG. 28 is a top perspective view of an exemplary embodiment of a second pole connection assembly according to the present disclosure.
Figure 29:
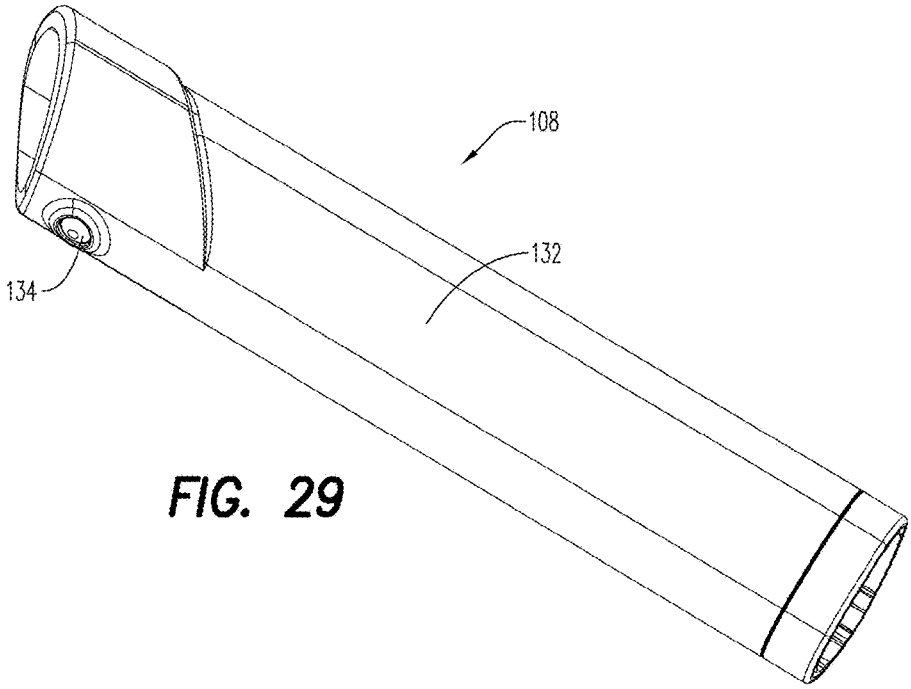
FIG. 29 is a bottom perspective view of the second pole connection assembly of FIG. 28.
Figure 30:
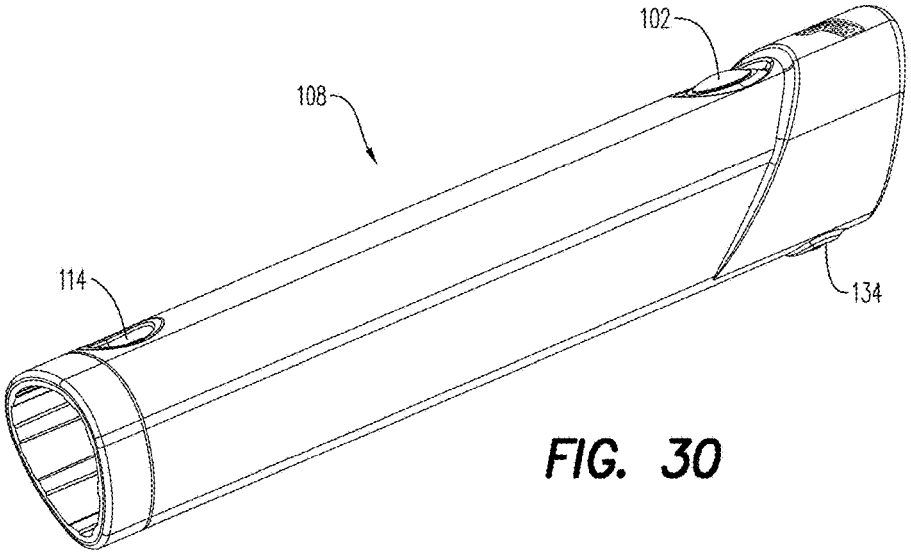
FIG. 30 is a side perspective view of the second pole connection assembly of FIG. 28.
Figure 31:
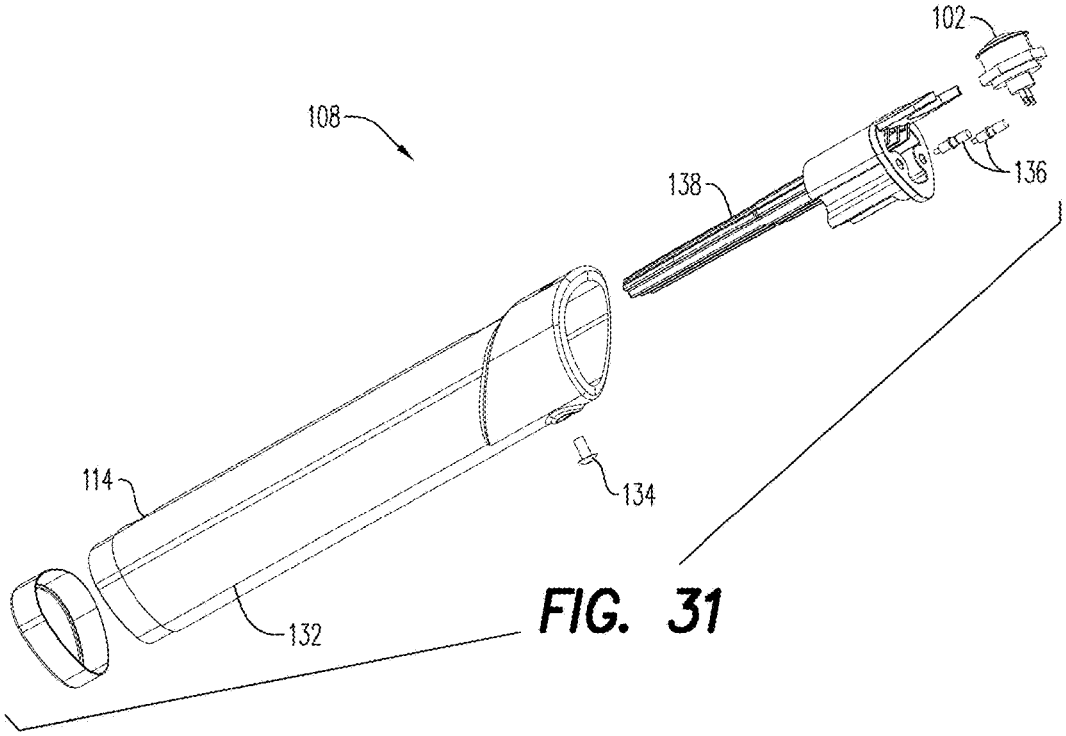
FIG. 31 is a side perspective, exploded view of the second pole connection assembly of FIG. 28.
Figure 32:
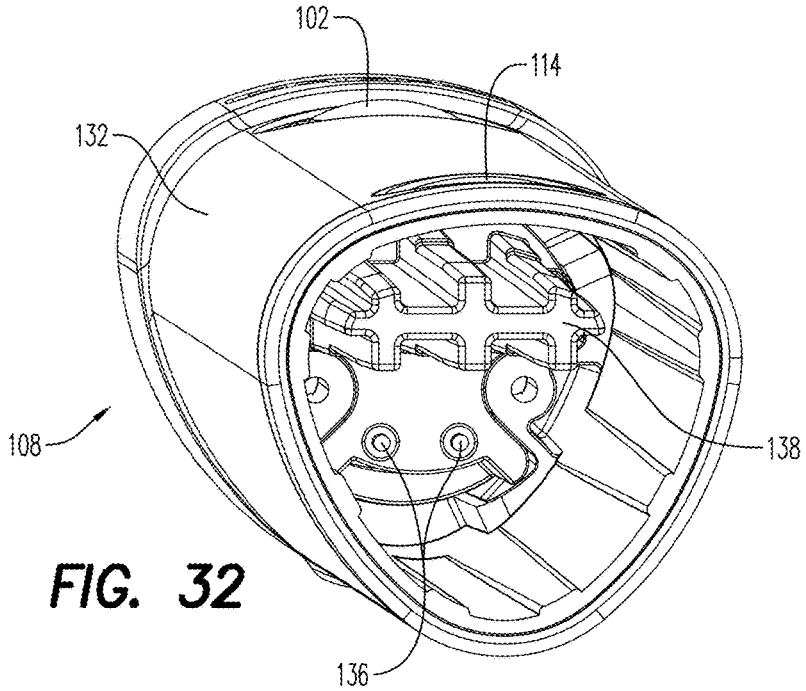
FIG. 32 is an end view of the second pole connection assembly of FIG. 28.

It has been found that, under certain cleaning activities, it may be desired to extend the reach of device 10 provided by handle 16. Accordingly, device 10 is configured for use with one or more extension poles 100 as shown in FIGS. 19-20 of the same or differing sizes.

Each of poles 100 includes an activation button 102 and the poles are configured so that, upon connection of the pole to handle 16 or to another pole 100, the activation button of the pole is placed in electrical communication with activation button of the handle 16. In this manner, pump 50—when device 10 is used with one or more poles 100—can be activated by button 56 on handle 16 and any of the buttons 102 on the poles.

Pole 100 is described in more detail with reference to FIGS. 21-32.

Pole 100 includes an extension member 104, a first pole connection assembly 106, and a second pole connection assembly 108. In the illustrated embodiment, extension member 104 is made of material such as, but not limited to metal (e.g., steel, aluminum), plastics, composite material (e.g., fiber glass, carbon fiber, etc), and other materials.

Member 104 has a hollow region 110 at least in the area of first pole connection assembly 106 in which the assembly is disposed. Of course, it is contemplated by the present disclosure for pole 100 to be entirely hollow.

Figure 33:
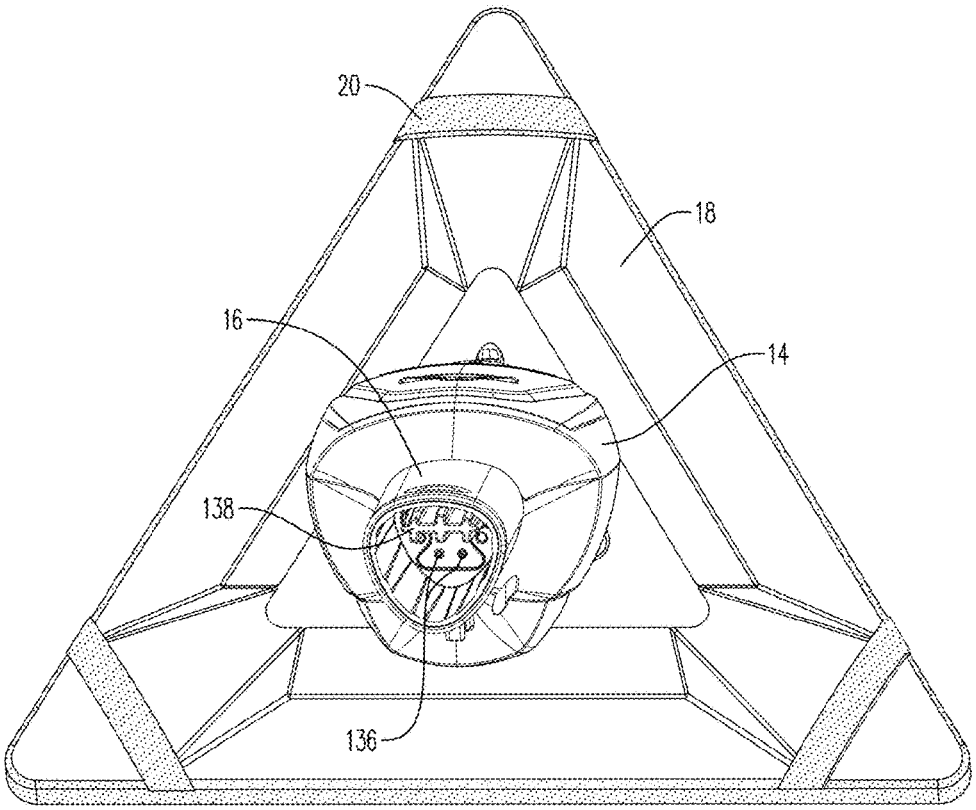
FIG. 33 is an end view of the cleaning device of FIG. 1 illustrating the elements of the second pole connection assembly.

First assembly 106 forms a portion of the physical and electrical interconnection between handle 16 and pole 100, as well as between poles. Similarly, second assembly 108 forms another portion of the physical and electrical interconnection between handle 16 and pole 100. While the second assembly 108 is described by way of example as part of pole 100, the features of the second assembly are also present in handle 16 to allow the first assembly 106 to physically and electrically connect to device 10. Thus, the features of second assembly 108 that are common to those on handle 16 are illustrated in FIG. 33.

Preferably, first assembly 106 is an internal assembly—namely is an assembly that is disposed substantially in the inner diameter of pole 100—while second assembly 108 is an external assembly—namely is an assembly that is disposed substantially around the outer diameter of pole 100. In this manner, the first assembly 106 can be thought of as the "male" portion of the interconnection and the second assembly 108 can be thought of as the "female" portion of the interconnection.

First assembly 106 includes a movable lock 112 that is removably received in a locking opening 114 of second assembly 108. When first assembly 106 is disposed in extension member 104, lock 112 is biased by a biasing member 116 (e.g., spring or other resilient member) through a passage in the extension member. Preferably, lock 112 has a tapered edge 118 that, when abutting the second assembly 108 during connection, acts as a cam surface to urge the button downward into extension member 104 by overcoming the return force of biasing member 116. However when lock 112 is in alignment or registration with locking opening 114 in second member 114, the biasing member 116 returns the lock to its normal, extended position where it resides in the locking opening to prevent separation of the poles 100 or pole 100 and handle 16, respectively.

During disconnection, the user can depress lock 112 overcoming the return force of biasing member 116 so that the lock is free from locking opening 114 in second member 114 to allow separation of the poles 100 or pole 100 and handle 16, respectively.

First assembly 106 includes a main body 120 that has a channel 122 in which lock 112 and biasing member 116 reciprocate vertically. Advantageously, channel 122 is open on at least one side 124, allowing the lock 112 and biasing member 116 to be installed into channel 122 from the side—then retained in position in the channel upon insertion into extension member 104.

First assembly 106 is secured in extension member 104 by way of a transverse pin 126. Further, first assembly 106 includes a pair of electrical contacts 128 and a guide member 130 which are described in more detail below in combination with features of second assembly 108.

Second assembly 108 includes a main body 132 in which locking opening 114 and activation button 102 are disposed. Second assembly 108 is secured over the outer diameter of extension member 104 by way of a transverse pin 134. Second assembly 108 also includes a pair of electrical contacts 136 and a guide member 138.

It is again noted that handle 16 functions in a manner similar to second assembly 108 and, thus, includes the elements of the second assembly necessary to form the desired physical and electrical connection with the first assembly 106 of pole 100. Accordingly, handle 16 includes lock opening 114, electrical contacts 136, and guide member 138 as shown at least in FIG. 33.

During assembly of first and second assemblies 106, 108 (i.e., assembly of two poles 100 to one another) and/or assembly of handle 16 with first assembly 106 (i.e., assembly of handle 16 with one pole 100), the guide members 130, 138 are mated to one another to provide positive location of contacts 128, 136 with respect to one another. The guide members 130, 138 are slid with respect to one another until locking member 112 is received in locking opening 114 to form the desired physical connection. Further and upon the completion of the physical connection, contacts 128, 136 also form an electrical connection therebetween.

It should be recognized that electrical contacts are illustrated as pin type contacts, but of course, it is contemplated by the present disclosure for contacts 128, 136 to be any contact type sufficient to provide the desired electrical conductivity such as, but not limited to, slide contacts.

Referring to the drawings and in particular to FIGS. 34-41C, an alternate exemplary embodiment of a cleaning device according to the present disclosure is shown and is generally referred to by reference numeral 210. Here, component parts performing similar or analogous functions to those discussed above are labeled in multiples of two hundred of the original reference numerals. In the interest of brevity, only certain aspects of device 210, that differ from those discussed above with respect to device 10, are discussed herein below.

Device 210 includes a main housing 214 having a handle 216 depending therefrom. Device 210 also includes a cleaning head 218 having a cleaning element 220 (FIG. 35) that is removably disposed thereon. Cleaning element 220 can be any desired material sufficient for the desired cleaning action such as, but not limited to, washable fabrics, microfiber, disposable fabrics, woven fabrics, non-woven fabrics, fabrics made of natural materials (e.g., cotton), synthetic materials (e.g. polyester), combinations of natural and synthetic materials, materials in the form of brushes or scrubbing materials (e.g., melamine foam), and any combinations of the aforementioned or other materials. As will be described in more detail below, device 210 is configured to removably receive pouch 212 within housing 214.

It should be recognized that device 210 is shown, by way of example, having head 218 depending from housing 214 in non-movable manner, as compared to the connection between housing 14 and head 18 discussed above via supports 80 and pivot member 82 that allow head 18 pivot or rotate about one or more axes 84, 88.

Additionally, device 210 is shown, by way of example, having handle 216 being formed on housing 214 at an angle of between about 5 to 45 degrees with respect to the plane defined by the surface of head 218, with about 20 degrees being preferred.

In this manner, device 210 is particularly configured for use in cleaning as hard surfaces such as, but not limited to, tables, floors, counters, walls, windows, and the like.

Device 210 is configured to pump fluid from pouch 212 to one or more spray nozzles 222 (one shown) directly onto the surface being cleaned. Here, cleaning head 218 and cleaning element 220 each include central openings 224, 226, respectively that are in alignment or registration with one another so that spray nozzles 222 spray the cleaning fluid through the openings 224, 226 onto the surface being cleaned.

In this manner, nozzles 222 are protected from damage that may occur during use. Moreover and when device 210 is placed with cleaning element 220 against the surface being cleaned, any spray of the cleaning fluid is captured or trapped within head 218 due to the position of nozzles 222. Without wishing to be bound by any particular theory, it is believed that device 210—by capturing the spray of the cleaning fluid between head 218 and the surface being cleaned—prevents airborne cleaning fluid from being present in the air, particularly as the device is used to clean a table or counter in an eating establishment (e.g., restaurant, diner, cafeteria, etc.) or a food preparation area (e.g., fast food counter, kitchen, etc.) held at or above head level while cleaning windows, mirrors, and the like. When prior art surface cleaning devices are used to clean items in these locations—either near food being stored or prepared or near other diners, the atomized cleaning fluid can disadvantageously pass onto or be transferred to other foods or surfaces, or smelled or otherwise bothersome to nearby patrons—an outcome that device 210 prevents by constraining the spray of the cleaning fluid between head 218 and the surface being cleaned.

Although device 210 is not shown in use with one or more extension handles 100 discussed in detail above, it should be recognized that handle 216 is configured for use with such handles. For example, handle 216—much like handle 16—functions in a manner similar to second assembly 108 and, thus, includes the elements of the second assembly necessary to form the desired physical and electrical connection with pole 100. Accordingly, handle 216 can include lock opening (not shown), electrical contacts 336, and, when necessary, a guide member (not shown).

Figure 41:
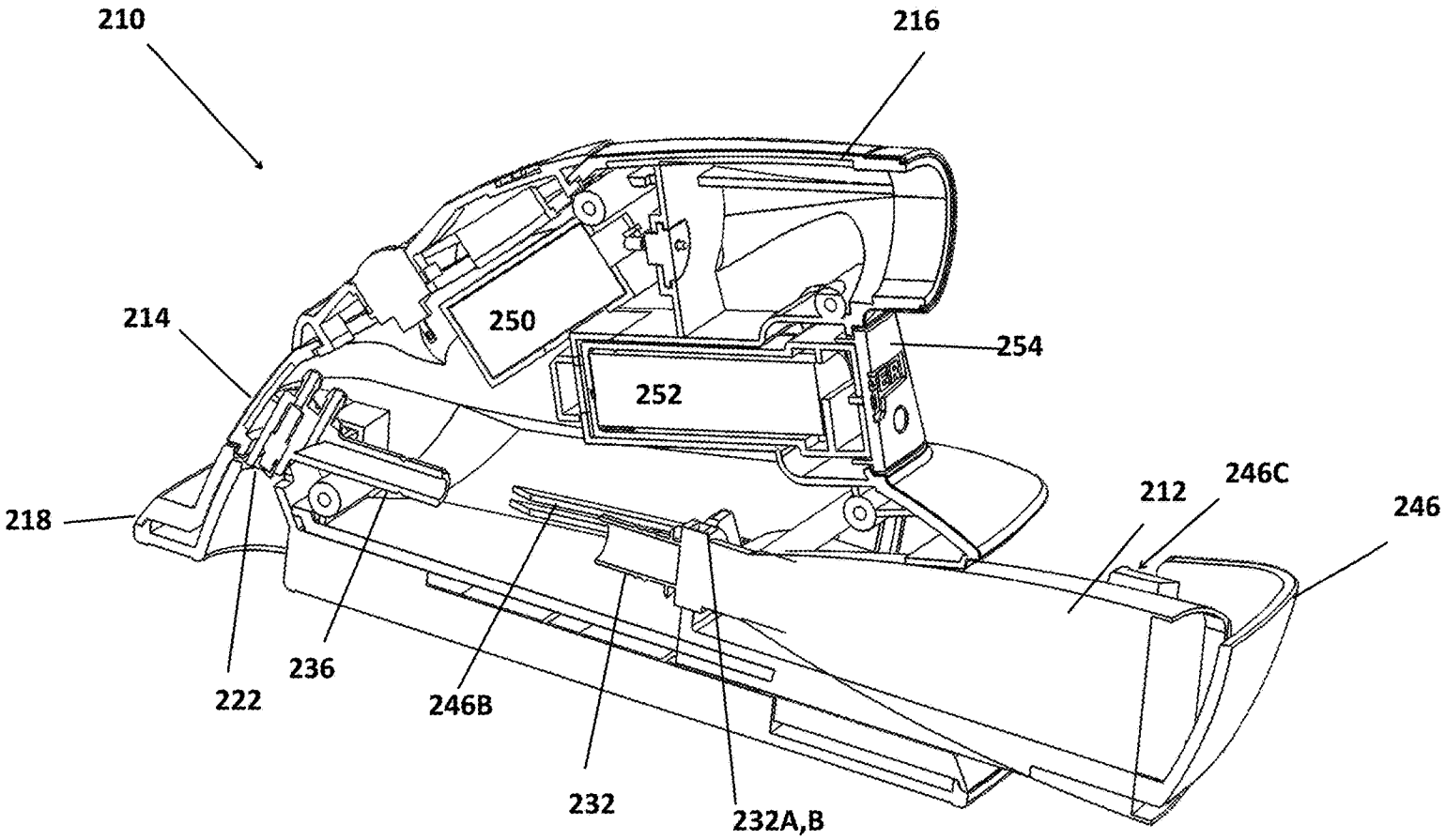
FIG. 41 is a sectional view of FIG. 40.
Figure 41A:
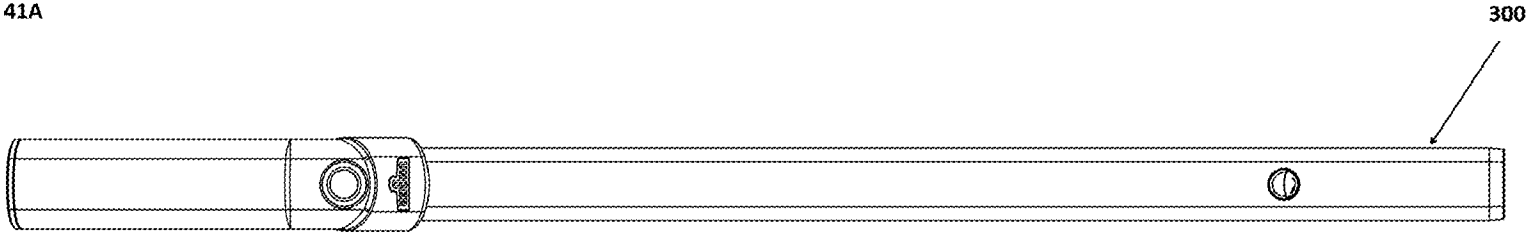
FIGS. 41A, 41B, and 41C illustrate an alternate exemplary embodiment of an extension pole for use with the cleaning device of FIG. 34.
Figure 41B:
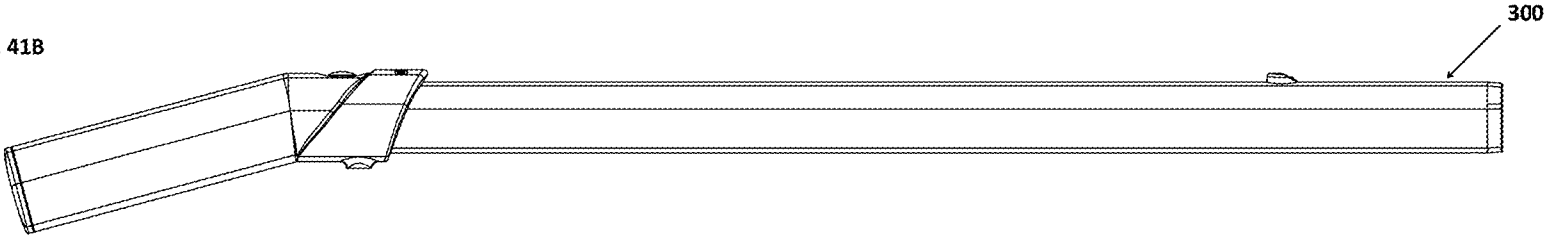
Figure 41C:
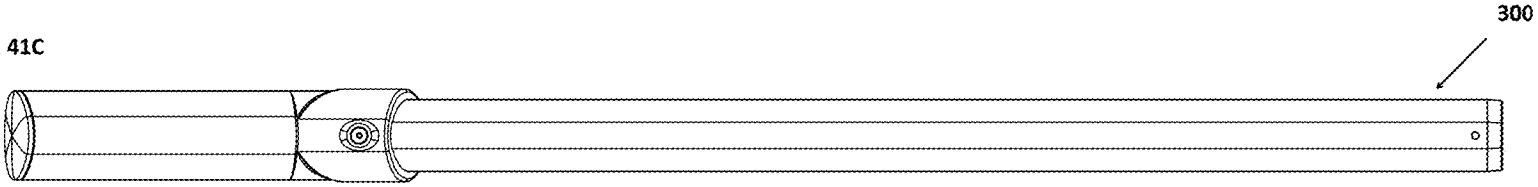
Figure 42:
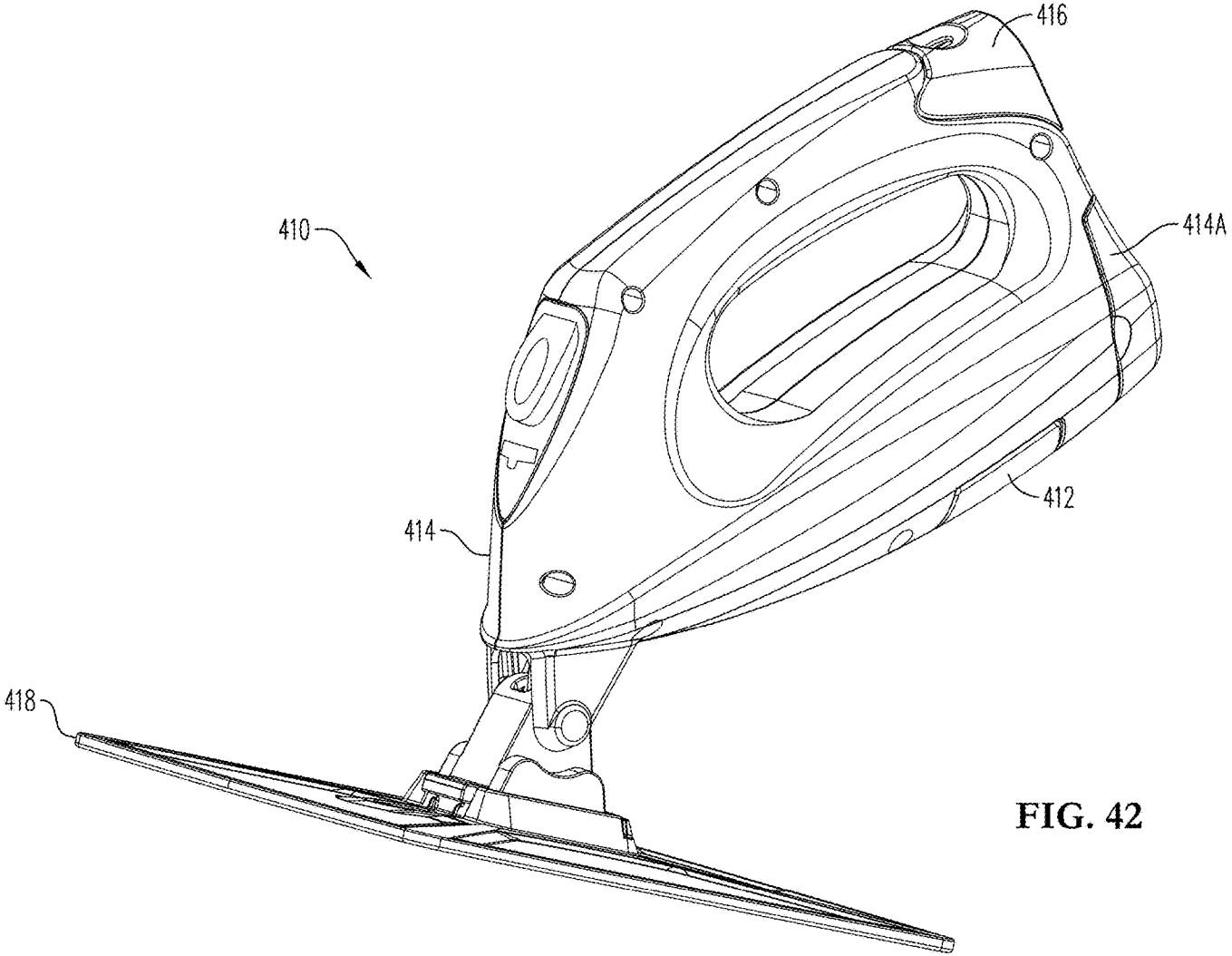
FIG. 42 is a front perspective view of another alternate exemplary embodiment of a cleaning device according to the present disclosure.
Figure 43:
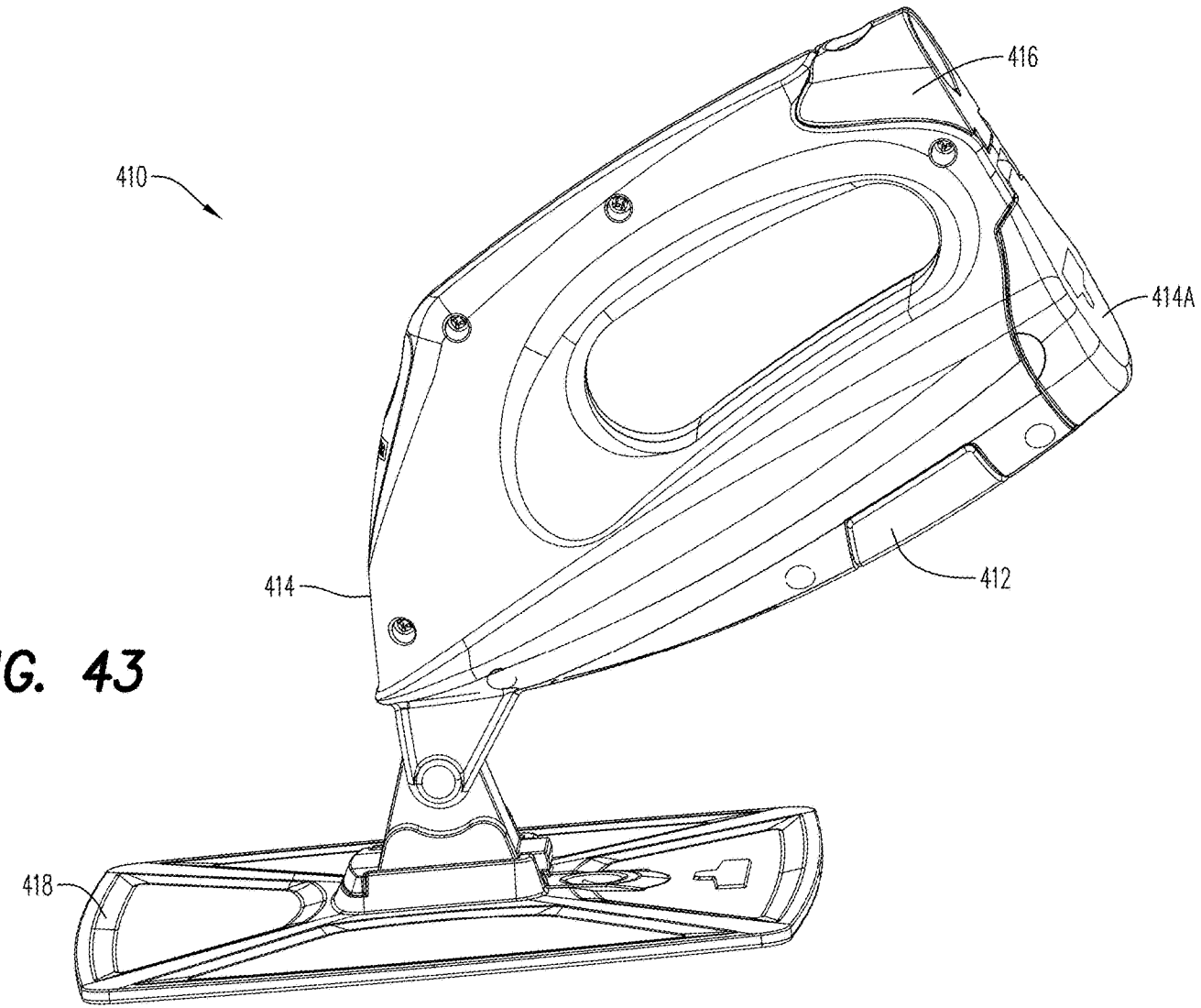
FIG. 43 is a side perspective view of the cleaning device of FIG. 42.
Figure 44:
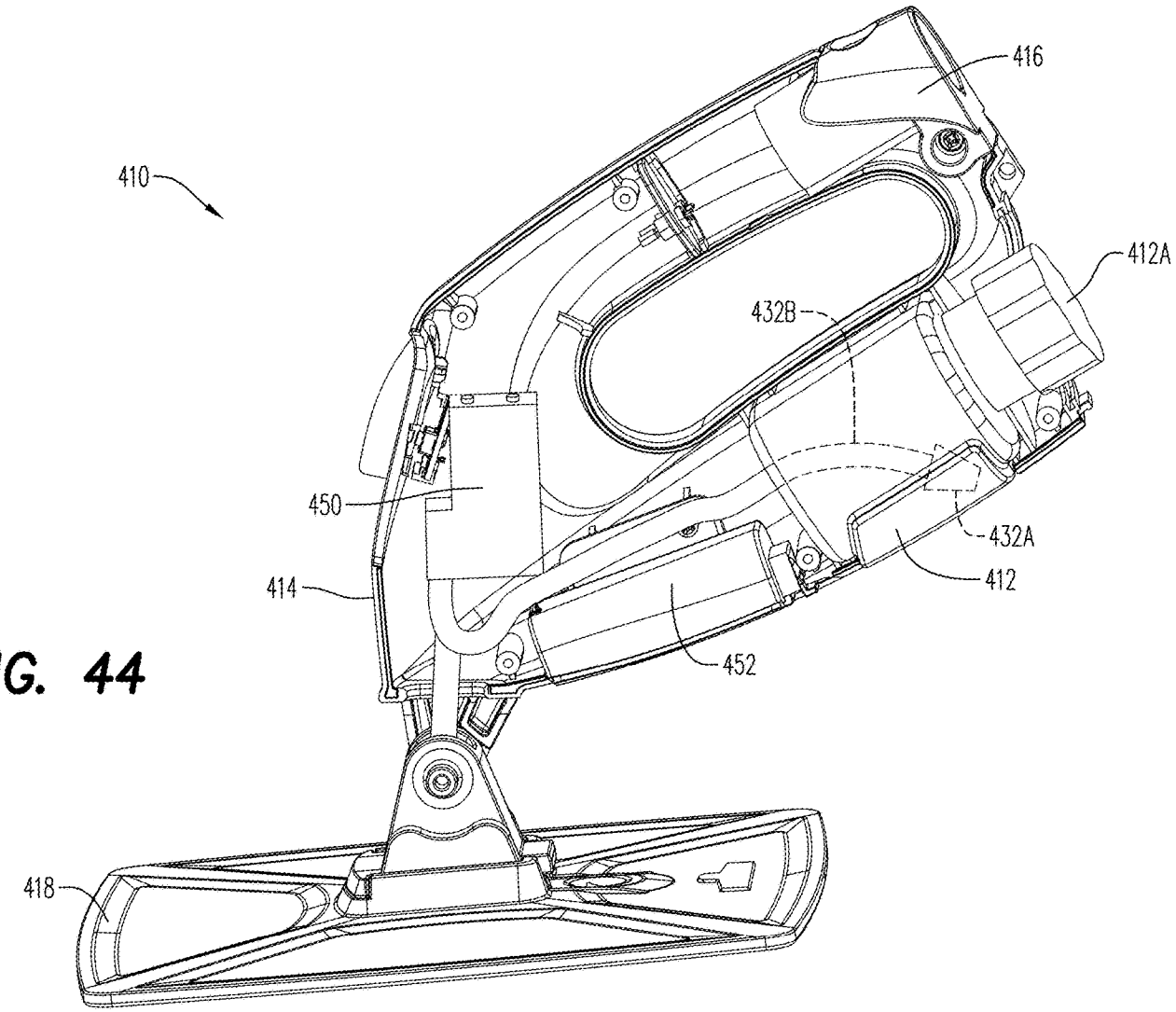
FIG. 44 is a partial sectional view of the cleaning device of FIG. 42.
Figure 45:
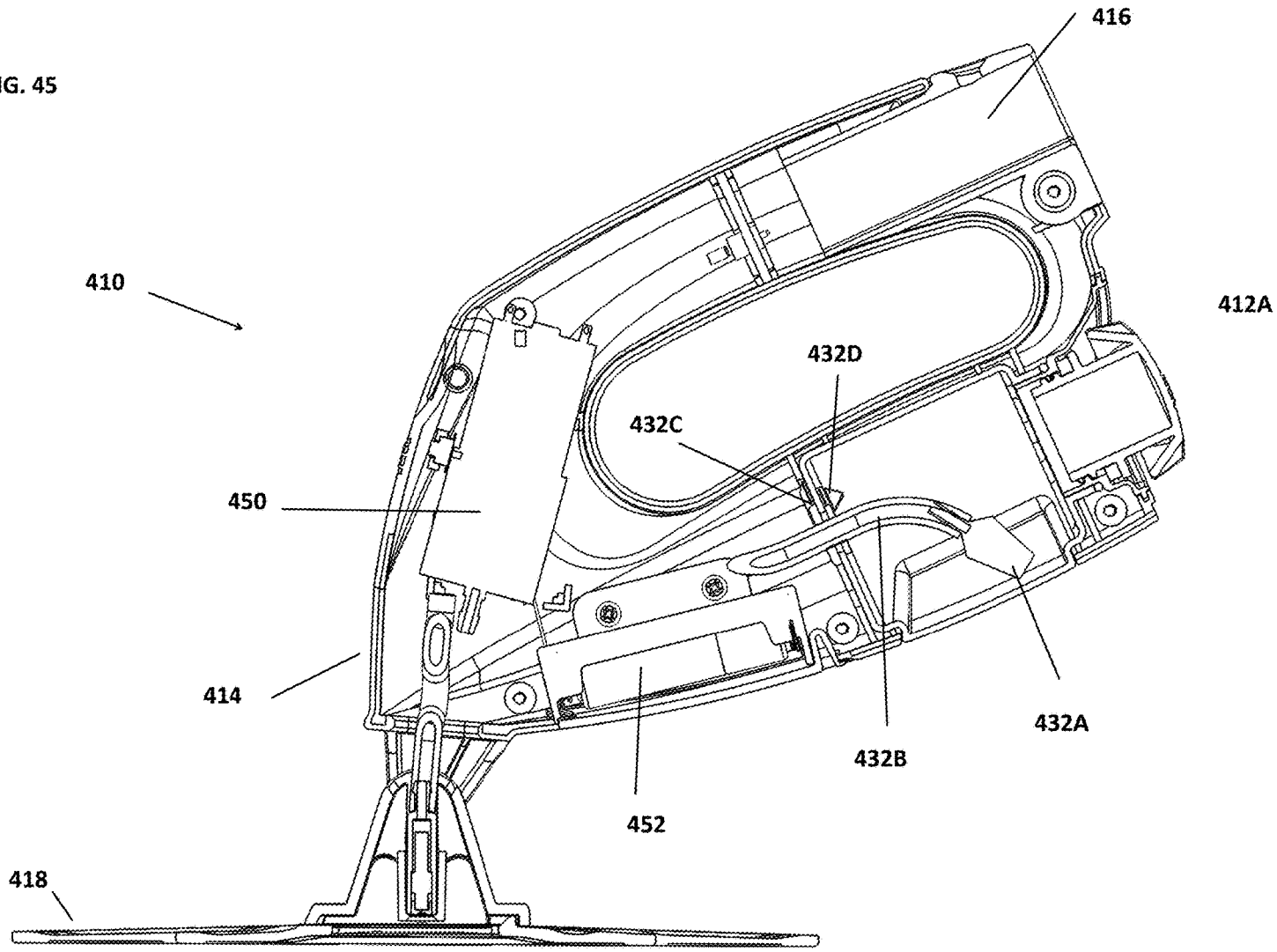
FIG. 45 is another partial sectional view of the cleaning device of FIG. 42.
Figure 46:
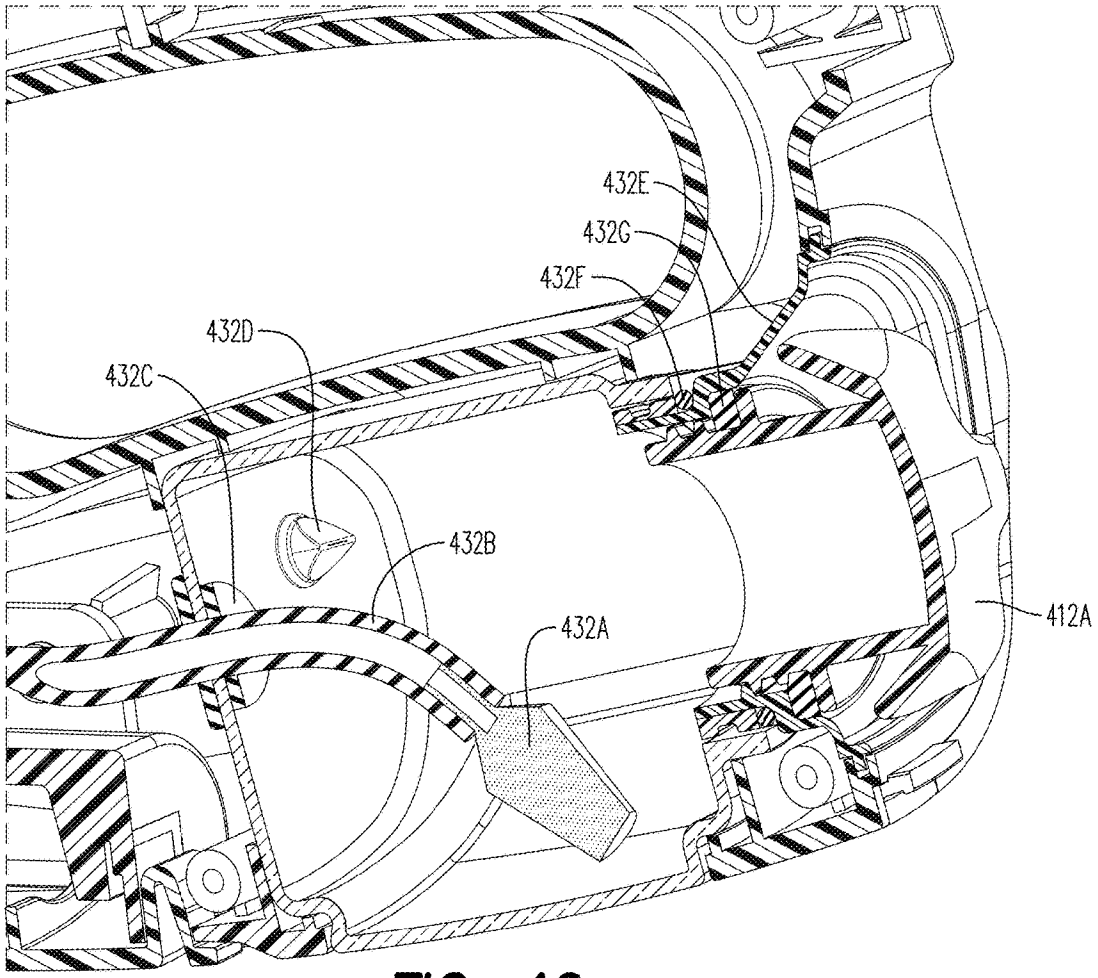
FIG. 46 is a magnified partial sectional view of the cleaning device of FIG. 42.

Accordingly, the reach of device 210 along the hard surface, such as but not limited to a horizontal surface, can be extended via pole 100 or via pole 300 illustrated in FIGS. 41A-41C, which is illustrated as having a single angular bend. Of course poles having no bend, more than one bend or having curved bends are contemplated for use with device 210.

Device 210 includes pump 250 and power source 252, which in this embodiment is illustrated as a battery. In order to allow replacement of the power source 252, housing 214 includes a separate removable cover 254, which in some embodiments can be provided with a seal or o-ring (not shown) to eliminate or at least mitigate leakage of fluids into the power source. In some embodiments, power source 252 is a rechargeable battery unit having one or more externally accessible recharging contacts 252A, which allow device 210 to be inserted into and charged by a recharging station (discussed in more detail below).

Device 210, the device includes a plate 246 that is configured as a tray that can be selectively slid into and out of housing 214 to assist in the installation and replacement of pouch 212 in housing.

Pouch 212 includes a connection port 232 that allows the pouch to form a releasable fluid and air tight connection with device 210. Connection port 232 includes a closure member 234, illustrated as an external thread, which removably receives a cap or closure (not shown) to close the pouch before use and/or between uses. In this manner, pouch 212 is easily accessible and replaceable.

Device 210 includes a pouch port 236 that can be removably received in connection port 232 of pouch 212 to place the pouch in fluid communication with the inlet port. Thus, a user can remove the cap from closure member 234 of pouch 212 and insert pouch port 236 into connection port 232 to form a fluid and air tight connection. In some embodiments, inlet port 236 can include an o-ring or other seal member (not shown) to improve or enhance the seal between pouch 212 and pouch port 236.

Without wishing to be bound by any particular theory, the fluid and air tight connection of pouch 212 to device 210 is believed to prevent or at least slow degradation of the cleaning fluid in the pouch. For example, some oxidizing agents and antimicrobial agents commonly used in cleaning fluids are known to degrade in the presence of air, debris, and/or containments. Thus, device 210 is particularly configured to minimize the exposure of air to the cleaning agents in pouch 212 by way of the air tight connection thereto.

Preferably, pouch 212 can include a slit valve (not shown) that selectively opens upon application of a negative pressure on the pouch by the pump within device 10 and closes, under its own resilience after the pump is turned off. In this manner, device 210 with pouch 212 installed therein forms a fluid tight connection that prevents, or at least minimizes, leakage of cleaning fluid from pouch when the device is stored or not in use and/or when the pouch is removed from the device. Thus, pouch 212 and pouch port 236 are configured so that the pouch port, when inserted into the pouch, does not pass through the valve.

In the illustrated embodiment, pouch port 236 is secured to housing 214 in a rigid or stationary manner, which allows the sliding of plate 246, having pouch 212 carried thereon, to connect ports 232, 236 to one another. Device 210 includes one or more guiding members to ensure alignment and connection of ports 232, 236.

For example, device 210 can in some embodiments include cooperating guides 246A, 246B on plate 246 and housing 214, respectively. Guides 246A, 246B are positioned and configured to ensure that plate 246 maintains a desired position within housing 214, where the desired position helps to ensure alignment and connection of ports 232, 236 during the installation of the plate into the housing.

Device 210 can include in other embodiments or together with guides 246A, 246B, guides 232A, 232B on pouch 212 and plate 246, respectively. Here, pouch 212 can be held in a desired position in plate 246—namely with port 232 in a desired position with respect to the plate—by engaging guide 232A of the pouch with guide 232B of the plate.

It has been found by the present disclosure that device 210, particularly when having both guides 232A, 232B and guides 246A, 246B, assists in easy and accurate installation of pouch 212 in the device.

Figure 36A:
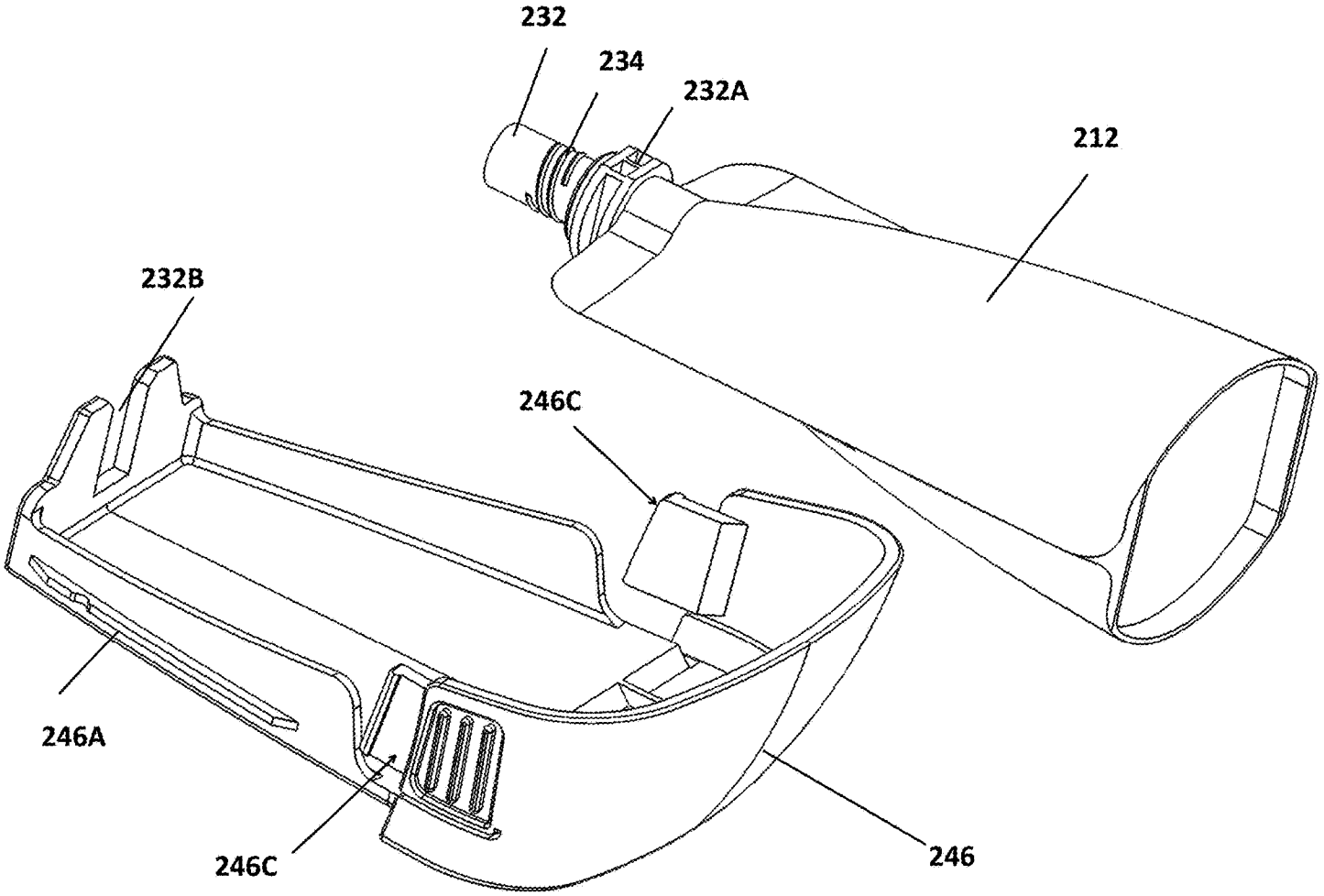
FIG. 36A is a rear perspective exploded view of a loading plate and cleaning fluid pouch of the cleaning device of FIG. 34.
Figure 36B:
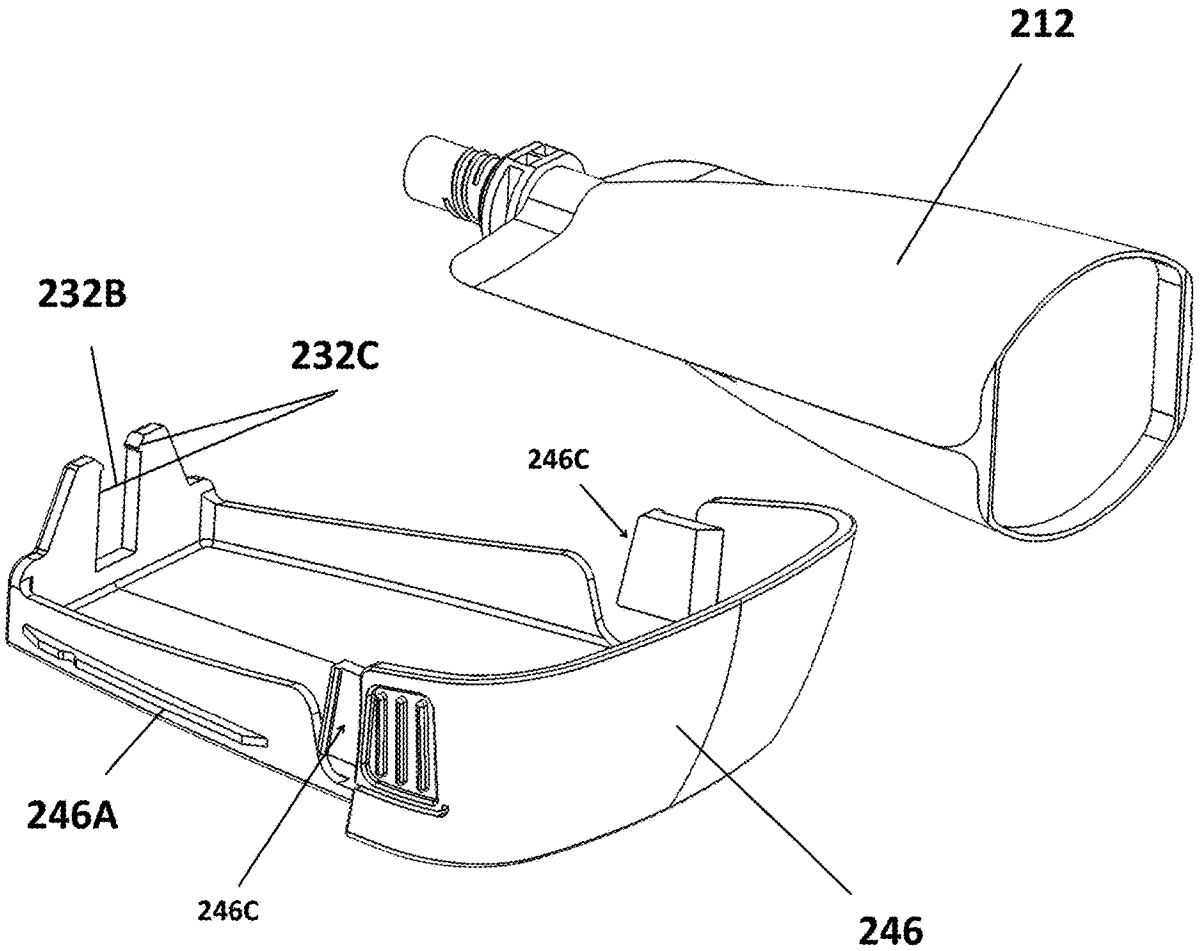
FIG. 36B is a rear perspective exploded view of an alternate embodiment of a loading plate and cleaning fluid pouch of the cleaning device of FIG. 34.
Figure 37:
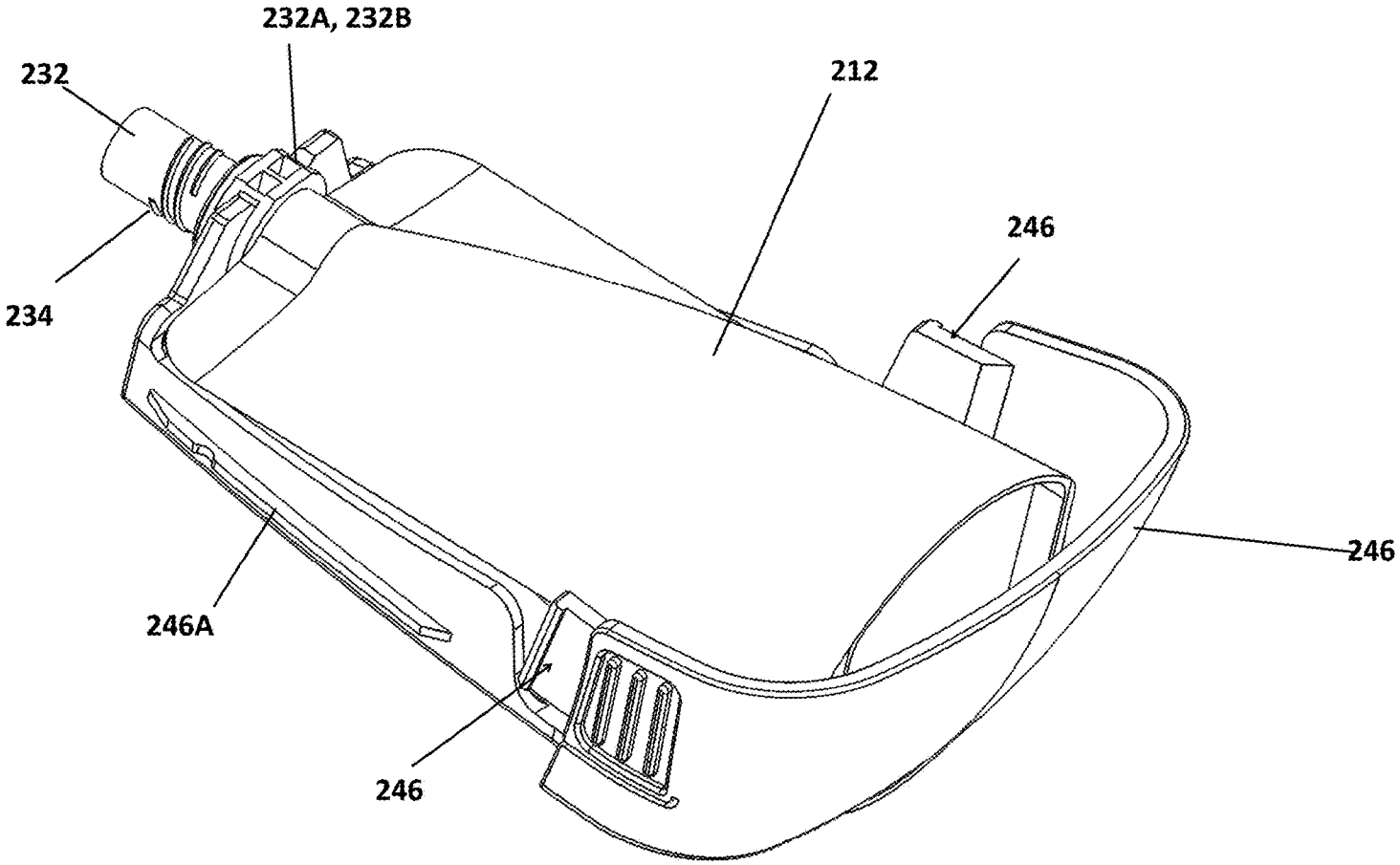
FIG. 37 is a rear perspective assembled view of the loading plate and cleaning fluid pouch of the cleaning device of FIG. 34.
Figure 38:
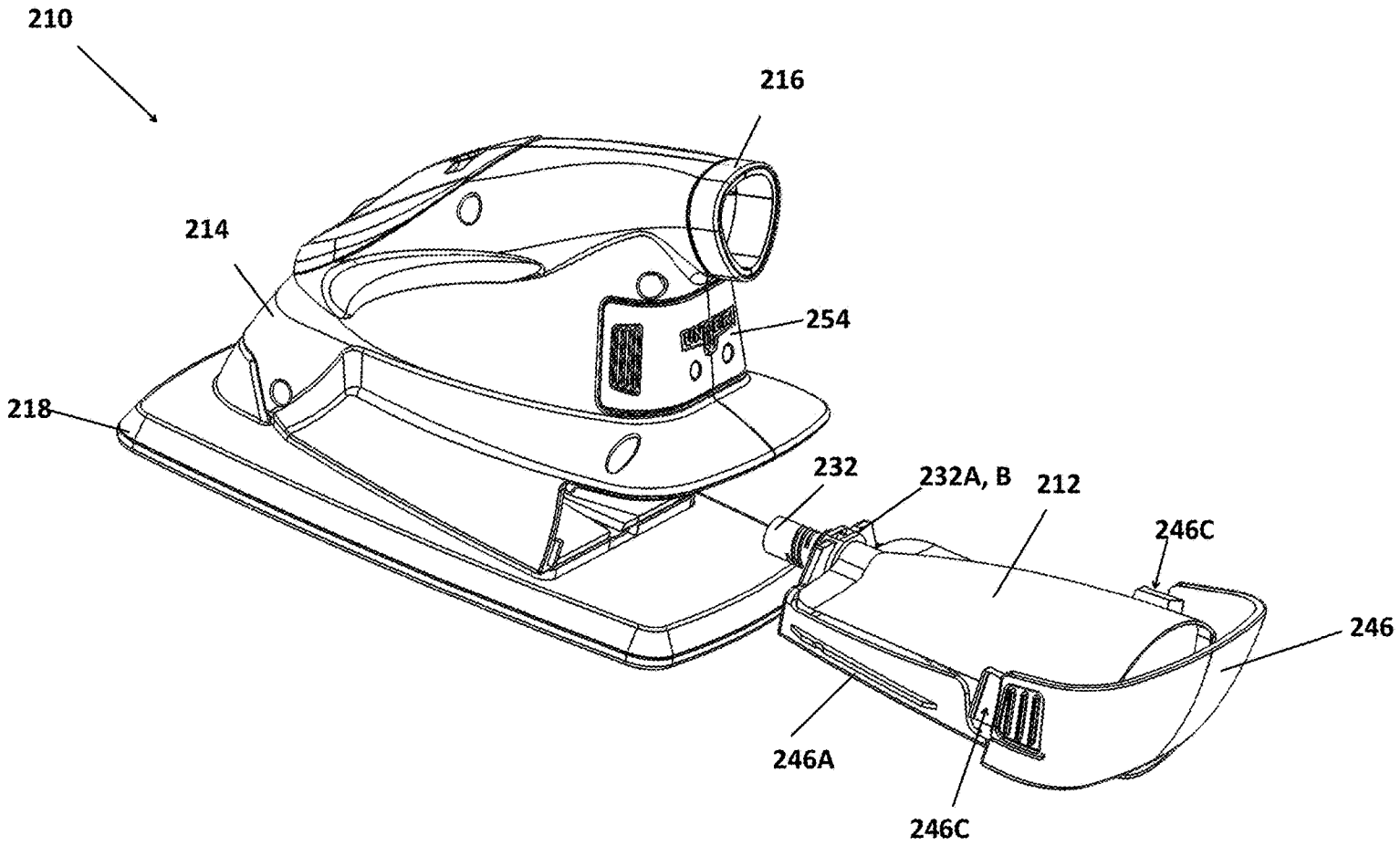
FIG. 38 is a rear perspective view of the assembled loading plate and cleaning fluid pouch before installation into the cleaning device of FIG. 34.
Figure 39:
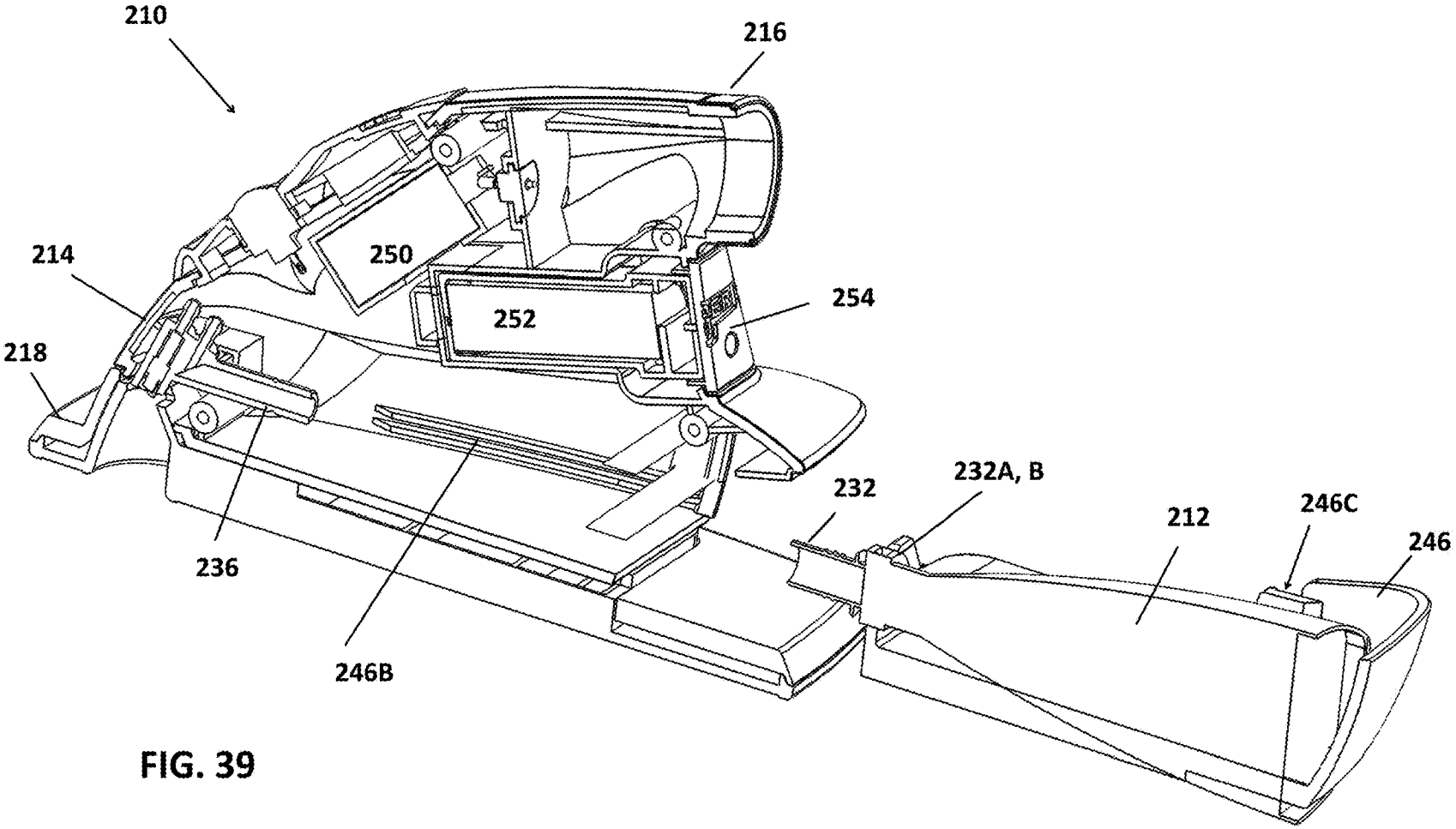
FIG. 39 is a sectional view of FIG. 38.
Figure 40:
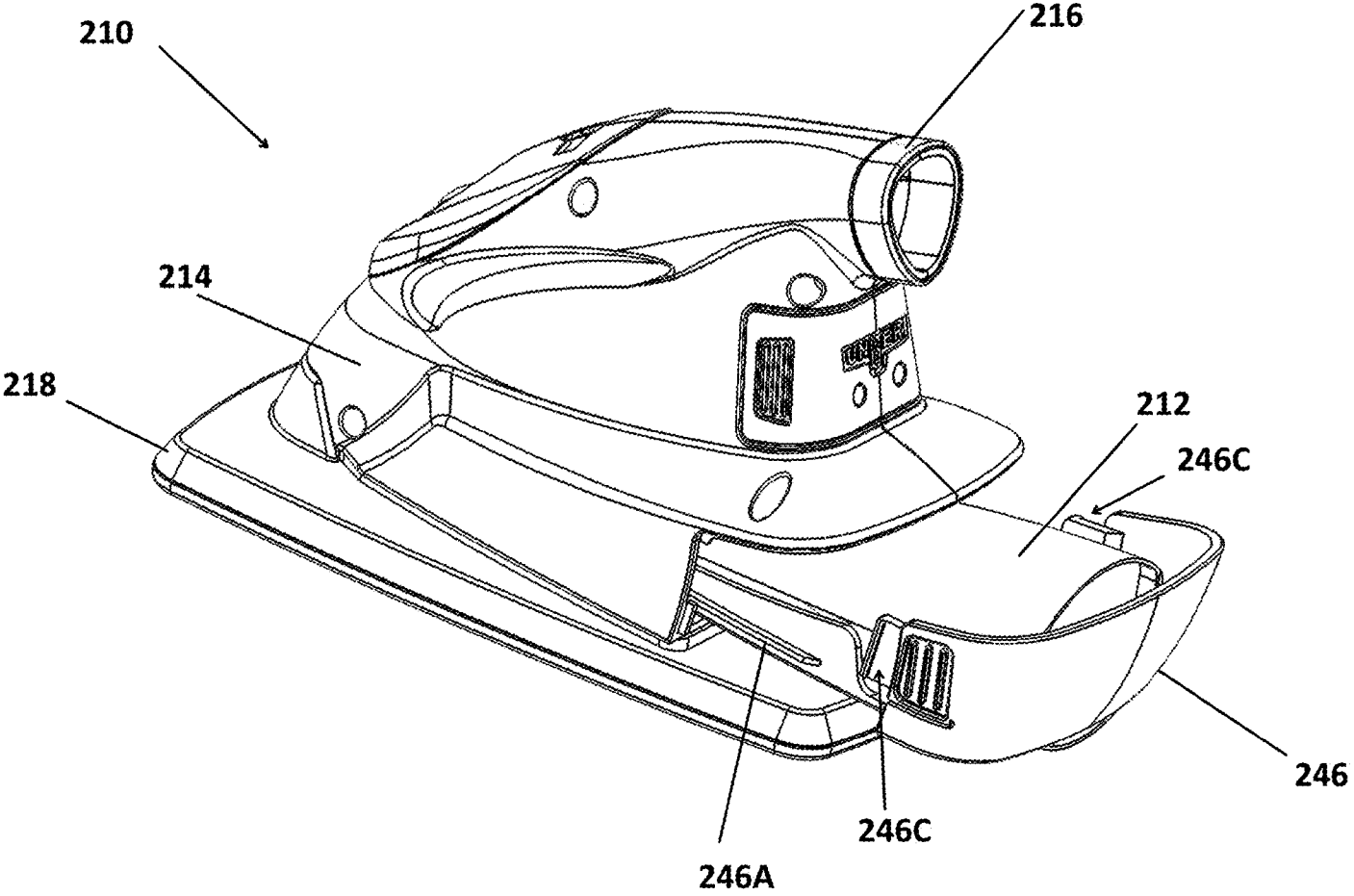
FIG. 40 is a rear perspective view of the assembled loading plate and cleaning fluid pouch during installation into the cleaning device of FIG. 34.

Pouch 212 can be held in position in device 210 by—for example—the friction between ports 232, 236 in FIG. 36A. Of course, it is contemplated by the present disclosure for device 210 to secure pouch 212 in by any desired method. For example and as illustrated in FIG. 36B, plate 246 can include one or more ears 232C at guide 232A, which resiliently flex and/or resiliently flex port 232 of pouch 212 during installation and removal of port 232 from the plate.

In the illustrated embodiment, plate 246 includes one or more resilient locking tabs 246C that selectively engage with housing 214 to secure the plate, having pouch 212 riding thereon, in device 210.

Referring to the drawings and in particular to FIGS. 42-47, another alternate exemplary embodiment of a cleaning device according to the present disclosure is shown and is generally referred to by reference numeral 410. Here, component parts performing similar or analogous functions to those originally discussed above are labeled in multiples of four hundred of the original reference numerals. In the interest of brevity, only certain aspects of device 410, that differ from those discussed above with respect to devices 10, 210, are discussed herein below.

Device 410 includes a main housing 414 having a handle 416 depending therefrom. Device 410 also includes a cleaning head 418 having a cleaning element (not shown) that is disposable thereon. As will be described in more detail below, device 410 is configured to receive liquid cleaning fluid in a refillable rigid container 412 positioned in housing 414.

Device 410 is configured for use with a cleaning element that—as disclosed above—includes an opening through which the cleaning fluid is sprayed. The cleaning element can be any desired material sufficient for the desired cleaning action such as, but not limited to, washable fabrics, disposable fabrics, woven fabrics, non-woven fabrics, microfiber fabrics, fabrics made of natural materials (e.g., cotton), synthetic materials (e.g. polyester), combinations of natural and synthetic materials, materials in the form of brushes or scrubbing materials (e.g., melamine foam), and any combinations of the aforementioned or other materials.

Device 420 is configured to pump fluid from container 412 to one or more spray nozzles (not shown) directly onto the surface being cleaned. However, in this embodiment, container 412 includes a removable cap 412A and, in some embodiments, housing 414 includes cover 414A that hingeably covers the cap. Container 412 can include at least one transparent region that can be viewed from outside of housing 414 to allow the user to visually check the amount and/or type of cleaning fluid in the container.

In some embodiments, container 412 includes a weighted port 432A—which can include a filter if desired secured to a flexible tube 432B, that places the cleaning fluid in communication with pump 450 and power source 452 as described above. In this manner, device 410 is particularly configured for use in a variety of different orientations with the weighted port 432A remaining in the cleaning fluid regardless of how the device is held.

In some embodiments, container 412 can include a grommet 432C that forms a fluid tight seal between the container and flexible tube 432B to allow the tube to pass through the container and fluidly communicate with pump 450.

In some embodiments, container 412 can include a vent 432D—illustrated as a resilient valve—that allows any pressure (negative or positive) above predetermined levels that form within the container to vent to atmosphere and, preferably, in a manner that prevents leakage of fluid from within the container.

In some embodiments, container 412 can be formed in multiple sections and include, for example, a funnel section 432E that is sealed to a main section of the container by a seal or o-ring 432F. Funnel section 432E can be manufactured from a rigid material such as, but not limited to, polypropylene (PP), acrylonitrile butadiene styrene (ABS), Nylon, or a flexible material such as, but not limited to, thermoplastic elastomer (fPE), ethylene propylene diene monomer (EPDM), silicone, or other thermoset or thermoplastic materials.

In other embodiments, container 412 can include a seal or o-ring 432G between the cap 412A and the container 412.

Without wishing to be bound by any particular theory, the fluid and air tight connection of container 412 to device 410 is believed to prevent or at least slow degradation of the cleaning fluid in the pouch. For example, some oxidizing agents and antimicrobial agents commonly used in cleaning fluids are known to degrade in the presence of air or in contact with debris or containments. Thus, device 410 is particularly configured to minimize the exposure of air to the cleaning agents in container 412 by way of the air tight connection thereof.

Additionally, device 410 is shown, by way of example, having handle 416 being formed on housing 414 with an opening and at a position that allows the device to be particularly configured for use in cleaning horizontal surfaces, vertical surfaces, or at any desired angle.

Figure 47:
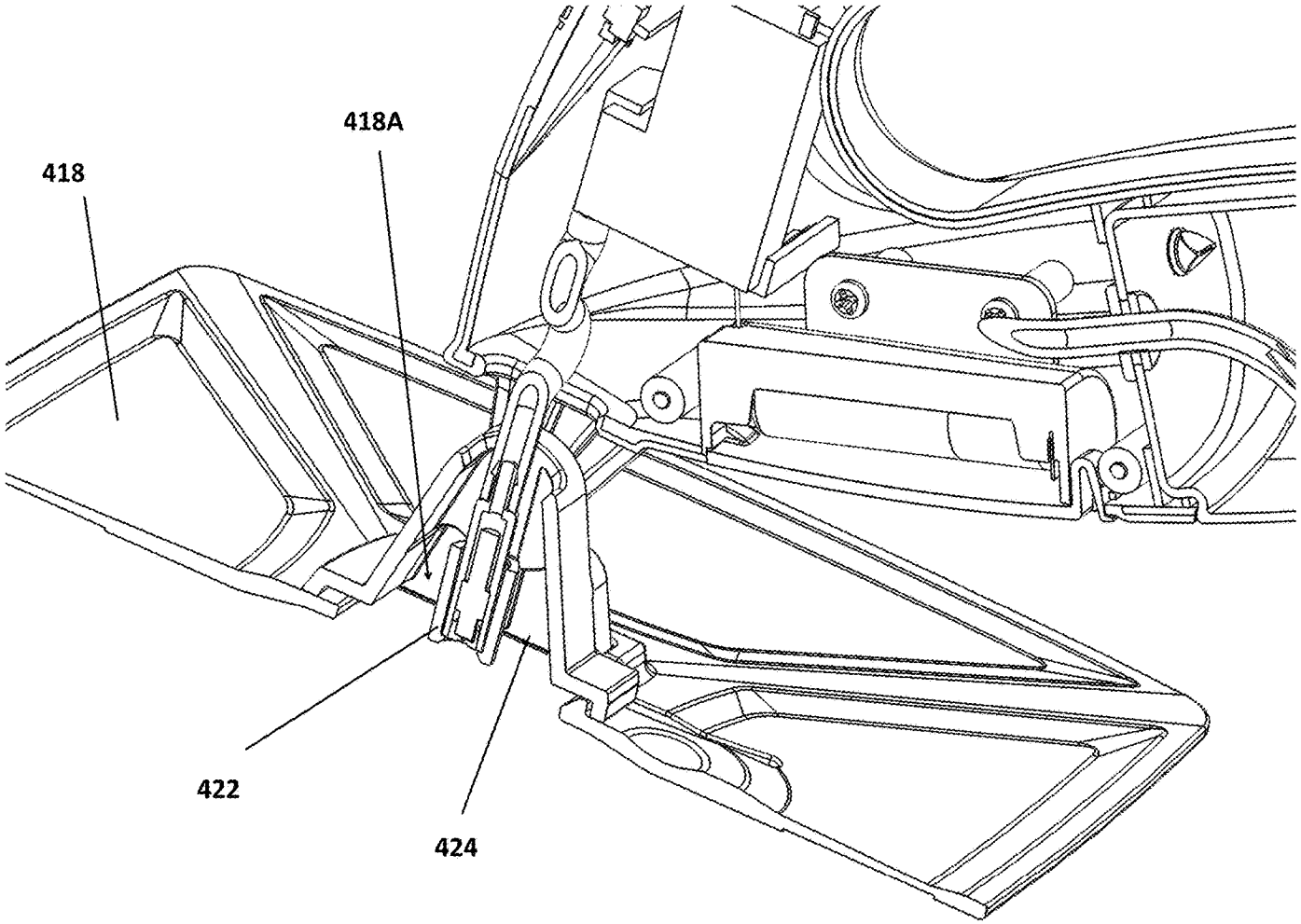
FIG. 47 is another magnified partial sectional view of the cleaning device of FIG. 42.

Referring now to FIG. 47, device 410 is configured to pump fluid from container 412 to one or more spray nozzles 422 (one shown) directly onto the surface being cleaned. Here, cleaning head 418 includes a central opening 424 that is in alignment or registration with an opening (not shown) in the cleaning member (not shown) so that spray nozzles 422 spray the cleaning fluid through the openings onto the surface being cleaned. Without wishing to be bound by any particular theory, head 418 defines a chamber 418A around nozzles 422 and positions the nozzles a predefined distance from the surface being cleaned. In this manner, device 410 is particularly configured to capture any spray of the cleaning fluid within head 418 and is particularly configured to ensure coverage of the surface being cleaned by allowing the spray from the nozzles 422 to have sufficient space, volume, or time to form larger droplets until all the chemical is on the surface being clean.

Thus, it has been determined by the present disclosure that, in some embodiments, there is a relationship between the height of nozzle 422 from the surface being cleaned (measured to the surface of the pad) and the volume of the chamber 418A, examples of which are illustrated in Table 1.

TABLE 1

COMPARISON OF NOZZLE HEIGHT AND CHAMBER VOLUME

| Example No. | Approx Nozzle height from Pad surface (mm) | Approx chamber volume around nozzle (cc) |
|---|---|---|
| 1 | 3.75 | 37 |
| 2 | 7 | 10 |
| 3 | 25 | 10 |

Although device 410 is not shown in use with one or more extension handles 100 discussed in detail above, it should be recognized that handle 416 is configured for use with such handles. For example, handle 416—much like handles 16, 216—functions in a manner similar to second assembly 108 and, thus, includes the elements of the second assembly necessary to form the desired physical and electrical connection with pole 100. Accordingly, handle 416 can include lock opening (not shown), electrical contacts (not shown), and, when necessary, a guide member (not shown). Accordingly, the reach of device 410 along the surface can be extended via pole 100 and/or pole 300 discussed above.

It is also contemplated by the present disclosure for device 10, 210, 410 to include pole attached to or integrally formed with the device—where the pole in these embodiments is extendable when needed or retractable at least partially into the device when not needed—such as, but not limited to, the structures used with luggage, briefcases, umbrellas, and the like.

Figure 48:
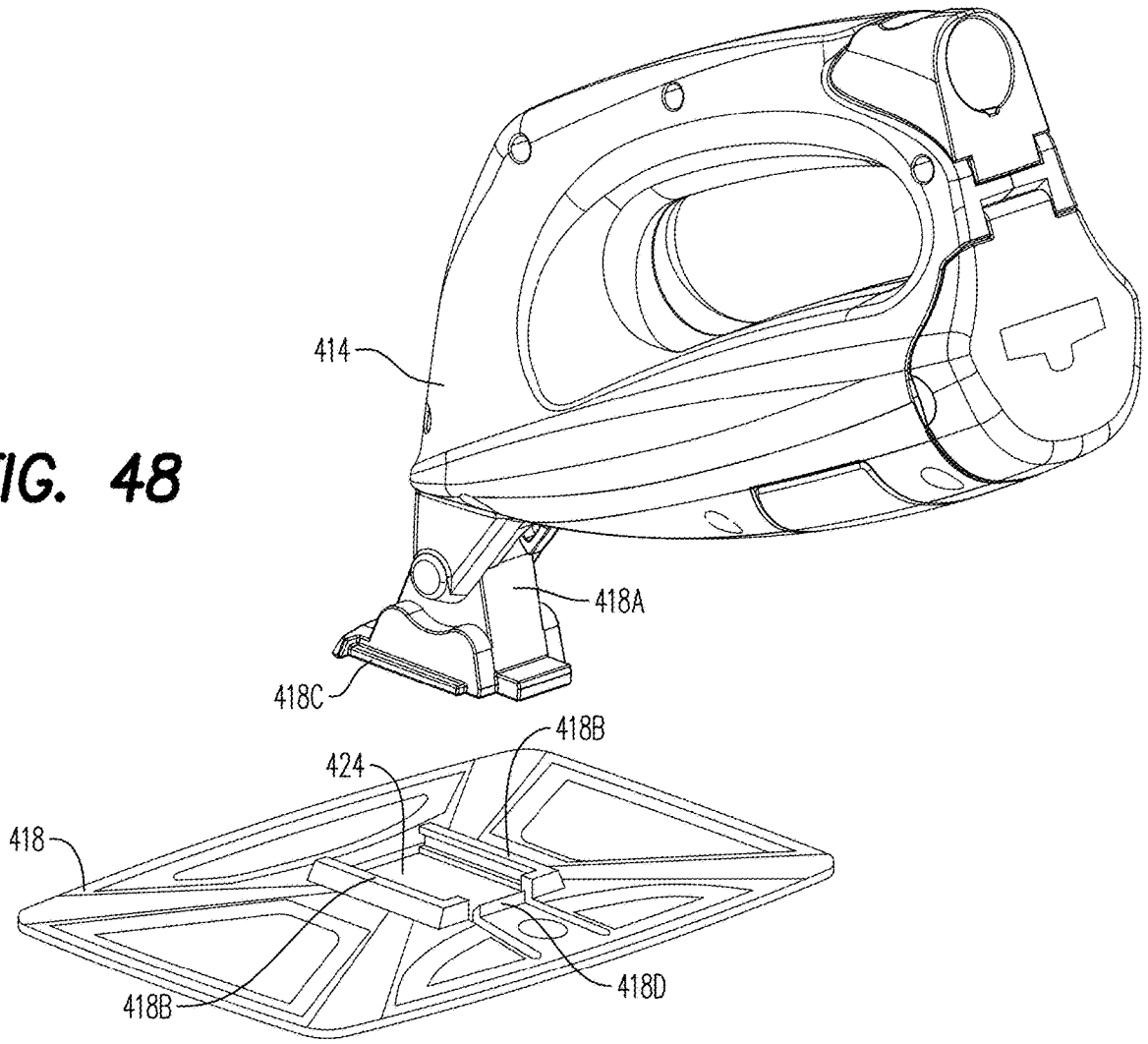
FIG. 48 is a partially disassembled view of the cleaning device in FIG. 47.
Figure 49:
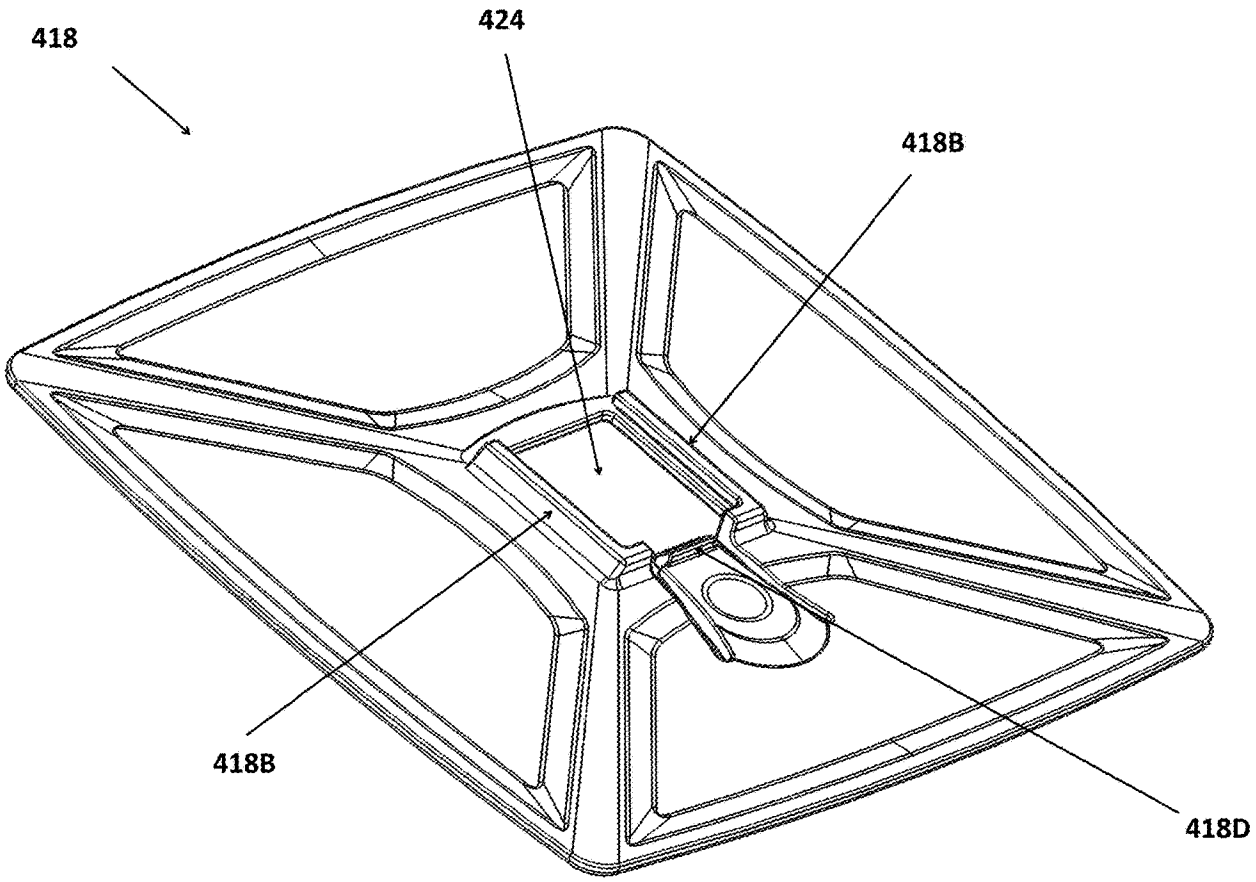
FIG. 49 is a top view of the cleaning head of FIG. 47.
Figure 50:
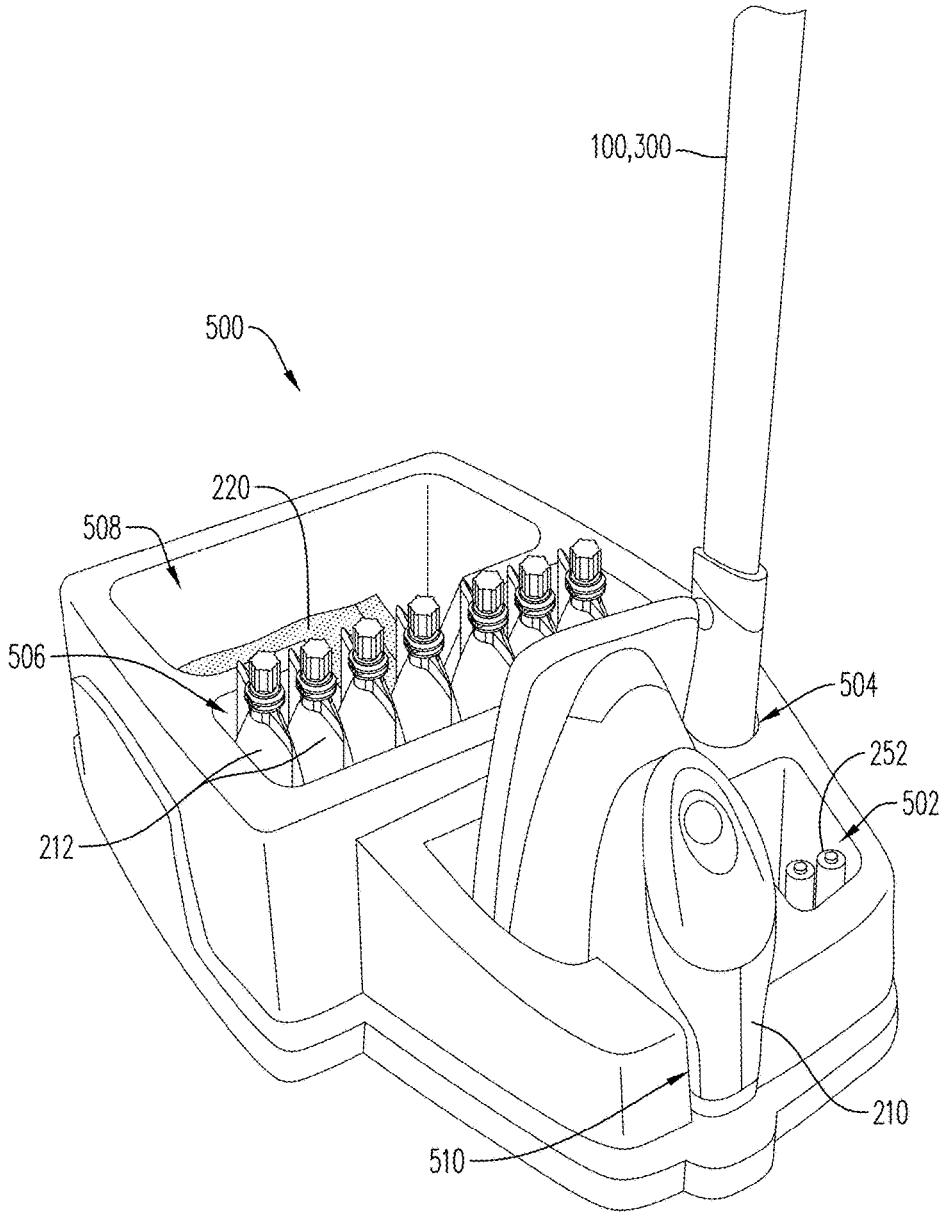
FIGS. 50 to 53 are perspective views of an exemplary embodiment of a station for use with the cleaning device of FIG. 34.
Figure 51:
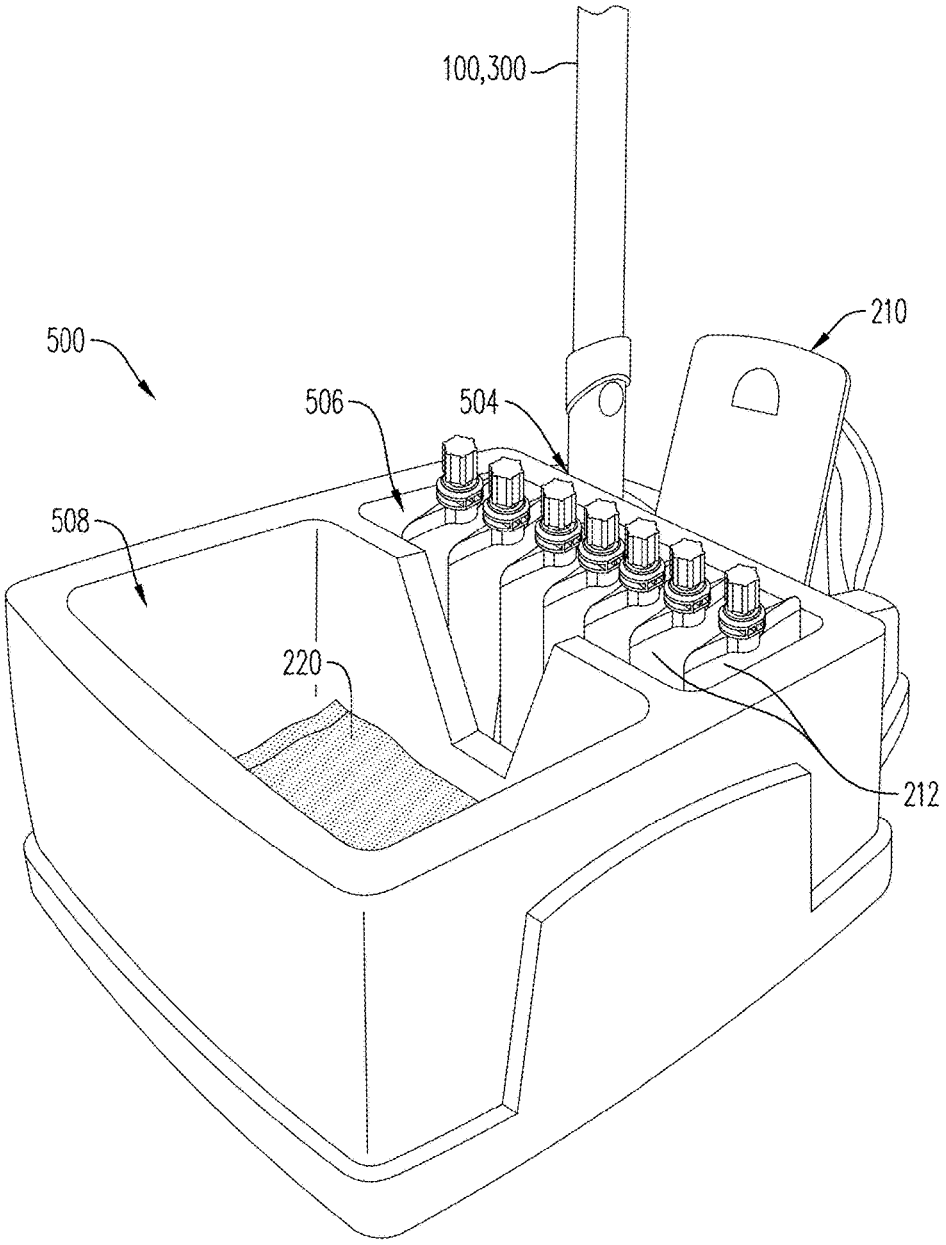
Figure 52:
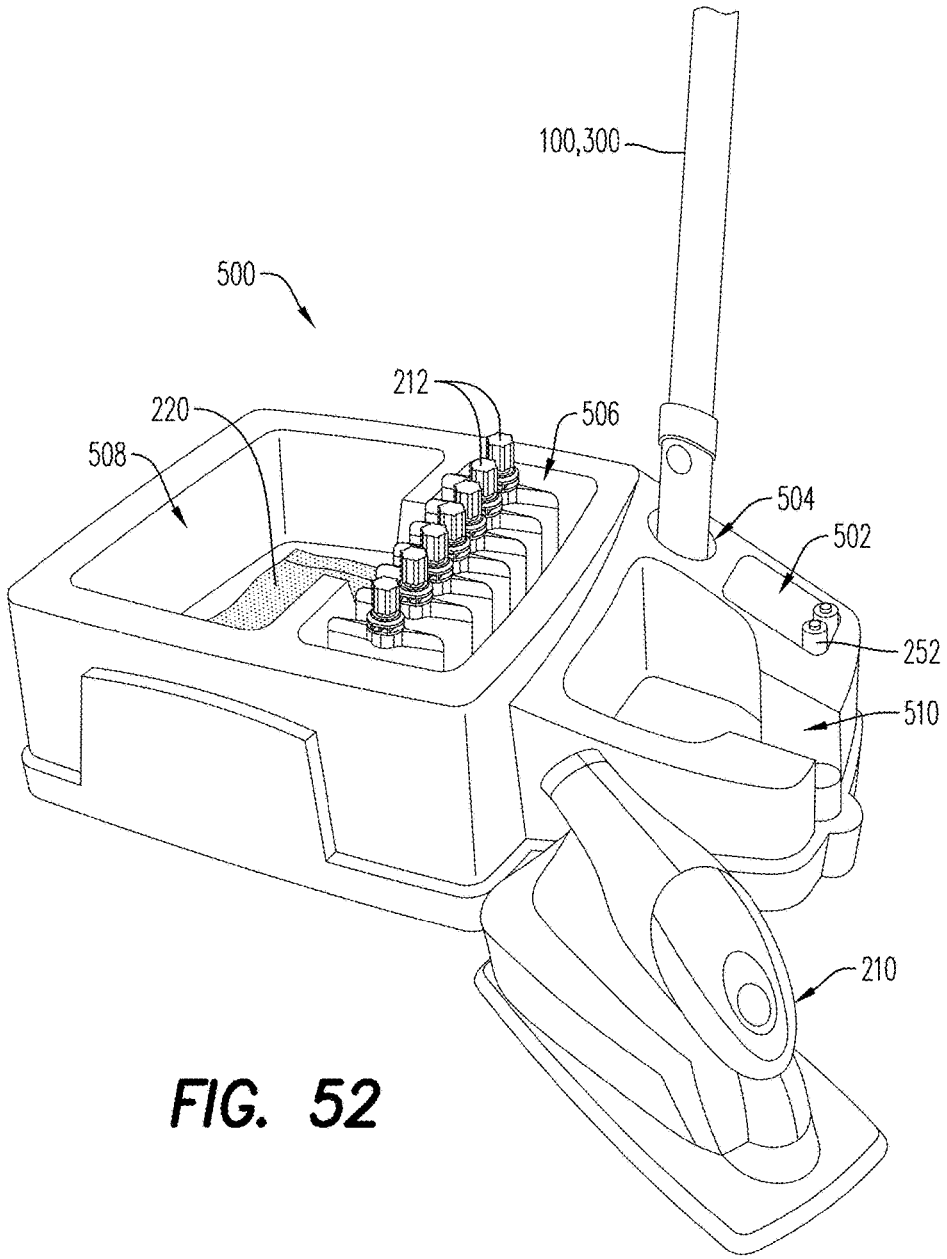
Figure 53:
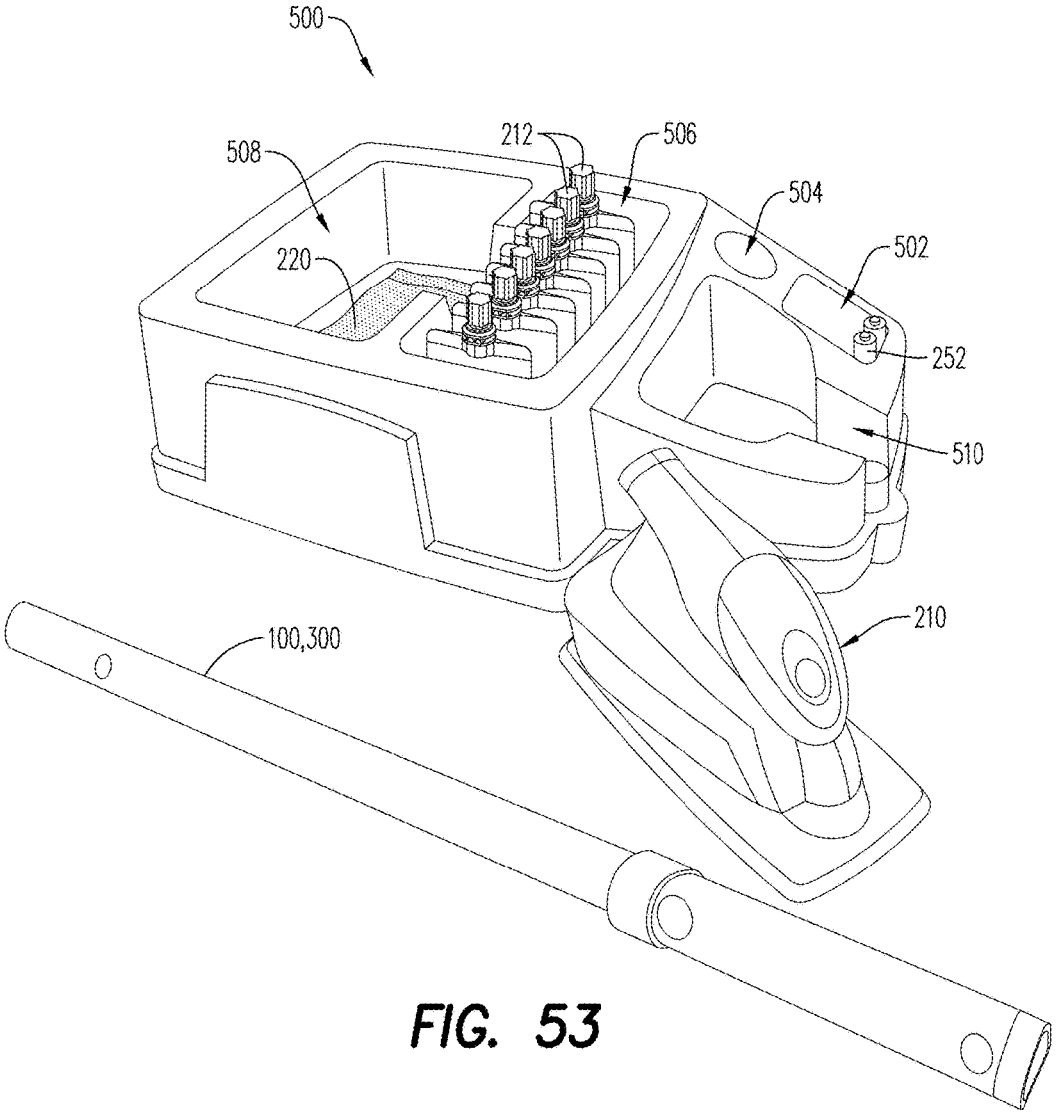
Figure 54:
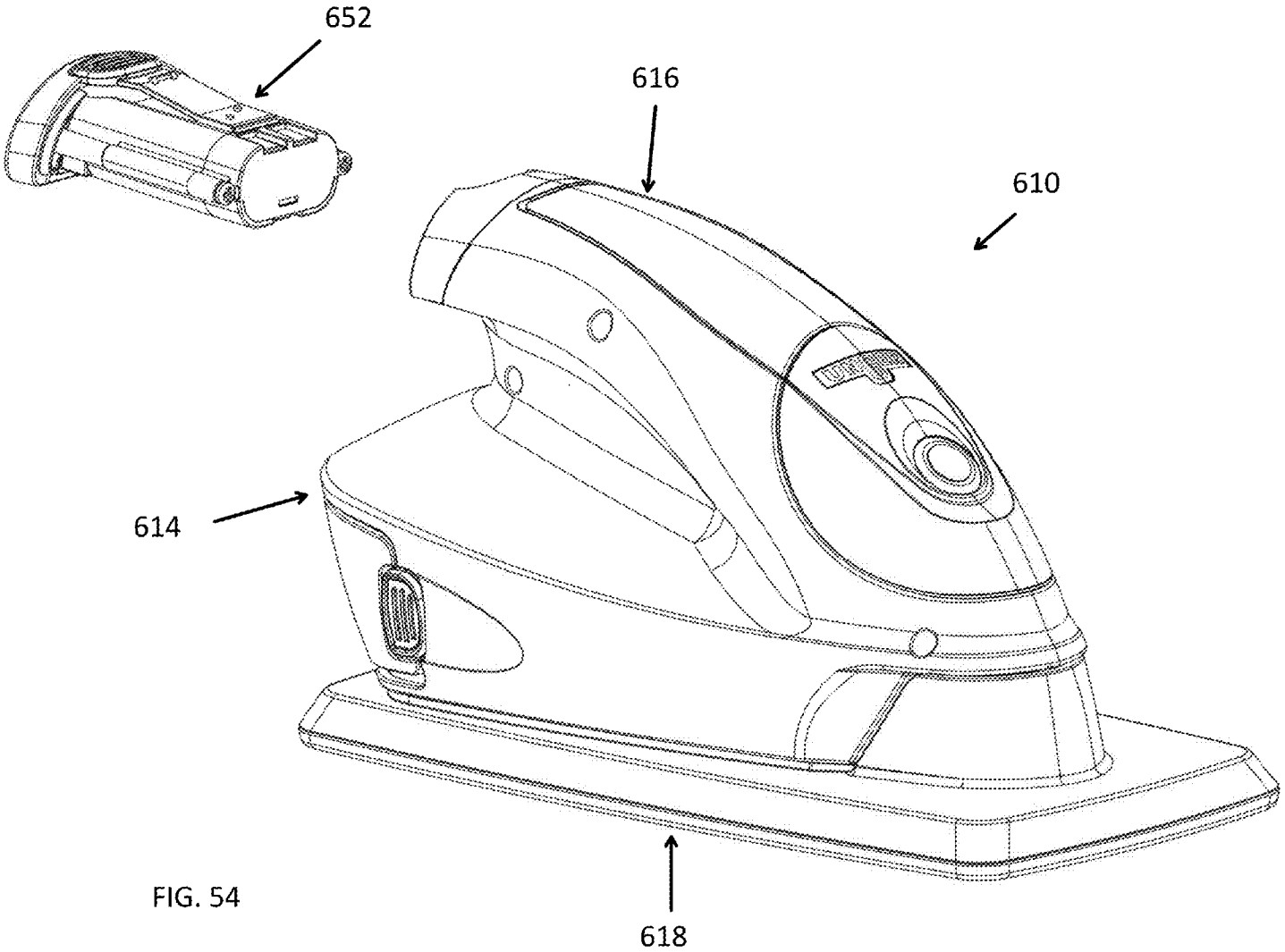
FIG. 54 is a front top perspective view of yet another alternate exemplary embodiment of a cleaning device according to the present disclosure.
Figure 55:
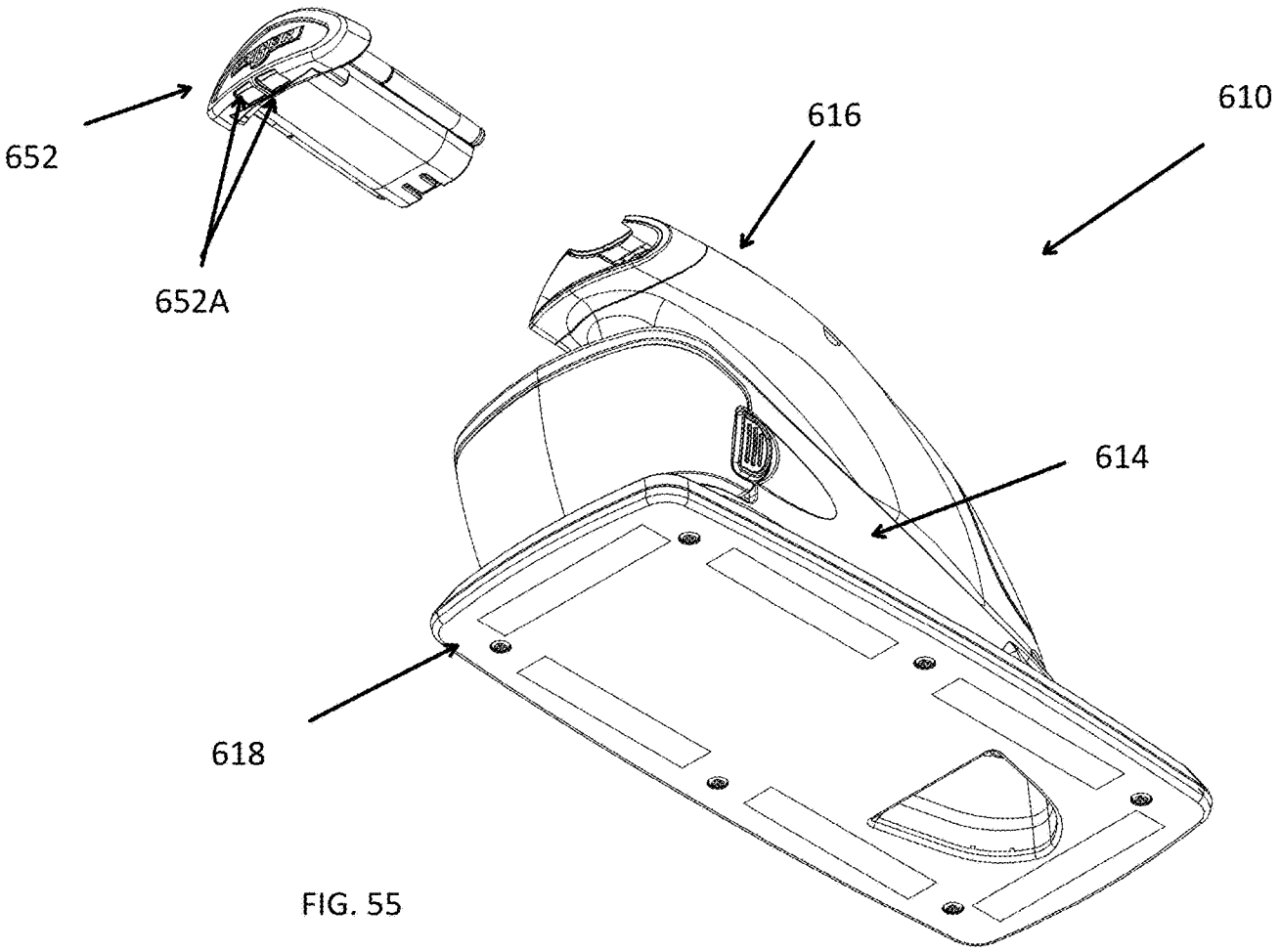
FIG. 55 is a rear, bottom perspective view of the cleaning device of FIG. 54.
Figure 56:
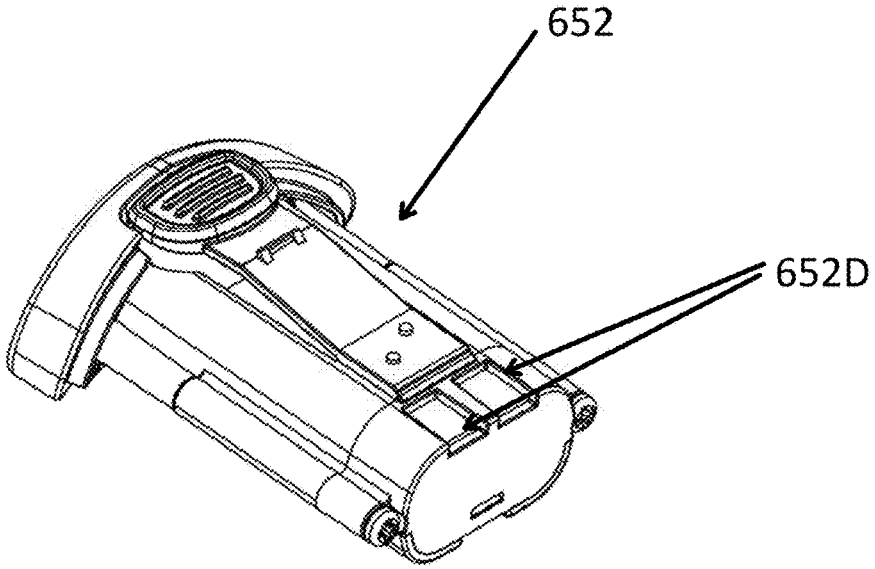
FIGS. 56-59 illustrate an exemplary embodiment of a battery pack for use with the cleaning device of FIG. 54.
Figure 57:
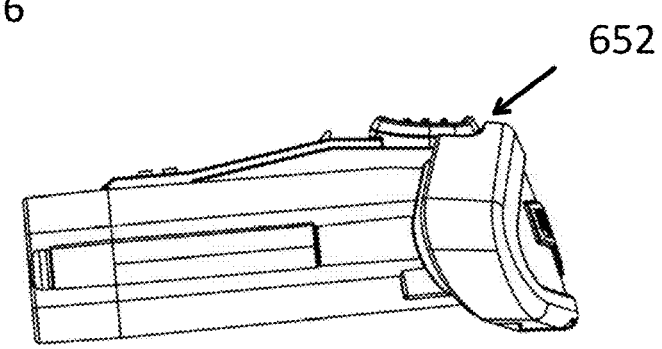
Figure 58:
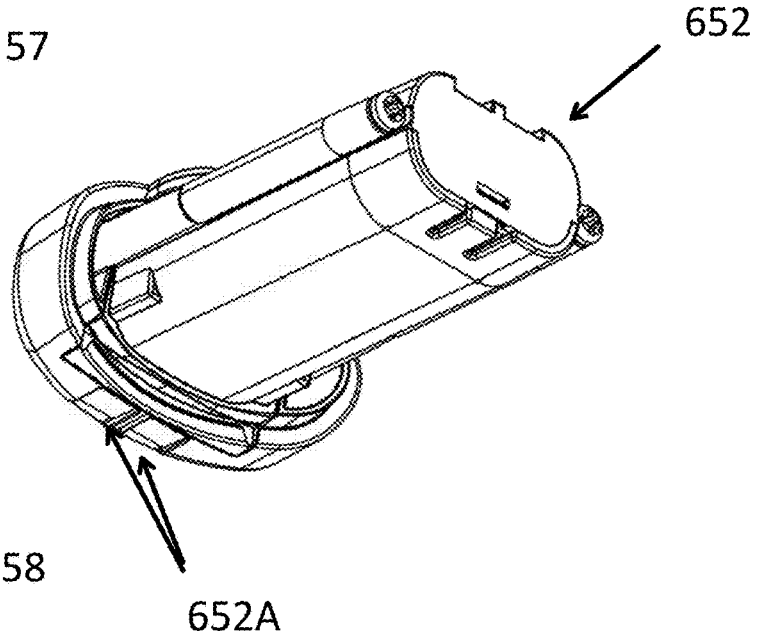
Figure 59:
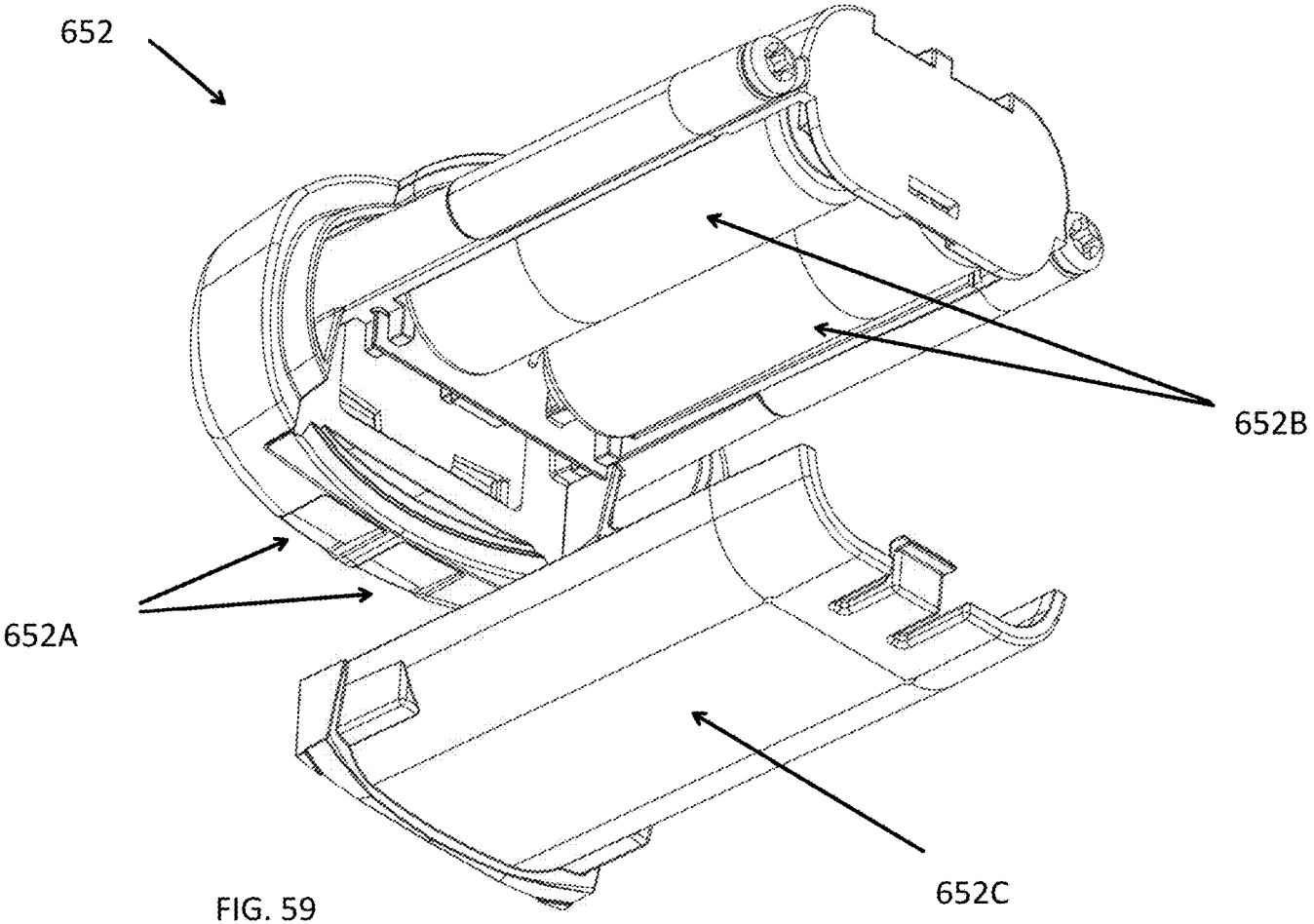

Device 410 also includes, as best seen in FIGS. 47 and 48, cleaning head 418 that is easily removed for replacement with a new cleaning head or with a cleaning head that has a different shape, size or other property. Additionally, the removable cleaning head 418 allows device 410 to have a smaller form factor for shipping and/or storage.

In this embodiment, chamber 418A is secured to handle 414 and cleaning head 418 is selectively removable from the chamber at opening 424. In the illustrated embodiment, chamber 418A includes features 418B (illustrated as lips) that mate with and retain corresponding features 418C (illustrated as channels) of cleaning head 418. In this manner, features 418A, 418B allow the user to selectively attach and remove cleaning head 418 to/from chamber 418A.

Additionally, cleaning head 418 can include a resilient locking tab 418D that locks the cleaning head to the handle 414. Here, resilient locking tab 418D can deflect as cleaning head 418 is inserted onto chamber 418A and can return to an initial position holding the head and handle 414 to one another until the tab is depressed by the end user and the head is slid out from the chamber.

Figure 34:
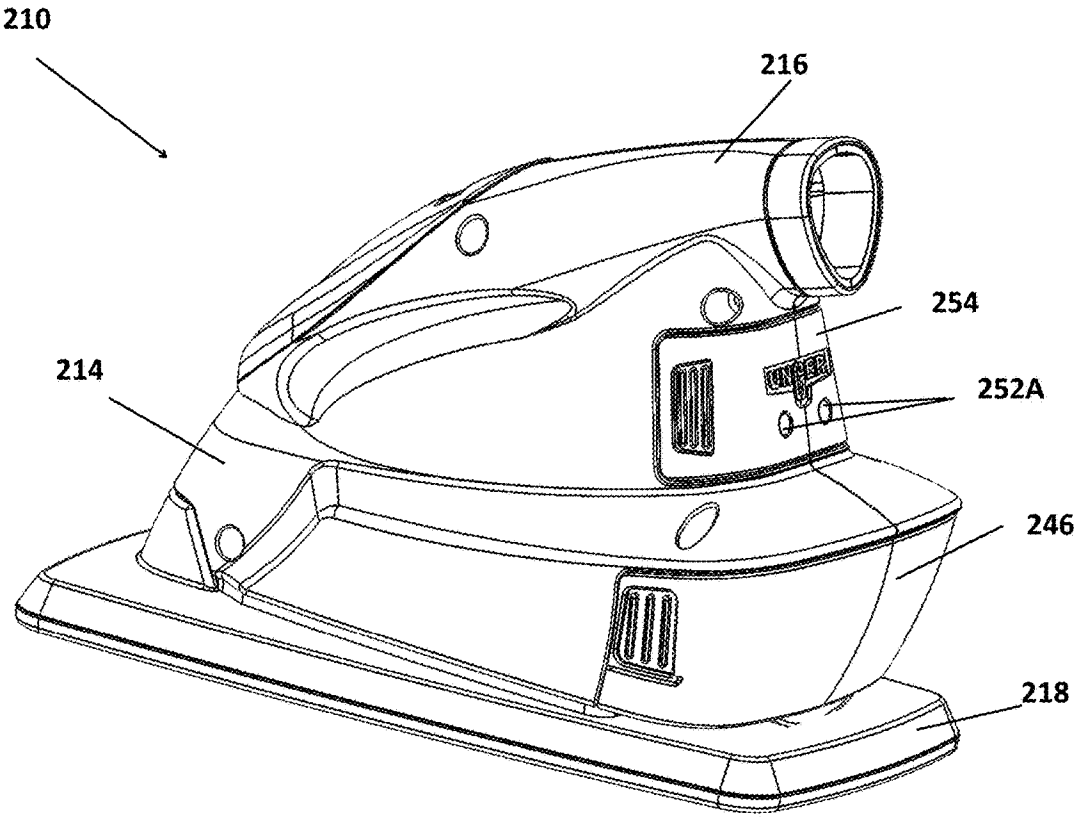
FIG. 34 is a rear perspective view of an alternate exemplary embodiment of a cleaning device according to the present disclosure.
Figure 35:
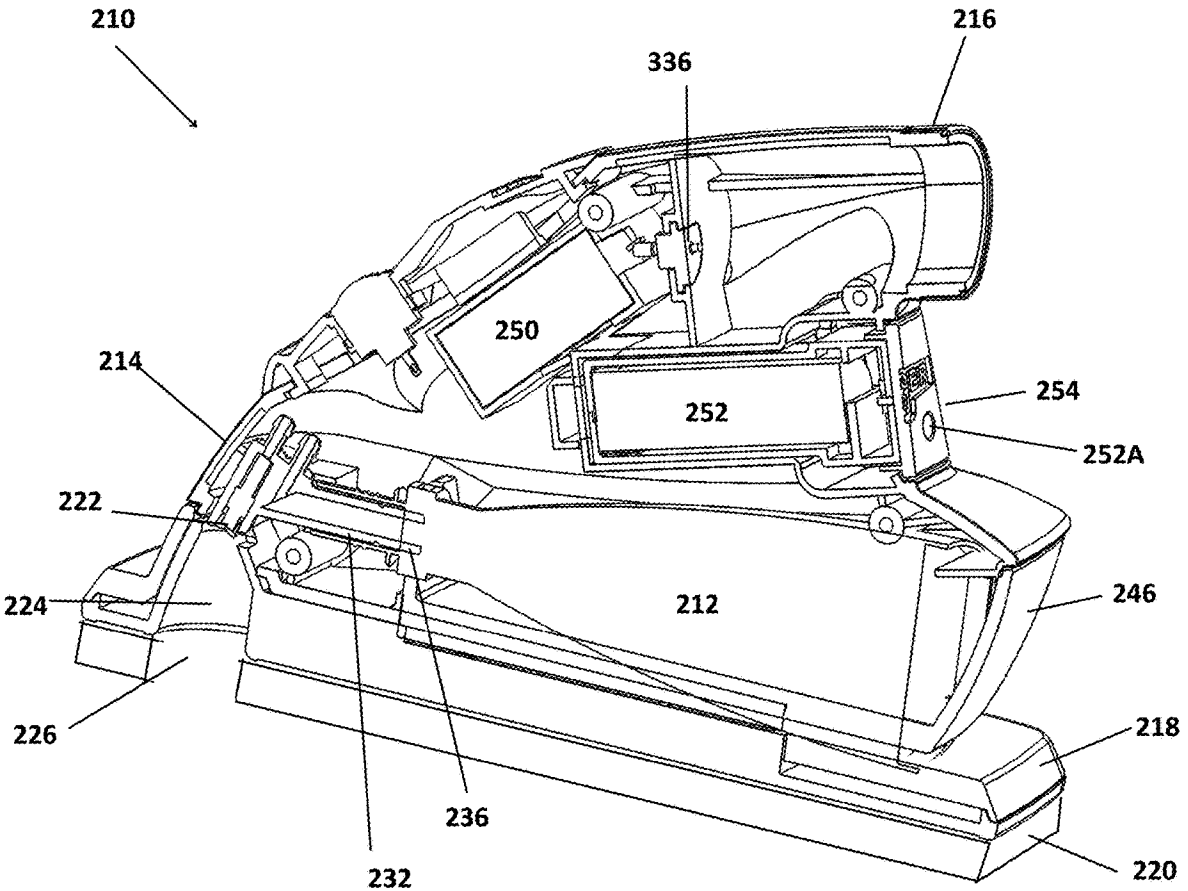
FIG. 35 is a sectional view of FIG. 34.

Referring now to FIGS. 50-53, an exemplary embodiment of a station 500 for use with the cleaning device 210 of FIG. 34 is shown. It should be recognized that station 500 is described by way of example in use with device 210. However, it is contemplated by the present disclosure for station 500 to find equal use with device 10 and device 410.

Station 500 is configured to hold the various components of device 210. For example, station 500 includes a battery holding area 502, a pole holding area 504, a pouch holding area 506, a cleaning element holding area 508, and a device holding area 510.

Battery holding area 502 can be configured to hold extra batteries. In some embodiments, holding area 502 can be a recharging area to recharge power source 252 where the power source is a rechargeable battery unit. Here, holding area 502 can have one or more externally accessible recharging contacts (not shown) that are electrically coupled to contacts 252A of the power source. In this embodiment, the power source 252 can be removed from device 210 and installed into area 502 for charging.

In addition to or instead of area 502 having contacts that mate with contacts 252A of device 210, device holding area 510 can include such contacts (not shown). In this embodiment, the power source 252 does not need to be removed from device 210, but rather the device having the power source thereon is installed into area 510 for storage and charging.

Pole holding area 504 is configured to store one or more of poles 100 and/or one or more of poles 300.

Pouch holding area 506 is configured to store one or more of pouches 212. Area 506 can, in some embodiments, be subdivided into smaller sections for holding pouches 212 of different chemicals in separate locations.

In embodiments where station 500 is used in combination with device 410, area 506 can be used to store one or more containers of cleaning fluid that are used to refill container 412.

Cleaning element holding area 508 is configured to store one or more cleaning elements 220. Area 508 can be subdivided into separate areas—where one subarea can be used to hold unused cleaning elements 220, while another subarea can be used to hold dirty cleaning elements. Moreover, the subdivided areas can be used to separately hold cleaning elements 220 that have been used with different cleaning chemicals or in the cleaning of different areas (e.g., bath room, kitchen, etc.) to mitigate cross contamination.

In some embodiments, area 508 is configured to store cleaning elements 220 in a manner such that the cleaning elements are oriented with an attachment side facing upward and a cleaning side facing downward. In this manner, station 500 is configured so that a new cleaning element can be installed by simply inserting device 210 into area 508 so that cleaning head 218 and element 220 are connected to one another. In some embodiments, area 508 can include one or more locating features (e.g., protrusions, indentations, and combinations thereof) in the sidewalls of the area that cooperate with corresponding features on cleaning element 220 and/or device 210 to ensure that the device and element are positioned with respect to one another in a desired location simply by the action of inserting the device into area 508. In this manner, station 500 is configured to, for example, ensure that element 220 is centered onto head 218 of device 210.

Referring to the drawings and in particular to FIGS. 54-59, an alternate exemplary embodiment of a cleaning device according to the present disclosure is shown and is generally referred to by reference numeral 610. Here, component parts performing similar or analogous functions to those discussed above are labeled in multiples of six hundred of the original reference numerals. In the interest of brevity, only certain aspects of device 610, that differ from those discussed above with respect to device 210 are discussed herein below.

Device 610 includes a main housing 614 having a handle 616 depending therefrom. Device 610 also includes a cleaning head 618 onto which a cleaning element (not shown) can be removably connected. Device 610 is configured to removably receive a pouch (not shown) within housing 614 in the manner discussed herein above with respect to device 210.

Device 610 is particularly configured for use in cleaning as hard surfaces such as, but not limited to, tables, floors, counters, walls, windows, and the like. For example, device 610 includes handle 616 that lacks openings for connection to an extension pole in the manner discussed above. Rather in this embodiment, device 610 has handle 616 formed on housing 614 at an angle of between 0 to 45 degrees with respect to the plane defined by the surface of head 618 and/or the surface to be cleaned.

In place of the elements of the necessary to form the desired physical and electrical connection with a pole, device 610 includes a power source 652 secured in handle 616. In some embodiments, power source 652 is a battery pack that is removably secured in handle 616 and, thus, includes first electrical contacts 652D that place the power source in electrical communication with device 610 in a known manner when the power source is installed in the device.

Power source 652 can, in some embodiments, include second electrical contacts 652A in electrical communication with one or more rechargeable batteries 652B. Here, contacts 652A can be externally accessible from device 610 when power source 652 is installed in device 610. In this manner, powers source 652 is configured so that device 610 can be inserted into and charged by a recharging station (shown in FIGS. 50-53) without removal of the power source from the device.

Alternately, it is contemplated by the present disclosure for contacts 652A to be positions so that the contacts are not externally accessible from device 610 when power source 652 is installed in device 610. In this manner, power source 652 is configured so that the power source must be removed from device 610 and inserted into a recharging station separate from the device. In this embodiment, it is contemplated by the present disclosure that contacts 652D discussed above that place power source 652 in electrical communication with device can also function as contacts 652A that allow recharging of the power source.

Moreover, it is contemplated by the present disclosure for power source 652 to batteries 652B that are disposable (e.g., illustrated as two standard AA batteries) and can be removed by the end user via a removable cover 652C.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cleaning device comprising:

a cleaning element having a first spray opening;

a cleaning head having a second spray opening, the cleaning element being connected to the cleaning head with the first and second spray openings in alignment with one another;

a housing connected to the cleaning head;

an electric pump and battery in the housing;

a container of cleaning fluid forming a fluid and air tight connection with the pump;

an activation button for selectively placing the pump and the battery in electrical communication; and a spray nozzle having a fluid tight and air tight connection with the pump so that the pump is configured to spray fluid from the container through the first and second spray openings onto a surface to be cleaned, wherein the cleaning head, the cleaning element, and the spray nozzle define a cavity that, when the cleaning element is in contact with the surface to be cleaned, traps spray from the spray nozzle between the cleaning device and the surface to be cleaned.

2. The cleaning device of claim 1, wherein the spray nozzle is positioned on the cleaning head in a position selected from the group consisting of: recessed with respect to a bottom of the cleaning head, flush with the bottom of the cleaning head, and extending from the bottom of the cleaning head a distance less than a thickness of the cleaning element.

3. The cleaning device of claim 1, wherein the cleaning element is removably connected to the cleaning head.

4. The cleaning device of claim 3, wherein the cleaning element is a microfiber cleaning cloth.

5. The cleaning device of claim 1, wherein the cleaning element is selected from the group consisting of: a washable fabric, a disposable fabric, a woven fabric, a non-woven fabric, a microfiber fabric, a fabric made of natural material, a fabric made of synthetic material, a brush, a melamine foam, and any combinations thereof.

6. The cleaning device of claim 1, wherein the cleaning head is removably connected to the housing.

7. The cleaning device of claim 1, wherein the cleaning head is pivotally connected to the housing.

8. The cleaning device of claim 1, wherein the container is a refillable rigid container having a vent.

9. The cleaning device of claim 8, wherein the rigid container comprises a removable cap.

10. The cleaning device of claim 9, wherein the housing further comprises a cover that hingeably covers the cap.

11. The cleaning device of claim 8, wherein the rigid container comprises at least one transparent region that can be viewed from outside of the housing.

12. The cleaning device of claim 8, wherein the rigid container comprises a vent that is normally closed when the pump and the battery are not in electrical communication and is opened by a negative pressure applied on the container when the pump and the battery are in electrical communication.

13. The cleaning device of claim 12, wherein the vent is the only valve in a fluid path from the container through the spray nozzle.

14. The cleaning device of claim 8, wherein the refillable rigid container comprises a flexible tube that places the cleaning fluid in communication with the pump.

15. The cleaning device of claim 14, further comprising a weighted port on the flexible tube in the container.

16. The cleaning device of claim 15, wherein the weighted port further comprises a filter.

17. The cleaning device of claim 14, further comprising a grommet forming a fluid tight seal between the container and the flexible tube to allow the tube to pass through the container.

18. The cleaning device of claim 1, wherein the battery is a rechargeable battery.

19. The cleaning device of claim 1, wherein the battery is removably received in the housing.

20. The cleaning device of claim 1, wherein the housing comprises a handle, the handle being positioned on the housing to allow use in cleaning surfaces selected from the group consisting of: horizontal surfaces, vertical surfaces, and surfaces having any desired angle therebetween.

21. A cleaning kit, comprising:

the cleaning device of claim 1; and a station having one or more of a battery holding area, a pole holding area, a cleaning element holding area, a cleaning fluid holding area, and a device holding area.

22. The cleaning kit of claim 21, wherein the station comprises a battery holding area configured to hold more than one battery.

23. The cleaning kit of claim 21, wherein the station comprises a battery recharging area configured to charge the battery.

24. The cleaning kit of claim 21, wherein the station comprises a device holding area configured to hold the cleaning device so that contacts on the battery mate with corresponding contacts in the device holding area.

* * * * *